US008333245B2

(12) United States Patent
Zupanick et al.

(10) Patent No.: US 8,333,245 B2
(45) Date of Patent: Dec. 18, 2012

(54) ACCELERATED PRODUCTION OF GAS FROM A SUBTERRANEAN ZONE

(75) Inventors: Joseph A. Zupanick, Pineville, WV (US); Monty H. Rial, Dallas, TX (US)

(73) Assignee: Vitruvian Exploration, LLC, The Woodlands, TX (US)

( * ) Notice: Subject to any disclaimer, the term of this patent is extended or adjusted under 35 U.S.C. 154(b) by 0 days.

(21) Appl. No.: 10/246,052

(22) Filed: Sep. 17, 2002

(65) Prior Publication Data

US 2004/0050554 A1 Mar. 18, 2004

(51) Int. Cl.
*E21B 43/00* (2006.01)

(52) U.S. Cl. ..... 166/370; 166/50

(58) Field of Classification Search ..... 166/50, 166/313, 369, 370, 372
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,452,654 | A | 11/1948 | Hayes et al. | |
| 2,490,350 | A | 12/1949 | Grable | 166/4 |
| 2,679,903 | A | 6/1954 | McGowen, Jr. et al. | 166/1 |
| 2,726,847 | A | 3/1955 | McCune et al. | 255/1.6 |
| 2,726,063 | A | 12/1955 | Ragland et al. | 255/1.8 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |

(Continued)

FOREIGN PATENT DOCUMENTS

AU 85/49964 A 11/1986

(Continued)

OTHER PUBLICATIONS

I. D. Palmer et al., "Coalbed Methane Well Completions and Stimulations", Chapter 14, pp. 303.sub.339, Hydrocarbons from Coal, published by the American Association of Petroleum Geologists (1993).*

(Continued)

*Primary Examiner* — John Kreck
(74) *Attorney, Agent, or Firm* — Fish & Richardson P.C.

(57) ABSTRACT

A method and system for surface production of gas from a subterranean zone includes lowering reservoir pressure in an area of a subterranean zone having a medium to low effective permeability through a multi-branching well bore pattern. At least twenty-five percent of the total gas in the area of the subterranean zone is produced within three years of the start of production.

139 Claims, 17 Drawing Sheets

U.S. PATENT DOCUMENTS

| | | | | |
|---|---|---|---|---|
| 2,980,142 | A | 4/1961 | Turak | 137/637.3 |
| 3,135,293 | A | 6/1964 | Hulsey | |
| 3,163,211 | A | 12/1964 | Henley | |
| 3,208,537 | A | 9/1965 | Scarborough | 175/53 |
| 3,347,595 | A | 10/1967 | Dahms et al. | 299/4 |
| 3,362,475 | A | 1/1968 | Huitt et al. | |
| 3,385,382 | A | 5/1968 | Canalizo et al. | |
| 3,406,766 | A | 10/1968 | Henderson | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,578,077 | A | 5/1971 | Glenn, Jr. et al. | |
| 3,582,138 | A | 6/1971 | Loofbourow et al. | |
| 3,587,743 | A | 6/1971 | Howard | |
| 3,647,230 | A | 3/1972 | Smedley | |
| 3,684,041 | A | 8/1972 | Kammerer, Jr. et al. | 175/267 |
| 3,687,204 | A | 8/1972 | Marshall et al. | |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,759,328 | A | 9/1973 | Ueber et al. | |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,106,575 | A | 8/1978 | Bunnelle | |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,137,975 | A | 2/1979 | Pennock | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,296,969 | A | 10/1981 | Willman | |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,356,866 | A | 11/1982 | Savins | |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,075 | A | 8/1983 | Wood et al. | |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,458,767 | A | 7/1984 | Hoehn, Jr. | |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,067 | A | 8/1986 | Burton, Jr. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,676,313 | A | 6/1987 | Rinaldi | |
| 4,702,314 | A | 10/1987 | Huang et al. | 166/245 |
| 4,705,109 | A | 11/1987 | Ledent et al. | |
| 4,705,431 | A | 11/1987 | Gadelle et al. | 405/267 |
| 4,715,440 | A | 12/1987 | Boxell et al. | 166/100 |
| 4,718,485 | A | 1/1988 | Brown et al. | |
| RE32,623 | E | 3/1988 | Marshall et al. | |
| 4,727,937 | A | 3/1988 | Shum et al. | |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,709 | A | 5/1991 | Combe et al. | |
| 5,016,710 | A | 5/1991 | Renard et al. | 166/245 |
| 5,033,550 | A | 7/1991 | Johnson et al. | |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,115,872 | A | 5/1992 | Brunet et al. | |
| 5,127,457 | A | 7/1992 | Stewart et al. | |
| 5,135,058 | A | 8/1992 | Millgard et al. | 175/71 |
| 5,148,875 | A | 9/1992 | Karlsson et al. | 175/62 |
| 5,148,877 | A | 9/1992 | MacGregor | |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |

5,207,271 A 5/1993 Sanchez et al.
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. ... 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,520,252 A 5/1996 McNair
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,664,911 A 9/1997 Bridges et al.
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Andersson et al. ..... 141/59
5,720,356 A 2/1998 Gardes ..... 175/62
5,727,629 A 3/1998 Blizzard, Jr. et al. ..... 166/298
5,733,067 A 3/1998 Hunt et al.
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,941,308 A 8/1999 Malone et al.
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
5,992,524 A 11/1999 Graham
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al. ..... 166/117.6
6,223,839 B1 5/2001 Fraim et al.
6,237,284 B1 5/2001 Erickson
6,244,340 B1 6/2001 McGlothen et al.
6,247,532 B1 6/2001 Ohmer
6,250,391 B1 6/2001 Proudfoot
6,263,965 B1 7/2001 Schmidt et al.
6,279,658 B1 8/2001 Donovan et al.
6,280,000 B1 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B2 8/2002 Zupanick ..... 175/161
6,450,256 B2 9/2002 Mones ..... 166/250.01
6,454,000 B1 9/2002 Zupanick
6,457,540 B2 10/2002 Gardes
6,491,101 B2 12/2002 Ohmer
6,497,556 B2 12/2002 Zupanick et al.
6,554,063 B2 4/2003 Ohmer
6,557,628 B2 5/2003 Ohmer
6,564,867 B2 5/2003 Ohmer
6,566,649 B1 5/2003 Mickael ..... 250/269.3
6,571,888 B2 6/2003 Comeau et al. ..... 175/61
6,575,255 B1 6/2003 Rial et al.
6,577,129 B1 6/2003 Thompson et al. ..... 324/338
6,581,455 B1 6/2003 Berger et al.
6,581,685 B2 6/2003 Burgess et al.
6,585,061 B2 7/2003 Radzinski et al. ..... 175/45
6,590,202 B2 7/2003 Mickael ..... 250/269.2
6,591,903 B2 7/2003 Ingle et al. ..... 166/50
6,591,922 B1 7/2003 Rial et al.
6,595,301 B1 7/2003 Diamond et al.
6,595,302 B1 7/2003 Diamond et al.
6,604,910 B1 8/2003 Zupanick
6,607,042 B2 8/2003 Hoyer et al. ..... 175/38
6,636,159 B1 10/2003 Winnacker ..... 340/854.3
6,639,210 B2 10/2003 Odom et al. ..... 250/269.6
6,644,422 B1 11/2003 Rial et al.
6,646,441 B2 11/2003 Thompson et al.
6,653,839 B2 11/2003 Yuratich et al. ..... 324/355
6,679,322 B1 1/2004 Zupanick
6,722,452 B1 4/2004 Rial et al.
6,758,279 B2 7/2004 Moore et al.
RE38,642 E 11/2004 Gondouin
7,387,165 B2 7/2008 Lopez de Cardenas et al.
7,543,648 B2 6/2009 Hill et al.
2001/0010432 A1* 8/2001 Zupanick ..... 299/12
2002/0043404 A1 4/2002 Trueman et al.
2002/0050358 A1 5/2002 Algeroy et al. ..... 166/313
2002/0074120 A1 6/2002 Scott ..... 166/313
2002/0074122 A1 6/2002 Kelley et al.
2002/0096336 A1 7/2002 Zupanick et al.
2002/0148647 A1 10/2002 Zupanick et al.
2003/0062198 A1 4/2003 Gardes ..... 175/61
2003/0066686 A1 4/2003 Conn ..... 175/57
2003/0075334 A1 4/2003 Haugen et al. ..... 166/313
2003/0164253 A1 9/2003 Trueman et al.

| | | | |
|---|---|---|---|
| 2003/0217842 | A1 | 11/2003 | Zupanick et al. |
| 2003/0221836 | A1 | 12/2003 | Gardes |
| 2003/0234120 | A1 | 12/2003 | Paluch et al. |
| 2004/0007353 | A1 | 1/2004 | Stave |
| 2004/0011560 | A1 | 1/2004 | Rial et al. |
| 2004/0020655 | A1 | 2/2004 | Rusby et al. |
| 2004/0031609 | A1 | 2/2004 | Zupanick |
| 2004/0033557 | A1 | 2/2004 | Scott et al. |
| 2004/0055787 | A1 | 3/2004 | Zupanick |
| 2004/0060351 | A1 | 4/2004 | Gunter et al. |
| 2004/0140129 | A1 | 7/2004 | Gardes |
| 2004/0226719 | A1 | 11/2004 | Morgan et al. |
| 2005/0189117 | A1 | 9/2005 | Pringle et al. |
| 2005/0252689 | A1 | 11/2005 | Gardes |
| 2005/0257962 | A1 | 11/2005 | Zupanick |
| 2006/0000607 | A1 | 1/2006 | Surjaatmadja et al. |
| 2006/0096755 | A1 | 5/2006 | Zupanick |
| 2008/0060571 | A1 | 3/2008 | Zupanick |
| 2008/0060799 | A1 | 3/2008 | Zupanick |
| 2008/0060804 | A1 | 3/2008 | Zupanick |
| 2008/0060805 | A1 | 3/2008 | Zupanick |
| 2008/0060806 | A1 | 3/2008 | Zupanick |
| 2008/0060807 | A1 | 3/2008 | Zupanick |
| 2008/0066903 | A1 | 3/2008 | Zupanick |
| 2008/0149349 | A1 | 6/2008 | Hiron et al. |
| 2008/0245525 | A1 | 10/2008 | Rivas et al. |
| 2009/0084534 | A1 | 4/2009 | Zupanick |

FOREIGN PATENT DOCUMENTS

| | | | | |
|---|---|---|---|---|
| CA | 2 278 735 | | 1/1998 | |
| CA | 2210866 | | 1/1998 | |
| CN | 2248254 | Y | 2/1997 | |
| CN | 1174587 | A | 2/1998 | |
| CN | 1191586 | | 8/1998 | |
| DE | CH 653 741 | | 1/1986 | |
| DE | 197 25 996 | A1 | 1/1998 | |
| EP | 0 819 834 | A1 | 1/1998 | |
| EP | 0 875 661 | A1 | 11/1998 | |
| EP | 0 952 300 | A1 | 10/1999 | |
| EP | 1 316 673 | A2 | 6/2003 | |
| FR | 964503 | | 4/1944 | ..... 8/1 |
| GB | 442008 | | 1/1936 | |
| GB | 444484 | | 3/1936 | |
| GB | 651468 | | 4/1951 | |
| GB | 893869 | | 4/1962 | |
| GB | SU-750108 | | 6/1975 | |
| GB | SU-1448078 | A1 | 3/1987 | |
| GB | SU-1770570 | A1 | 3/1990 | |
| GB | 2 255 033 | | 10/1992 | |
| GB | 2 297 988 | | 8/1996 | |
| GB | 2 347 157 | A | 8/2000 | |
| RU | SU-750108 | | 6/1975 | |
| RU | SU-876968 | | 10/1981 | |
| RU | SU-1448078 | A1 | 3/1987 | |
| RU | SU-1770570 | A1 | 3/1990 | |
| RU | 1709076 | A1 | 1/1992 | |
| RU | 2097536 | C1 | 11/1997 | |
| RU | 2136566 CI | | 9/1999 | |
| RU | 2176311 | C2 | 11/2001 | |
| RU | 2179234 | C1 | 2/2002 | |
| RU | 2205935 | C1 | 6/2003 | |
| UA | 37720 | A | 5/2001 | |
| WO | 94/21889 | | 9/1994 | |
| WO | WO94/28280 | | 12/1994 | |
| WO | WO97/21900 | | 6/1997 | |
| WO | WO98/25005 | | 6/1998 | |
| WO | WO98/35133 | | 8/1998 | |
| WO | WO 98/35133 | | 8/1998 | |
| WO | WO99/60248 | | 11/1999 | |
| WO | 00/31376 | | 6/2000 | |
| WO | WO 00/79099 | | 12/2000 | |
| WO | WO 01/44620 | | 6/2001 | |
| WO | WO 02/18738 | | 3/2002 | |
| WO | WO 02/059455 | | 8/2002 | |
| WO | WO 02/061238 | | 8/2002 | |
| WO | WO 03/038233 | | 5/2003 | |
| WO | WO 03/102348 | | 12/2003 | |
| WO | WO 2004/035984 | A1 | 4/2004 | |
| WO | WO 2005/003509 | | 1/2005 | |
| WO | WO 2005/012688 | | 2/2005 | |

OTHER PUBLICATIONS

McCray and Cole, "Oil Well Drilling and Technology," *University of Oklahoma Press,* pp. 315-319, 1959.

Berger and Anderson, "Modern Petroleum;" *PennWell Books,* pp. 106-108, 1978.

Howard L. Hartman, et al.; "SME Mining Engineering Handbook;" *Society for Mining, Metallurgy, and Exploration, Inc.;* pp. 1946-1950, 2nd Edition, vol. 2, 1992.

Dave Hassan, Mike Chernichen, Earl Jensen, and Morley Frank; "Multi-lateral technique lowers drilling costs, provides environmental benefis", *Drilling Technology,* pp. 41-47, Oct. 1999.

Gopal Ramaswamy, "Production History Provides CBM Insights," *Oil & Gas Journal,* pp. 49, 50 and 52, Apr. 2, 2001.

Arfon H. Jones et al., A Review of the Physical and Mechanical Properties of Coal with Implications for Coal-Bed Methane Well Completion and Production, *Rocky Mountain Association of Geologists,* pp. 169-181, 1988.

Joseph C. Stevens, Horizontal Applications For Coal Bed Methane Recovery, *Strategic Research Institute,* pp. 1-10 (slides), Mar. 25, 2002.

Weiguo Chi and Luwu Yang, "Feasibility of Coalbed Methane Exploration in China," *Horizontal Well Technology,* p. 74, Sep. 2001.

Nackerud Product Description, *Harvest Tool Company, LLC,* 1 page, Received Sep. 27, 2001.

Gopal Ramaswamy, "Advances Key For Coalbed Methane," *The American Oil & Gas Reporter,* pp. 71 & 73, Oct. 2001.

R.J. "Bob" Stayton, "Horizontal Wells Boost CBM Recovery", Special Report: Horizontal & Directional Drilling, *The American Oil & Gas Reporter,* pp. 71-75, Aug. 2002.

U.S. Appl. No. 09/769,098, entitled "Method and System for Enhanced Access to a Subterranean Zone," filed Jan. 24, 2001, 65 pages.

U.S. Appl. No. 09/774,996, entitled "Method and System for Accessing a Subterranean Zone From a Limited Surface Area," filed Jan. 30, 2001, 67 pages.

U.S. Appl. No. 09/788,897, entitled "Method and System for Accessing Subterranean Deposits From The Surface," filed Feb. 20, 2001, 54 pages.

U.S. Appl. No. 10/142,817, entitled "Method and System for Underground Treatment of Materials," filed May 8, 2002, 54 pgs, May 2, 2002.

U.S. Appl. No. 09/885,219, entitled "Method and System for Accessing Subterranean Deposits From The Surface," filed Jun. 20, 2001, 52 pages.

U.S. Appl. No. 10/046,001, entitled "Method and System for Management of By-Products From Subterranean Zones," filed Oct. 19, 2001. 42 pages.

U.S. Appl. No. 10/004,316, entitled "Slant Entry Well System and Method," filed Oct. 30, 2001, 35 pages.

U.S. Appl. No. 10/123,561, entitled "Method and System for Accessing Subterranean Zones From a Limited Surface," filed Apr. 5, 2002, 49 pages.

U.S. Appl. No. 10/123,556, entitled "Method and System for Accessing Subterranean Zones From a Limited Surface," filed Apr. 5, 2002, 49 pages, Apr. 5, 2001.

U.S. Appl. no. 10/165,627, entitled "Method and System for Accessing Subterranean Deposits from the Surface," filed Jun. 7, 2002, 26 pages.

U.S. Appl. No. 10/165,625, entitled "Method and System for Accessing Subterranean Deposits from the Surface," filed Jun. 7, 2002, 26 pages.

Joseph A. Zupanick, "Method and System for Accessing a Subterranean Zone From a Limited Surface," U.S. Appl. No. 10/188,141, Jul. 1, 2002.

Joseph A. Zupanick, "Undulating Well Bore," U.S. Appl. No. 10/194,366, Jul. 12, 2002.

Joseph A. Zupanick, "RampingWell Bores," U.S. Appl. No. 10/194,367, Jul. 12, 2002.

Joseph A. Zupanick, "Wellbore Sealing System and Method," U.S. Appl. No. 10/194,368, Jul. 12, 2002.
Joseph A. Zupanick, "Wellbore Plug System and Method," U.S. Appl. No. 10/194,422, Jul. 12, 2002.
Joseph A. Zupanick, "System and Method for Subterranean Access" U.S. Appl. No. 10/227,057, Aug. 22, 2002.
Joseph A. Zupanick et al., Method and System for Controlling Pressure in a Dual Well System, Sep. 12, 2002.
Joseph A. Zupanick, "Three-Dimensional Well System for Accessing Subterranean Zones", U.S. Appl. No. 10/244,083, Sep. 12, 2002.
Susan Eaton, "Reversal of Fortune", New Technology Magazine, pp. 30-31, Sep. 2002.
James Mahony, "A Shadow of Things to Come", New Technology Magazine, pp. 28-29, Sep. 2002.
Documents Received from Third Party, Great Lakes Directional Drilling, Inc., (12 pages), Received Sep. 12, 2002.
Robert W. Taylor and Richard Russell, Multilateral Technologies Increase Operational Efficiencies in Middle East, Oil & Gas Journal, pp. 76-80, Mar. 16, 1998.
Adam Pasiczynk, "Evolution Simplifies Multilateral Wells", Directional Drilling, pp. 53-55, Jun. 2000.
Steven S. Bell, "Multilateral System with Full Re-Entry Access Installed", World Oil, p. 29, Jun. 1996.
P. Jackson and S. Kershaw, Reducing Long Term Methane Emissions Resulting from Coal Mining, Energy Convers. Mgmt, vol. 37, Nos. 6-8, pp. 801-806, 1996.
Pascal Breant, "Des Puits Branches, Chez Total : les puits multi drains", Total Exploration Production, pp. 1-5, Jan. 1999.
Notification of Transmittal of the International Search Report or the Declaration (PCT Rule 44.1) mailed Dec. 19, 2003 (6 pages) re International Application No. PCT/US 03/28137.
Notification of Transmittal of the International Search Report or the Declaration (PCT Rule 44.1) mailed Feb. 4, 2004 (8 pages) re International Application No. PCT/US 03/26124.
Smith, Maurice, "*Chasing Unconventional Gas Unconventionally,*" CBM Gas Technology, New Technology Magazine, Oct./Nov. 2003, pp. 1-4.
Gardes, Robert "*A New Direction in Coalbed Methane and Shale Gas Recovery,*" (to the best of Applicants' recollection, first received at The Canadian Institute Coalbed Methane Symposium conference on Jun. 16 and Jun. 17, 2002), 1 page of conference flyer, 6 pages of document.
Gardes, Robert, "*Under-Balance Multi-Lateral Drilling for Unconventional Gas Recovery,*" (to the best of Applicants' recollection, first received at The Unconventional Gas Revolution conference on Dec. 9, 2003), 4 pages of conference flyer, 33 pages of document.
Boyce, Richard "*High Resolution Selsmic Imaging Programs for Coalbed Methane Development,*" (to the best of Applicants' recollection, first received at The Unconventional Gas Revolution conference on Dec. 10, 2003), 4 pages of conference flyer, 24 pages of document.
Mark Mazzella and David Strickland, "*Well Control Operations on a Multiwell Platform Blowout,*" WorldOil.com—Online Magazine Article, vol. 22, Part I—pp. 1-7, and Part II—pp. 1-13, Jan. 2002.
Vector Magnetics LLC, Case History, California, May 1999, "*Successful Kill of a Surface Blowout,*" pp. 1-12, May 1999.
Cudd Pressure Control, Inc, "*Successful Well Control Operations—A Case Study: Surface and Subsurface Well Intervention on a Multi-Well Offshore Platform Blowout and Fire,*" pp. 1-17, http://www.cuddwellcontrol.com/literature/successful/successful_well.htm, 2000.
R. Purl, et al., "*Damage to Coal Permeability During Hydraulic Fracturing,*" pp. 109-115 (SPE 21813), 1991.
U.S. Dept. of Energy—Office of Fossil Energy, "*Multi-Seam Well Completion Technology: Implications for Powder River Basin Coalbed Methane Production,*" pp. 1-100, A-1 through A10, Sep. 2003.
U.S. Dept. of Energy—Office of Fossil Energy, "*Powder River Basin-Coalbed Methane Development and Produced Water Management Study,*" pp. 1-111, A-1 through A14, Sep. 2003.
Rudy E. Rogers, "*Coalbed Methane: Principles & Practice,*" Prentice Hall Petroleum Engineering Series, 1994.
Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil and Gas Journal, pp. 28-30, Jan. 25, 2004.
Kalinin, et al., "Drilling Inclined and Horizontal Well Bores," Nedra Publishers, Moscow, 1997, 15 pages.
Arens, V.Zh., "Well-Drilling Recovery of Minerals," Geotechnology, Nedra Publishers, Moscow, 7 pages, 1986.
Notification of Transmittal of the International Search Report or the Declaration (PCT Rule 44.1) mailed Feb. 9, 2004 (6 pages) re International Application No. PCT/US 03/28138, Sep. 9, 2003.
Notification of Transmittal of the International Search Report or the Declaration (PCT Rule 44.1) mailed Feb. 24, 2004 (9 pages) re International Application No. PCT/US 03/30126, Sep. 23, 2003.
Translation of selected pages of Kalinin, et al., "Drilling Inclined and Horizontal Well Bores," Nedra Publishers, Moscow, 1997, 15 pages.
Translation of selected pages of Arens, V.Zh., "Well-Drilling Recovery of Minerals," Geotechnology, Nedra Publishers, Moscow, 7 pages, 1986.
Notification of Transmittal of the International Search Report or the Declaration (PCT Rule 44.1) mailed Nov. 6, 2003 (8 pages) re International Application No. PCT/US 03/21626, Filed Jul. 11, 2003.
Notification of Transmittal of the International Search Report or the Declaration (PCT Rule 44.1) mailed Nov. 5, 2003 (8 pages) re International Application No. PCT/US 03/21627, Filed Jul. 11, 2003.
Notification of Transmittal of the International Search Report or the Declaration (PCT Rule 44.1) mailed Nov. 4, 2003 (7 pages) re International Application No. PCT/US 03/21628, Filed Jul. 11, 2003.
Notification of Transmittal of the International Search Report or the Declaration (PCT Rule 44.1) mailed Dec. 5, 2003 (7 pages) re International Application No. PCT/US 03/21750, Filed Jul. 11, 2003.
Examiner of Record, Office Action Response regarding the Interpretation of the three Russian Patent Applications listed above under Foreign Patent Documents (9 pages), date unknown.
Ian D. Palmer et al., "*Coalbed Methane Well Completions and Stimulations",* Chapter 14, pp. 303-339, Hydrocarbons from Coal, Published by the American Association of Petroleum Geologists, 1993.
B. Gotas et al., "*Performance of Openhole Completed and Cased Horizontal/Undulating Wells in Thin-Bessed, Tight Sand Gas Reservoirs,*" Society of Petroleum Engineers, Inc., Oct. 17 through Oct. 19, 2000, pp. 1-7.
R. Sharma, et al., "*Modelling of Undulating Wellbore Trajectories, The Journal of Canadian Petroleum Technology",* XP-002261908, Oct. 18-20, 1993, pp. 16-24.
E. F. Balbinski et al., "*Prediction of Offshore Viscous Oil Field Performance,*" European Symposium on Improved Oil Recovery, Aug. 18-20, 1999, pp. 1-10.
Chi, Weiguo, "*A feasible discussion on exploitation coalbed methane through horizontal network drilling in China",* SPE 64709, Society of Petroleum Engineers (SPE International), 4 pages, Nov. 7, 2000.
Chi, Weiguo, "*Feasibility of Coalbed Methane Exploitation in China",* synopsis of paper SPE 64709, 1 page.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Kalinin, et al., Translation of Selected Pages from Ch. 4, Sections 4.2 (p. 135), 10.1 (p. 402), 10.4 (pp. 418-419), "*Drilling Inclined and Horizontal Well Bores,*" Moscow, Nedra Publishers, 1997, 4 pages.
Jet Lavanway Exploration, "*Well Survey,*" Key Energy Surveys, Nov. 2, 1997, 3 pages.
Precision Drilling, "*We Have Roots in Coal Bed Methane Drilling,*" Technology Services Group, Published on or before Aug. 5, 2002, 1 page.

U.S. Dept. of Energy, "*New Breed of CBM/CMM Recovery Technology,*" Jul. 2003, 1 page.
Ghiselin, Dick, "*Unconventional Vision Frees Gas Reserves,*" Natural Gas Quarterly, Sep. 2003, 2 pages.
CBM Review, World Coal, *"US Drilling into Asia,"* Jun. 2003, 4 pages.
Skrebowski, Chris, "*US Interest in North Korean Reserves,*" Petroleum, Energy Institute, Jul. 2003, 4 pages.
Diamond et al., entitled "Method and System for Removing Fluid From a Subterranean Zone Using an Enlarged Cavity," U.S. Appl. No. 10/264,535, Oct. 3, 2002 (37 pages).
Zupanick, entitled "Method of Drilling Lateral Wellbores From a Slant Well Without Utilizing a Whipstock," U.S. 10/267,426, Oct. 8, 2002 (24 pages).
Rial et al., entitled "Method and System for Controlling the Production Rate Of Fluid From A Subterranean Zone To Maintain Production Bore Stability In The Zone," U.S. Appl. No. 10/328,408, Dec. 23, 2002 (29 pages).
Zupanick, et al., entitled "Method and System for Recirculating Fluid in a Well System," U.S. Appl. No. 10/457,103, Jun. 5, 2003 (41 pages).
Zupanick, entitled "Method and System for Accessing Subterranean Deposits from the Surface and Tools Therefor," U.S. Appl. No. 10/630,345, Jul. 29, 2003 (366 pages).
Pauley, Steven, entitled "Multi-Purpose Well Bores and Method for Accessing a Subterranean Zone From the Surface," U.S. Appl. No. 10/715,300, Nov. 17, 2003 (34 pages).
Seams, Douglas, entitled "Method and System for Extraction of Resources from a Subterranean Well Bore," U.S. Appl. No. 10/723,322, Nov. 26, 2003 (40 pages).
Zupanick, entitled "Slant Entry Well System and Method," U.S. Appl. No. 10/749,884, Dec. 31, 2003 (28 pages).
Zupanick, entitled "Method and System for Accessing Subterranean Deposits from the Surface," U.S. Appl. No. 10/761,629, Jan. 20, 2004 (38 pages).
Zupanick, entitled "Method and System for Testing A Partially Formed Hydrocarbon Well for Evaluation and Well Planning Refinement," U.S. Appl. No. 10/769,221, Jan. 30, 2004 (34 pages).
Platt, "Method and System for Lining Multilateral Wells," U.S. Appl. No. 10/772,841, Feb. 5, 2004 (30 pages).
Zupanick, "Three-Dimensional Well System For Accessing Subterranean Zones," Feb. 11, 2004, U.S. Appl. No. 10/777,503 (27 pages).
Zupanick, "System And Method For Directional Drilling Utilizing Clutch Assembly," U.S. Appl. No. 10/811,118, Mar. 25, 2004 (35 pages).
Zupanick et al., "Slot Cavity," U.S. Appl. No. 10/419,529, Apr. 21, 2003 (44 pages).
Zupanick, "System and Method for Multiple Wells from a Common Surface Location," U.S. Appl. no. 10/788,694, Feb. 27, 2004 (26 pages).
Field, T.W., "*Surface to In-seam Drilling—The Australian Experience,*" Undated, 10 pages.
Drawings included in CBM well permit issued to CNX stamped Apr. 15, 2004 by the West Virginia Department of Environmenal Protection (5 pages).
Website of Mitchell Drilling Contractors, "*Services: Dymaxion—Surface to In-seam,*" http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction,*" Lucas Technical Paper, copyrighted 2003, 11 pages.
U.S. Department of Energy, DE-FC26-0INT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling,*" Mar. 1999, 1 page.
Desai, Praful, et al., "*Innovative Design Allows Construction of Level 3 or Level 4 Junction Using the Same Platform,*" SPE/Petroleum Society of CIM/CHOA 78965, Canadian Heavy Oil Association, 2002, pp. 1-11.
Bybee, Karen, "*Advanced Openhole Multilaterals,*" Horizontal Wells, Nov. 2002, pp. 41-42.
Bybee, Karen, "*A New Generation Multilateral System for the Troll Olje Field,*" Multilater/Extended Reach, Jul. 2002, 2 pages.
Emerson,, A.B., et al., "*Moving Toward Simpler, Highly Functional Multilateral Completions,*" Technical Note, Journal of Canadian Petroleum Technology, May 2002, vol. 41, No. 5, pp. 9-12.
Moritis, Guntis, "*Complex Well Geometries Boost Orinoco Heavy Oil Producing Rates,*" XP-000969491, Oil & Gas Journal, Feb. 28, 2000, pp. 42-46.
Themig, Dan, "*Multilateral Thinking,*" New Technology Magazine, Dec. 1999, pp. 24-25.
Smith, R.C., et al., "*The Lateral Tie-Back System: The Ability to Drill and Case Multiple Laterals,*" IADC/SPE 27436, Society of Petroleum Engineers, 1994, pp. 55-64, plus Multilateral Services Profile (1 page) and Multilateral Services Specifications (1 page).
Notification of Transmittal of the International Search Report of the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane,*" Hydrocarbons From Coal, Chapter 12, Copyright 1993, Title Page, Copyright Page, pp. 269-285.
Hanes, John, "*Outbursts in Leichhardt Colliery: Lessons Learned,*" International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment,*" Bowen Basin Symposium 2000, pp. 325-333.
Brown, K., et al., "*New South Wales Coal Seam Methane Potential,*" Petroleum Bulletin 2, Department of Mineral Resources, Discovery 2000, Mar. 1996, pp. i-viii, Jan. 1996.
Fipke, S., et al., "*Economical Multilateral Well Technology for Canadian Heavy Oil,*" Petroleum Society, Canadian Institute of Mining, Metallurgy & Petroleum, Paper 2002-100, to be presented in Calgary Alberta, Jun. 11-13, 2002, pp. 1-11.
Daniel.J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.
Kevin Meaney and Lincoln Paterson, "Relative Permeability in Coal," SPE 36986, Society of Petroleum Engineers, Copyright 1996, pp. 231-236.
Calender of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.
Tom Engler and Kent Perry, "Creating a Roadmap for Unconventional Gas R&D," Gas TIPS, Fall 2002, pp. 16-20.
CSIRO Petroleum—SIMEDWin, "Summary of SIMEDWin Capabilites," Copyright 1997-2005, Website: http://www.dpr.csiro.au/ourcapabilites/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol_2004/537.htm, printed Mar. 17, 2005, 7 pages.
Jeffrey R. Levine, Ph.D., "Matrix Shrinkage Coefficient," Undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.
R.W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.
Peter Jackson, "Drilling Technologies for Underground Coal Gasification," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.
Dreiling, Tim, McClelland, M.L. and Bilyeu, Brad, "Horizontal & High Angle Air Drilling in the San Juan Basin, New Mexico," Believed to be dated Apr. 1996, pp. 1-11.
Technology Scene Drilling & Intervention Services, "Weatherford Moves Into Advanced Multilateral Well Completion Technology" and "Productivity Gains and Safety Record Speed Acceptance of UBS," *Reservoir Mechanics,* Weatherford International, Inc., 2000 Annual Report (2 pages).
Santos, Helio, SPE, Impact Engineering Solutions and Jesus Olaya, Ecopetrol/ICP, "*No-Damage Drilling: How to Achieve this Challenging Goal?,*" SPE 77189, Copyright 2002, presented at the IADC/SPE Asia Pacific Drilling Technology, Jakarta, Indonesia, Sep. 9-11, 2002, 10 pages.
Santos, Helio, SPE, Impact Engineering Solutions, "*Increasing Leakoff Pressure with New Class of Drilling Fluid,*" SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos, SPE, Impact Solutions Group, "*Drilling Fluids Approaches for Control of Wellbore Instability in Fractured Formations,*" SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe,*" SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations,*" World Oil, Drilling Report Special Focus, Oct. 2003, 5 pages.
Robert E. Snyder, "Drilling Advances," World Oil, Oct. 2003, 1 page.
U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short-Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/ . . . //, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).

The Official Newsletter of the Cooperative Research Centre for Mining Technology and Equipment, CMTE News 7, "Tight-Radius Drilling Clinches Award," Jun. 2001, 1 page.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by Penn Well Publishing Company (4 pages).
"Economic Justification and Modeling of Multilateral Wells," Economic Analysis, Hart's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).
H.H. Fields, Stephen Krickovic, Albert Sainato, and M.G. Zabetkis, "Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, United States Department of the Interior, 1994 (51 pages).
Technology Scene Drilling & Intervention Services, "Weatherford Moves Into Advanced Multilateral Well Completion Technology," *Reservoir Mechanics,* Weatherford International, Inc., 2000 Annual Report (2 pages).
"A Different Direction for CBM Wells," *W Magazine,* 2004 Third Quarter (5 pages).
Snyder, Robert E., "What's New in Production," *WorldOil Magazine,* Feb. 2005, [retrieved from the internet on Mar. 7, 2005]. http://www.worldoil.com/magazine/MAGAZINE_DETAIL.asp?ART_ID=2507@MONTH_YEAR (3 pages).
Nazzal, Greg, "Moving Multilateral Systems to the Next Level," Strategic Acquisition Expands Weatherford's Capabilities, 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Applications," DOE/EIA-TR-0565, U.S. Department of Energy, Apr. 1993, 30 pages.
PowerPoint Presentation entitled, "Horizontal Coalbed Methane Wells," by Bob Stayton, Computalog Drilling Services, date is believed to have been in 2002.
Denney, Dennis, "*Drilling Maximum-Reservoir-Contact Wells in the Shaybah Field,*" SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Dated on or about Mar. 6, 2003, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/.../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI, Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application No. EP 05020737, 5 pages.
P.C. Thakur and W.N. Poundstone, "Horizontal Drilling Technology for Advance Degasification," Society of Mining Engineers of AIME, Preprint No. 79-113, for presentation at the 1979 AIME Annual Meeting, New Orleans, Lousiana, Feb. 18-22, 1979, Engineering Societies Library stamp dated Feb. 5, 1980, 11 pages.
Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.
Wang Weiping, "Trend of Drilling Technology Abroad," Petroleum Drilling and Production Technology, 1995 (vol. 17), Issue 6, www.cnki.net, 8 pages.

Tver, David, The Petroleum Dictionary, 1980, p. 221.
Rennick, et al., "Demonstration of Safety Plugging of Oil Wells Penetrating Appalachian Coal Mines," Bureau of Mines Coal Mine Health and Safety Research Program, Technical Progress Report—56, U.S. Department of the Interior, Jul. 1972, 25 pages.
George N. Aul and Joseph Cervik, "Grouting Horizontal Drainage Holes in Coalbeds," RI 8375, Bureau of Mines Report of Investigations, U.S. Department of the Interior, 1979, 21 pages.
Paul J. Componation, et al., "Cleaning Out, Sealing and Mining Through Wells Penetrating Areas of Active Coal Mines in Northern West Virginia," MESA Information Report 1052, 1977, 26 pages.
George S. Rice, "Notes on the Prevention of Dust and Gas Explosions in Coal Mines," Technical Papter 56, Department of the Interior Bureau of Mines, copyright 1913, 12 pages.
George S. Rice, et al., "Oil and Gas Wells Through Workable Coal Beds," Bulletin 65, Petroleum Technology 7, Bureau of Mines Internal Industries, copyright 1913, 54 pages.
Pratt, et al, U.S. Patent Application entitled "Cavity Well System," U.S. Appl. No. 11/141,335, May 31, 2005, 19 pages.
Notification of Transmittal of the International Preliminary Report on Patentability (1 page) and International Preliminary Report on Patentability (8 pages) for International Application No. PCT/US2005/002162 mailed May 3, 2006.
J.R. Kelafant, C.M. Boyer, and M.D. Zuber, "Production Potential and Strategies for Coalbed Methane in the Central Appalachian Basin," SPE 18550, Society of Petroleum Engineers, Copyright 1988, 8 pages.
Margaret A. Adams, Jeanne L. Hewitt and Rodney D. Malone, "Coalbed Methane Potential of the Appalachians," SPE/DOE 10802, Society of Petroleum Engineers, Copyright 1982, 10 pages.
F.C. Schwerer and A.M. Pavone, "Effect of Pressure-Dependent Permeability on Well-Test Analyses and Long-Term Production of Methane From Coal Seams," SPE/DOE/GRI 12857, Society of Petroleum Engineers, Copyright 1984, 10 pages.
D. Nathan Meehan, "*Technology Vital for Horizontal Well Success*," Oil & Gas Journal, Dec. 11, 1995, 8 pages.
B.A. Tarr, A.F. Kuckes and M.V. Ac, "*Use of New Ranging Tool to Position a Vertical Well Adjacent to a Horizontal Well*," SPE Drilling Engineering, Jun. 1992, 7 pages.
Dan Themig, "*Multi-Laterals Providing New Options*," The American Oil & Gas Reporter, V. 39, No. 7, Jul. 1996, 4 pages.
Daniel D. Gleltman, "*Integrated Underbalanced Directional Drilling System*," Interim Report for Period of Performance Oct. 1, 1995-Feb. 14, 1996, DOE FETC Contract DE-AC21-95MC31103, Mar. 1997, 23 pages.
J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.
C.A. Ehlig-Economides, G.R. Mowat and C. Corbett, "*Techniques for Multibranch Well Trajectory Design in the Context of a Three-Dimensional Reservoir Model*," SPE 35505, Society of Petroleum Engineers, Copyright 1996, 8 pages.
Stephen R. Dittoe, Albertus Retnanto, and Michael J. Economides, "*An Analysis of Reserves Enhancement in Petroleum Reservoirs with Horizontal and Multi-Lateral Wells*," SPE 37037, Society of Petroleum Engineers, Copyright 1996, 9 pages.
D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.
R.A. Schraufnagel, D.G. Hill and R.A. McBane, "*Coalbed Methane—A Decade of Success*," SPE 28581, Society of Petroleum Engineers, Copyright 1994, 14 page.
Matt C. Rowan and Michael J. Whims, "*Multilateral Well Enhances Gas Storage Deliverability*," Oil 7 Gas Journal, Dec. 25, 1995, 4 pp.
S.W. Bokhari, A.J. Hatch, A. Kyei, and O.C. Wemgren, "*Improved Recovery from Tight Gas Sands with Multilateral Drilling*," Synopsis of SPE 38629, JPT, Jul. 1998, 4 pages.
David C. Oyler, William P. Diamond, and Paul W. Jeran, "*Directional Drilling for Coalbed Degasification*," Program Goals and Progress in 1978, Bureau of Mines Report of Investigations/I979, RI 8380, 1979, 17 pages.
Robert A. Gardes, "*Micro-annulus Under-balanced Drilling of Multilateral Wells*," OFFSHORE, May 1996,4 pages.
J.R. Scofield, B. Laney and P. Woodard, "*Field Experience With Multi-Laterals in the ldd El Shargi North Dome Field (Qatar)*," SPE/IADC 37675, Society of Petroleum Engineers, Copyright 1997, 11 pages.
H. Azoba, O. Akinmoladun, H. Rothenhofer, D. Kent and N. Nawfal, "*World Record Dual-and Tri-lateral Wells*," SPE/IADC 39240, Society of Petroleum Engineers, Copyright 1997, 6 pages.
Gerald L. Finfinger, Leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Chapter 10 by Pramod C. Thakur, "*Methane Control for Longwell Gobs*," Longwall-Shortwall Mining, State of the Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwell Face*," Preprint No. 83-398, Society of Mining Engineers of AIME, for presentation at the SME-AIME Fall Meeting and Exhibit, Salt Lake City, Utah, Oct. 19-21, 1983, 14 pages.
T.L. Logan, J.J. Schwoebel and D.M. Homer, "*Application of Horizontal Drainhole Drilling Technology for Coalbed Methane Recovery*," SPE/DOE 16409, Society of Petroleum Engineers/U.S. Department of Energy, Copyright 1997, 12 pages.
Andre P. Jourdan and Guy A. Baron, "*Elf Drills 1,000+ Ft Horizontally*," Petroleum Engineer International. Sep. 1981, 4 pages.
Nikola Maricic, "*Parametric and Predictive Analysis of Horizontal Well Configurations for Coalbed Methane Reservoirs in Appalachian Basin*," Thesis, \West Virginia University, Department of Petroleum and Natural Gas Engineering, 2004, 162 pages.
Paul F. Conti and Michael Schumacher, "Solution Mining in the Nineties," Presented at the Fall 1991 meeting of the Solution Mining Research Institute, Oct. 27-30, 1991, 11 pages.
William J. McDonald, Ph.D., John H. Cohen, and C. Mel Hightower, "*New Lightweight Fluids for Underbalanced Drilling*," presented at the U.S. Department of Energy (DOE) 1999 Oil & Gas Conference, Dallas, Texas, Jun. 28-30, 1999, 10 pages.
Philip C. Crouse, "*Application and Needs for Advanced Multilateral Technologies and Strategies*," Website: www.netl.doe.gov/publications/proceedings/97/97ng/ng97_pdf/NG2-5.pdf; presented at the U.S. Department of Energy (DOE) 1997 Natural Gas Conference on Mar. 24-27, 1997 in Houston, Texas, 9 pages.
Evaluation of Coalbed Methane Well Types in the San Juan Basin, prepared by Malkewicz Hueni Associates, Inc. for The Bureau of Land Management, Mar. 2004, 23 pages.
Robert William Chase, "*Degasification of Coal Seams Via Vertical Boreholes: A Field and Computer Simulation Study*," Thesis in Petroleum and Natural Gas Engineering, Mar. 1980, 174 pages.
L.Z. Shuck and J. Pasini III, "In Situ Gasification of Eastern Coals," presented at the proceedings of the Coal Processing and Conversion Symposium, Jun. 1-3, 1976, Morgantown, West Virginia, 16 pages.
Terry L. Logan, "Application of Medium Radius Horizontal Drainhole Drilling Technology for Underground Coal Gasification," presented at 13th Annual Underground Coal Gasification Symposium, Aug. 24-26, 1987, Laramie, Wyoming, 10 pages.
S.R. Lindblom and V.E. Smith, "Rocky Mountain 1 Underground Coal Gasification Test," Hanna, Wyoming, Groundwater Evaluation, DOE Grant No. DE-FG21-88MC25038, Final Report, Jun. 10, 1988-Jun. 30, 1993, 5 pages.
Coal-Bed Methane: Potential and Concerns, Survey, U.S. Department of the Interior, U.S. Geological Survey, USGS Fact Sheet FS-123-00, Oct. 2000, 2 pages.
Horizontal and Multilateral Wells, Society of Petroleum Engineers, website: http://www.spe.org/spe/jsp/basic_pf/0,.1104_1714_1003974.00.html, printed Dec. 27, 2006, 5 pages.
Notification of Transmittal of the International Search Report and the Written Opinion of the International Searching Authority, or the Declaration (3 pages), International Search Report (7 pages), and Written Opinion of the International Searching Authority (7 pages) for International Application No. PCT/US2006/021057 dated Jan. 4, 2007.
I.D. Palmer, M.J. Mavor, J.L. Spitler and R.F. Volz, "*Openhole Cavity Completions in Coalbed Methane Wells in the San Juan Basin*," Journal of Petroleum Technology, vol. 45, No. 11, Nov. 1993, 11 pages.
V.S. Orlov, et al., "*Methods for Simultaneous Segregated Production from Multiple Formations Using Single Well*," Series Petroleum Engineering, Moscow, Aurdiomeogi, 1976, translated pp. 6-11, 28-29 and 36-37, 15 pages.
Kalinin A.G. et al., "*Boring of Slanted and Horizontal Well Bores*," Moskva, Nedra, 1997, pp. 453-458, Sections 11.2, 11.2.2, and 11.2.3, 10 pages.
"Report and Recommendation" dated Aug. 30, 2006; issued by Donald E. Ziegler—Special Master in Civil Action No. 05-1574 pending in the United States District Court for the Western District of Pennsylvania, 26 pages.
"Order of Court" dated Oct. 13, 2006; issued by Arthur J. Schwab—United States District Court Judge in Civil Action No. 05-1574 pending in the United States District Court for the Western District of Pennsylvania, 2 pages.
Dreiling, Tim, McClelland, M.L., and Bilyeu, Brad, "Horizontal and High Angle Air Drilling in the San Juan Basin, New Mexico," The Brief, published by Amoco and Chevron by Murphy Publishing, Inc., vol. 2, Issue 6, No. 54, Jun. 1996 (9 pages).
Notification of Transmittal of the International Preliminary Report on Patentability (1 page) and International Preliminary Report on Patentability (10 pages) for International Application No. PCT/US2006/021057 mailed Jul. 9, 2007.
William P. Diamond and David C. Oyler, "Effects of Stimulation Treatments on Coalbeds and Surrounding Strata: Evidence From Underground Observations," RI 9083, Bureau of Mines Report of Investigations, 1987 (53 pages).
W.P. Diamond and D.C. Oyler, "Recent Underground Observations of Intercepted Hydraulic Stimulations in Coalbed Methane Drainage Wells," Preprint No. 85-332, Society of Mining Engineers of AIME, SME-AIME Fall Meeting, Oct. 16-18, 1985 (12 pages).
William P. Diamond, "Underground Observations of Mined-Through Stimulation Treatments of Coalbeds," Methane From Coal Seams Technology, Jun. 1987 (11 pages).
W.P. Diamond, "Characterization of Fracture Geometry and Roof Penetrations Associated with Stimulation Treatments in Coalbeds," 1987 Coalbed Methane Symposium, Nov. 16-19, 1987 (11 pages).
C.M. McCulloch, Maurice Deul and P.W. Jeran, "Cleat in Bituminous Coalbeds," RI 7910, Bureau of Mines Report of Investigations, 1974 (28 pages).
B.E. Law, "The Relationship Between Coal Rank and Cleat Spacing: Implications for the Prediction of Permeability in Coal," Proceedings of the 1993 International Coalbed Methane Symposium, May 17-21, 1993 (7 pages).
C.T. Montgomery and R.E. Steanson, "Proppant Selection: The Key to Successful Fracture Stimulation," Journal of Petroleum Technology, Dec. 1985 (10 pages).
R.W. Veatch, Jr., "Overview of Current Hydraulic Fracturing Design and Treatment Technology—Part 2," Journal of Petroleum Technology, May 1983 (12 pages).
David D. Cramer, "The Unique Aspects of Fracturing Western U.S. Coalbeds," Journal of Petroleum Technology, Oct. 1992 (8 pages).
S.A. Holditch, J.W. Ely, R.H. Carter, and M.E. Semmelbeck, Coal Seam Stimulation Manual, Gas Research Institute, Contract No. 5087-214-1469, Apr. 1990 (265 pages).
Jack E. Nolde, "Coalbed Methane in Virginia," Virginia Minerals, Virginia Division of Mineral Resources, vol. 41, Feb. 1995 (7 pages).
C.H. Elder and Maurice Deul, "Degasification of the Mary Lee Coalbed Near Oak Grove, Jefferson County, Ala., by Vertical Borehole in Advance of Mining," RI 7968, U.S. Bureau of Mines, 1974 (23 pages).
Maureen Lorenzetti, "Policymakers eye frac regulation to protect groundwater," Oil & Gas Journal, Sep. 10, 2001, p. 40 (1 page).
Peter F. Steidl, "Foam Stimulation To Enhance Production From Degasification Wells in the Pittsburgh Coalbed," RI 8286, Bureau of Mines Report of Investigations, 1978 (11 pages).
David G. Hill, "Contribution of Unconventional Gas to U.S. Supply Continues to Grow," Gas Research Institute Gas TIPS, Fall 2001 (6 pages).
Vello A. Kuuskraa and Charles F. Brandenburg, "Coalbed Methane Sparks a New Energy Industry," Oil & Gas Journal, Week of Oct. 9, 1989 (8 pages).
Walter B. Ayers Jr. and Bruce S. Kelso, "Knowledge of Methane Potential for Coalbed Resources Grows, But Needs More Study," Oil & Gas Journal, Oct. 23, 1989 (6 pages).
John E. McElhiney, Robert A. Koenig and Richard A. Schraufnagel, "Evaluation of Coalbed-Methane Reserves Involves Different Techniques," Oil & Gas Journal, Week of Oct. 9, 1989 (8 pages).
Steven W. Lambert, Stanley L. Graves and Arfon H. Jones, "Warrior Basin Drilling, Stimulation Covered," Oil & Gas Journal, Week of Oct. 9, 1989 (7 pages).
Steven W. Lambert and Stanley L. Graves, "Production Strategy Developed," Oil & Gas Journal, Week of Oct. 9, 1989 (4 pages).
Terry L. Logan, Western Basins Dictate Varied Operations, Oil & Gas Journal, Week of Oct. 9, 1989 (7 pages).
Vello A. Kuuskra, Charles M. Boyer II, and Richard A. McBane, "Steps to Assess Resource Economics Covered," Oil & Gas Journal, Week of Oct. 9, 1989 (6 pages).
Richard A. Counts, "Ownership Questions Can Stymie Development of Coalbed Methane," Oil & Gas Journal, Week of Oct. 9, 1989 (6 pages).
Richard A. Schraufnagel, Richard A. McBane and Vello A. Kuuskraa, "Coalbed Methane Development Faces Technology Gaps," Oil & Gas Journal, Week of Oct. 9, 1989 (7 pages).
"US Coalbed Methane Resource Estimates, Issues Aired," Oil & Gas Journal, Sep. 24, 2001 (2 pages).
Dr. Charles R. Nelson, "Coalbed Methane Potential of the U.S. Rocky Mountain Region," Gas TIPS, Fall 2000 (9 pages).
Dr. Charles R. Nelson, "Changing Perceptions Regarding the Size and Production Potential of Coalbed Methane Resources," Gas TIPS, Summer 1999 (9 pages).
Ala. Coalbed Methane Production Hits Record, Coal Age, May 1998 (1 page).
Charles M. Boyer II, "Introduction," Gas Research Institute, Methane From Coal Seams Technology, Aug. 1993 (4 pages).
P.F. Steidl, "Evaluation of Induced Fractures Intercepted by Mining," Proceedings of the 1993 International Coalbed Methane Symposium, May 17-21, 1993 (12 pages).
W.P. Diamond, W.R. Bodden III, M.D. Zuber and R.A. Schraufnagel, "Measuring the Extent of Coalbed Gas Drainage After 10 Years of Production at the Oak Grove Pattern, Alabama," Proceedings of the 1989 Coalbed Methane Symposium, Apr. 17-20, 1989 (10 pages).
W.M. Merritts, W.N. Poundstone and B.A. Light, "Removing Methane (Degasification) From the Pittsburgh Coalbed in Northern West Virginia," Bureau of Mines RI 5977, 1962 (46 pages).
M.L. Skow, Ann G. Kim and Maurice Deul, "Creating a Safer Environment in U.S. Coal Mines," U.S. Bureau of Mines Impact Report, 1980 (56 pages).
Stephen W. Lambert, Michael A. Trevits, and Peter F. Steidl, "Vertical Borehole Design and Completion Practices Used to Remove Methane Gas From Mineable Coalbeds," U.S. Dept. of Energy, 1980 (173 pages).
M.A. Trevits, S.W. Lambert, P.F. Steidl and C.H. Elder, "Methane Drainage Through Small-Diameter Vertical Boreholes," Chapter 9 in U.S. Bureau of Mines Bulletin B687 entitled Methane Control Research: Summary of Results, 1964-80, 1988 (25 pages).
C.M. Boyer II and S.R. Reeves, "A Strategy for Coalbed Methane Production Development Part III: Production Operations," Proceedings of the 1989 Coalbed Methane Symposium, Apr. 17-20, 1989 (5 pages).
R.A. Mills and J.W. Stevenson, "History of Methane Drainage at Jim Walter Resources, Inc.," Proceedings of the 1991 Coalbed Methane Symposium, May 13-16, 1991 (9 pages).
Richard A. Schraufnagel, "Coalbed Methane Production," Chapter 15 of Hydrocarbons from Coal, American Association of Petroleum Geologists, 1993 (21 pages).
Curtis H. Elder, "Effects of Hydraulic Stimulation on Coalbeds and Associated Strata," Bureau of Mines RI 8260, 1977 (25 pages).

A Guide to Coalbed Methane Reservoir Engineering, published by Gas Research Institute, GRI-94/0397, pp. 2.11-2.12, 1996 (3 pages).
Well Performance Manual, Schlumberger, pp. 3-1 and 3-2, Aug. 1993 (4 pages).
Michael Zuber, "Coalbed Methane Engineering Methods," The Society of Petroleum Engineers, Oct. 2006 (161 pages).
James V. Mahoney, P.B. Stubbs, F.C. Schwerer, III and F.X. Dobscha, "Effects of a No-Proppant Foam Stimulation Treatment on a Coal-Seam Degasification Borehole," Journal of Petroleum Technology, Nov. 1981 (9 pages).
S.J. Jeu, T.L. Logan and R.A. McBane, "Exploitation of Deeply Buried Coalbed Methane Using Different Hydraulic Fracturing Techniques in the Piceance Basin, Colorado and San Juan Basin New Mexico," Society of Petroleum Engineers, SPE 18253, copyright 1988 (11 pages).
Stephen E. Laubach, Carol M. Tremain and Walter B. Ayers, Jr., "Coal Fracture Studies: Guides for Coalbed Methane Exploration and Development," Journal of Coal Quality, vol. 10, No. 3, Jul.-Sep. 1991 (8 pages).
Part 1—Production and performance data for wells of the Pinnacle Mine located in Pineville, Wyoming County, West Virginia and other related documents for the period Sep. 1997 through Nov. 2000, 25 pages.
Part 2—Production and performance data for wells of the Pinnacle Mine located in Pineville, Wyoming County, West Virginia and other related documents for the period Sep. 1997 through Nov. 2000, 25 pages.
Part 3—Production and performance data for wells of the Pinnacle Mine located in Pineville, Wyoming County, West Virginia and other related documents for the period Sep. 1997 through Nov. 2000, 25 pages.
Part 4—Production and performance data for wells of the Pinnacle Mine located in Pineville, Wyoming County, West Virginia and other related documents for the period Sep. 1997 through Nov. 2000, 25 pages.
Part 5—Production and performance data for wells of the Pinnacle Mine located in Pineville, Wyoming County, West Virginia and other related documents for the period Sep. 1997 through Nov. 2000, 25 pages.
Part 6—Production and performance data for wells of the Pinnacle Mine located in Pineville, Wyoming County, West Virginia and other related documents for the period Sep. 1997 through Nov. 2000, 25 pages.
Part 7—Production and performance data for wells of the Pinnacle Mine located in Pineville, Wyoming County, West Virginia and other related documents for the period Sep. 1997 through Nov. 2000, 25 pages.
Part 8—Production and performance data for wells of the Pinnacle Mine located in Pineville, Wyoming County, West Virginia and other related documents for the period Sep. 1997 through Nov. 2000, 25 pages.
Part 9—Production and performance data for wells of the Pinnacle Mine located in Pineville, Wyoming County, West Virginia and other related documents for the period Sep. 1997 through Nov. 2000, 25 pages.
Part 10—Production and performance data for wells of the Pinnacle Mine located in Pineville, Wyoming County, West Virginia and other related documents for the period Sep. 1997 through Nov. 2000, 25 pages.
Part 11—Production and performance data for wells of the Pinnacle Mine located in Pineville, Wyoming County, West Virginia and other related documents for the period Sep. 1997 through Nov. 2000, 8 pages.
"Well Lifetime Gas Production" logs from West Virginia Department of Environmental Protection for wells DW-6, DW-7, DW-8B, DW-9, DW-12, 8E-3, 8E-1, 8F-1, 8E-4, DW-14, 8F-3, 8F-2, 8F-4, 8G-1, 8FG-3, 8G-2, 8G-4(93-A), 8HI-1, 8FG-1.5, 8K-1, 8HI-5, 8HI-2, 8HI-3, 8HI-4, 8K-2A, 8K-3a, 8M-2, 8M-1, 8LM-0.5, 8M-3, and 8K4.
Communication of Partial European Search Report (1 page), Partial European Search Report (2 pages), Lack of Unity of Invention Sheet B (2 pages) and Annex to the European Search Report (1 page) for Application No. EP 07 02 1409 dated Aug. 6, 2008.
T. Beims and C. Strunk, "*Capital, Technology Suppliers Pulling New Tricks From The Hat As Industry Hits High Gear*," The American Oil & Gas Reporter, Mar. 1997 (8 pages).
B. Campbell, "*Directional Driller Discovers Future in Technology*," The American Oil & Gas Reporter, Jul. 1991 (4 pages).
"*Economic Justification and Modeling of Multilateral Wells," in "Multilateral Technology: Taking Horizontal Wells to the Next Level*"—A supplement to Hart's Petroleum Engineer, International, 1997 (5 pages).
R. Gardes, "*New Radial Drilling Technology Applied To Recovering Cores*," The American Oil & Gas Reporter, Apr. 1993 (5 pages).
Gardes Energy Services, Inc., Map of Drilled Well Locations (1 page).
"*Gardes Drilling redefines improved recovery*," Improved Recovery Week, vol. 1, No. 21, Jul. 1992 (3 pages).
R. Gardes, "Micro-Annulus Underbalanced Drilling of Multilaterals," 4th Annual North American Conference on Coiled Tubing, Feb. 5-6, 1996 (23 pages).
Johnson et al., "Underbalanced Drilling Design Maximizes Coal Bed Methane Recoveries", *CDX Gas*, Aug. 2008 (6 pages).
B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.
W.H. Leach Jr., "*New Technology for CBM Production*," Oil and Gas Investor, Opportunities in Coalbed Methane, Dec. 2002, 6 pages.
David Wagman, "*CBM Investors Keep Their Guard Up*," Oil and Gas Investor, Opportunities in Coalbed Methane, Dec. 2002, 5 pages.
Stephen D. Schwochow, "*CBM: Coming to a Basin Near You*," Oil and Gas Investor, Opportunities in Coalbed Methane, Dec. 2002, 7 pages.
"*White Paper: Guidebook on Coalbed Methane Drainage for Underground Coal Mines*," paper prepared under U.S. Environmental Protection Agency Cooperative Agreement No. CX824467-01-0 with The Pennsylvania State University by Jan M. Mutmansky, Apr. 1999, 50 pages.
M.G. Zabetakis, Maurice Deul, and M.L. Skow, "*Methane Control in United States Coal Mines—1972*," Information Circular 8600, United States Department of the Interior, Bureau of Mines Information Circular/1973, 26 pages.
B. Goktas, "*A Comparative Analysis of the Production Characteristics of Cavity Completions and Hydraulic Fractures in Coalbed Methane Reservoirs*," Society of Petroleum Engineers, SPE 55600, Copyright 1999, 10 pages.
William P. Diamond and David C. Oyler, "*Drilling Long Horizontal Coalbed Methane Drainage Holes from a Directional Surface Borehole*," Society of Petroleum Engineers, SPE/DOE 8968, 1980, 6 pages.
Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.
Patrick B. Tracy, "*Lateral Drilling Technology Tested on UCG Project*," IADC/SPE 17237, IADC/SPE Drilling Conference, Copyright 1988, 10 pages.
P.S. Sarkar and J.M. Rajtar, "*Transient Well Testing of Coalbed Methane Reservoirs With Horizontal Wells*," SPE 27681, Society of Petroleum Engineers, Copyright 1994, 9 pages.
R.A. Schraufnagel, D.G. Hill and R.A. McBane, "*Coalbed Methane—A Decade of Success*," SPE 28581, Society of Petroleum Engineers, Copyright 1994, 14 pages.
Ian Palmer, John McLennan, and Mike Kutas, "*Completions and Stimulations for Coalbed Methane Wells*," SPE 30012, Society of Petroleum Engineers, Copyright 1995, 13 pages.
John E. Jochen and Bradley M. Robinson, "*Survey of Horizontal Gas Well Activity*," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.

Matt C. Rowan and Michael J. Whims, "*Multilateral Well Enhances Gas Storage Deliverability*," Oil & Gas Journal, Dec. 25, 1995, 4 pages.
Dan Themig, "*Planning and Evaluation are Crucial to Multilateral Wells*," Petroleum Engineer International, Jan. 1996, 3 pages.
Larry Comeau, Randy Pustanyk, Ray Smith and Ian Gilles, "*Lateral Tie-Back System Increases Reservoir Exposure*," World Oil, Jul. 1995, 5 pages.
J. Smith, M.J. Economides and T.P. Frick, "*Reducing Economic Risk in Areally Anisotropic Formations With Multiple-Lateral Horizontal Wells*," SPE 30647 Society of Petroleum Engineers, Copyright 1995, 14 pages.
Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.
William P. Diamond and David C. Oyler, "*Directional Drilling for Coalbed Degasification in Advance of Mining*," Proceedings of the 2nd Annual Methane Recovery from Coalbeds Symposium, Apr. 18-20, 1979, 17 pages.
John L. Stalder, Gregory D. York, Robert J. Kopper, Carl M. Curtis and Tony L. Cole, and Jeffrey H. Copley, "*Multilateral-Horizontal Wells Increase Rate and Lower Cost Per Barrel in the Zuata Field, Faja, Venezuela*," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, and O.C. Werngren, "*Improved Recovery from Tight Gas Sands with Multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and Herbert H. Fields, "*Directionally Controlled Drilling to Horizontally Intercept Selected Strata, Upper Freeport Coalbed, Green County, PA*," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results, 1964-80*," Bureau of Mines Bulletin, Bulletin 687, 1988, 188 pages.
EPA, "*Identifying Opportunities for Methane Recovery at U.S. Coal Mines: Profiles of Selected Gassy Underground Coal Mines 1997-2001*," EPA Publication EPA 430-K-04-003, Jul. 2004, 202 pages.
Marshall DeLuca, "*Multilateral Completions on the Verge of Mainstream*," OFFSHORE, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready for More Sophisticated Multilateral Well Technology*," Petroleum Engineer International, Jan. 1996, 4 pages.
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 page.
Guntis Moritis, "*Smart, Intelligent Wells*," Oil & Gas Journal, Apr. 2, 2001, 6 pages.
Craig Coull, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a Heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.
"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (QATAR)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operator's Experience*," Synopsis of SPE 37493 by C. Ellis et al., JPT, Jul. 1997, 3 pages.
"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al., JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*," Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton, "*Use of Multi-lateral Wells to Access Marginal Reservoirs*," OFFSHORE, Feb. 1999, 3 pages.
J.R. Salas, P.J. Clifford and D.P. Jenkins, "*Brief: Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and Kim Jones, "*How ARCO Drills High-Angle Wells Offshore Indonesia*," World Oil, Mar. 1993, 11 pages.
S. Hovda, et al., "*World's First Application of a Multilateral System Combining a Cased and Cemented Junction With Fullbore Access to Both Laterals*," SPE 36488, Society of Petroleum Engineers, Copyright 1996, 15 pages.
Robert A. Gardes, "*Micro-annulus Under-balanced Drilling of Multilateral Wells*," OFFSHORE, May 1996, 4 pages.
Brent Lowson, "*Phillips Multilateral Features Several Firsts for North Sea*," OFFSHORE, Feb. 1997, 2 pages.
J.R. Scofield, B. Laney and P. Woodard, "*Field Experience With Multi-Laterals in the Idd El Shargi North Dome Field (Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," OFFSHORE, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal of Canadian Petroleum Technology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.

Cliff Hogg, "*Comparison of Multilateral Completion Scenarios and Their Application*," SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.
H. Azoba, O. Akinmoladun, H. Rothenhofer, D. Kent and N. Nawfal, "*World Record Dual- and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.
D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed, Alabama, Using Horizontal Drilling Techniques*," SPE/DOE 8967, Society of Petroleum Engineers, May 18, 1980, 6 pages.
Gerald L. Finfinger, Leonard J. Prosser, and Joseph Cervik,"*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," RI 8097, Bureau of Mines Reporting of Investigations, 1975, 26 pages.
D.G. Masszi and A.A. Kahil, "*Coal Demethanation Principles and Field Experience*," The Journal of Canadian Petroleum Technology, Jul.-Aug. 1982, 4 pages.
Tobias W. Goodman, Joseph Cervik, and George N. Aul, "*Degasification Study From an Air Shaft in the Beckley Coalbed*," RI 8675, Bureau of Mines Report of Investigations, 1982, 23 pages.
P.C. Thakur and H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State of the Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face*," Preprint No. 83-398, Society of Mining Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery from Wyoming Field*," SPE 9418, Society of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery*," SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*," SPE 37131, Society of Petroleum Engineers, Copyright 1996, 13 pages.
S.D. Joshi, "*A Review of Horizontal Well and Drainhole Technology*," SPE 16868, Society of Petroleum Engineers, Copyright 1987, 17 pages.
R. Bitto, A.B. Henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385, Society of Petroleum Engineers, Copyright 1996, 11 pages.
Kelly Falk and Craig McDonald, "*An Overview of Underbalanced Drilling Applications in Canada*," SPE 30129, Society of Petroleum Engineers, Copyright 1995, 9 pages.
"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," OFFSHORE, Jul. 1997, 6 pages.
"*Trilateral Horizontal Wells Add 10 Million bbl for Unocal*," OFFSHORE, Dec. 1993, 2 pages.
Nicholas P. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan, "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From Horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*," RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "Elf Drills 1,000+ Ft Horizontally," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based on Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.

D. Keith Murray, "*Deep Coals Hold Big Part of Resource*," The American Oil & Gas Reporter, May 2002, 8 pages.
Nestor Rivera, et al., "*Multilateral, Intelligent Well Completion Benefits Explored*," Oil & Gas Journal, Apr. 14, 2003, 10 pages.
Handbook on Coal Bed Methane Produced Water: Management and Beneficial Use Alternatives, prepared by ALL Consulting, Jul. 2003, 321 pages.
Nikola Maricic, "*Parametric and Predictive Analysis of Horizontal Well Configurations for Coalbed Methane Reservoirs in Appalachian Basin*," Thesis, West Virginia University, Department of Petroleum and Natural Gas Engineering, 2004, 162 pages.
Nikola Maricic, Shahab D. Mohaghegh, and Emre Artun, "*A Parametric Study on the Benefits of Drilling Horizontal and Multilateral Wells in Coalbed Methane Reservoirs*," SPE 96018, Society of Petroleum Engineers, Copyright 2005, 8 pages.
D.P. Schlick and J.W. Stevenson, "*Methane Degasification Experience at Jim Walter's*," Proceedings of the Twelfth Annual Institute on Coal Mining Health, Safety and Research, Aug. 25-27, 1981, 9 pages.
P.C. Thakur, "*Optimum Methane Drainage in Gassy Coal Mines*," 2003 SME Annual Meeting, copyright 2003 by SME, 4 pages.
Global Methane and the Coal Industry: A Two-Part Report on Methane Emissions from the Coal Industry and Coalbed Methane Recovery and Use, Coal Industry Advisory Board, International Energy Agency, copyright 1994, 72 pages.
Paul F. Conti and Michael Schumacher, "*Solution Mining in the Nineties*," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages) and Amended Sheets (9 pages) for International Application No. PCT/US2004/012029 mailed Aug. 11, 2005.
Notification Concerning Transmittal of Copy of International Preliminary Report on Patentability (1 page), International Preliminary Report on Patentability (1 page), and Written Opinion (5 pages) for International Application No. PCT/US2005/005289 mailed Sep. 8, 2006.
Invitation to Pay Additional Fees (2 pages) and Annex to Form PCT/ISA/206 Communication Relating to the Results of the Partial International Search (3 pages) for International Application No. PCT/US2006/021057 mailed Sep. 11, 2006.
Kalinin, D.G., et al., Translation of Selected Pages, "Boring Direction and Horizontal Wells," Moscow, "Nedra", 1997, p. 11-12, 148-152 (15 pages).
Anderson #1R Horizontal Multilateral Historic Production.
Penrose #1R Horizontal Multilateral Historic Production.
Anderson #1 Horizontal Multilateral Production Graph.
M.J. Mavor et al., Formation Evaluation of Exploration Coalbed Methane Wells, paper to be presented at international technical meeting hosted by Petroleum Society of CIM and the Society of Petroleum Engineers in Calgary, Jun. 10-13, 1990, 12 pages.
The State Intellectual Property Office of the People's Republic of China, "Third Office Action", Application No. 200710152916.9, issued on Aug. 1, 2012 (4 pages).
Butler, Jeffrey, "Examination Report", Canadian Appl. No. 2,661,725, dated Jun. 6, 2011 (3 pages).
The State Intellectual Property Office of the People's Republic of China, "The First Office Action", Chinese Appl. No. 99815570.5, dated Apr. 29, 2005 (6 pages).
Ron Weber, "Examination Report", Australian Appl. No. 2011200364, dated Dec. 22, 2011 (2 pages).

* cited by examiner

SIMULATED CUMULATIVE GAS PRODUCTION FOR A MULTILATERAL WELL AS A FUNCTION OF LATERAL SPACING

ACCELERATED PRODUCTION OF GAS FROM A SUBTERRANEAN ZONE

TECHNICAL FIELD OF THE INVENTION

The present invention relates generally to the recovery of subterranean resources, and more particularly to a method and system for accelerated production of gas from a subterranean zone.

BACKGROUND OF THE INVENTION

Subterranean deposits of coal, whether of "hard" coal such as anthracite or "soft" coal such as lignite or bituminous coal, contain substantial quantities of entrained methane gas. Limited production and use of methane gas from coal deposits has occurred for many years. Substantial obstacles have frustrated more extensive development and use of methane gas deposits in coal seams.

One problem in producing methane gas from coal seams is that while coal seams may extend over large areas, up to several thousand acres, and may vary in depth from a few inches to many feet. Coal seams may also have a low permeability. Thus, vertical wells drilled into the coal deposits for obtaining methane gas can generally only drain a fairly small radius of methane gas in low and even medium permeability coal deposits. As a result, once gas in the vicinity of a vertical well bore is produced, further production from the coal seam through the vertical well is limited.

Another problem in producing methane gas from coal seams is subterranean water which must be drained from the coal seam in order to produce the methane. As water is removed from the coal seam, it may be replaced with recharge water flowing from other virgin areas of the coal seam and/or adjacent formations. This recharge of the coal seam extends the time required to drain the coal seam and thus prolongs the production time for entrained methane gas which may take five years, ten years, or even longer. When the area of the coal seam being drained is near a mine or other subterranean structure that reduces water and/or recharge water by itself draining water from the coal seam or in areas of high permeability, methane gas may be produced from the coal seam after a shorter period of water removal. For example, in Appalachia coal beds with a high permeability of ten to fifteen millidarcies have in four or five months been pumped down to the point where gas can be produced.

SUMMARY OF THE INVENTION

The present invention provides a method and system for surface production of gas from a subterranean zone that substantially eliminates or reduces the disadvantages and problems associated with previous systems and methods. In a particular embodiment, water and gas are produced from a coal seam or other suitable subterranean zone through a horizontal drainage pattern having a plurality of cooperating bores that lower water pressure throughout the drainage area of the pattern to allow accelerated release of gas in the zone.

In accordance with one embodiment of the present invention, a method and system for surface production of gas from a subterranean zone includes lowering reservoir pressure in an area of a subterranean zone having a medium to low effective permeability by removing water from the area through a well bore pattern. The well bore pattern comprises a multi-branching pattern that provides a drainage network for the area. In a particular embodiment, twenty-five percent of the total gas in the area of the subterranean zone is produced within three years of the start of production.

More specifically, in accordance with a particular embodiment of the present invention, the well bore pattern may include a plurality of cooperating bores. In this and other embodiments, reservoir pressure may be substantially and uniformly dropped throughout the area of the subterranean zone by producing water and/or gas through the cooperating bores of the well bore pattern. The gas may also be produced in two-phase flow with the water. The gas may be produced in a self-sustaining flow. The well bore pattern may be a pinnate or other omni-directional pattern that intersects a substantial number of natural fractures, which may comprise cleats, of the subterranean zone. In addition, the pattern may cover a substantially symmetrical area of the subterranean zone. In one or more embodiments, the patterns may be nested to cover a field, formation or other large area.

In other embodiments of the present invention, the twenty-five percent of gas in the area of the subterranean zone may be produced within eighteen months, one year, nine months or even six months of the start of water production. In addition, up to two-thirds of the gas in the area of the subterranean zone may be produced within five or even three years of the start of production. In one or more embodiments, excluding the production spike caused by drainage of gas immediately near the well bore, production may have a peak with a steep-sloped expediential decline. The peak production rate may occur within months of the start of production with a majority of gas and/or produceable gas in the area being produced prior to a production decline from the peak reaching one-quarter of the peak rate.

Technical advantages of the present invention include providing accelerated gas production from subsurface coal, shale and other suitable formations. In a particular embodiment, reservoir pressure of a target formation is substantially uniformly reduced across a coverage area to initiate early gas release. Gas may be produced in two-phase flow with entrained water. In addition, the released gas may lower the specific gravity and/or viscosity of the produced fluid thereby further accelerating production from the formation. Moreover, the released gas may act as a propellant for two-phase flow production. In addition, the pressure reduction may affect a large rock volume causing a bulk coal or other formation matrix to shrink and further accelerate gas release. For a coal formation, the attendant increase in cleat width may increase formation permeability and may thereby further expedite gas production from the formation.

Another technical advantage of the present invention includes providing a substantially uniform pressure drop across a non-disjointed coverage area of the well bore pattern. As a result, substantially all of the formation in the coverage area is exposed to a drainage point and continuity of the flow unit is enhanced. Thus, trapped zones of unrecovered gas are minimized.

Still another technical advantage of one or more embodiments of the present invention include providing a well bore pattern with cooperating bores that effectively increase well-bore radius. In particular, a large surface area of lateral bores promotes high flow rates and minimizes skin damage affects. In addition, troughs of pressure reduction of the lateral bores effect a greater area of the formation than a cone of pressure reduction of a vertical bore.

Still another technical advantage of one or more embodiments of the present invention includes providing an omni-directional well bore pattern that may in any horizontal or other suitable orientation intersect a substantial number of natural fractures, which may comprise cleats, of a coal seam or other formation. As a result, water and/or gas may be produced from a medium to low permeability coal seam despite low relative permeabilities of the formation matrix to water and gas. In addition, the orientation of the natural fractures need not be determined or accounted for in orienting the well bore pattern.

Still another technical advantage of one or more embodiments of the present invention includes maintaining hydraulic seal integrity of a coal or other suitable formation during gas production. A pinnate or other substantially uniform pattern allows gas production without hydraulic fracturing operations which may fracture seals between the coal and adjacent water bearing sands and cause significant water influx. In addition, the cooperating bores capture recharge water at the perimeter of the drainage area and provide a shield for the coverage area, trapped cell pressure reduction and continued depleted pressure between the cooperating bores.

Still another technical advantage of one or more embodiments of the present invention includes eliminating the need for large artificial lift devices by providing self-sustaining gas production in a coal, shale or other suitable seam. In particular, water head pressure is suitably drawn down in the reservoir within a few weeks or months of the start of production allowing high gas flow rates to then lift the water and kick-off the well. Thereafter, a chain reaction sustains gas production and lifts water with the gas.

Still another technical advantage of one or more embodiments of the present invention includes obtaining substantial release of non-near well bore gas within a period of a few weeks of the start of production by blowing down the well at the start of water production. In particular, compressed air is pumped down a tubing string to gas lift water collected from the subterranean zone at the surface. In this way, depending on the amounts of water in the zone and the well bore pattern, up to five thousand barrels or more of water may be produced per day from the subterranean zone. This may kick-off the well within one or a couple of weeks, allow a peak production rate under continuous flow conditions to be reached within a period of months and allow the bulk of gas to be produced within one, two or a few years of the start of production.

Yet another technical advantage of one or more embodiments of the present invention includes providing an enhanced and/or accelerated revenue stream for coal bed methane and other suitable gas production. In particular, accelerated production of gas allows drilling and operating expenses for gas production of a field to become self-sustaining within a year as opposed to a three to five year period for typical production operations. As a result, use of capital per field is reduced. In addition, an accelerated rate of return may be provided for a given investment.

The above and elsewhere described technical advantages of the present invention may be provided and/or evidenced by some, all or none of the various embodiments of the present invention. In addition, other technical advantages of the present invention may be readily apparent to one skilled in the art from the following figures, descriptions and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
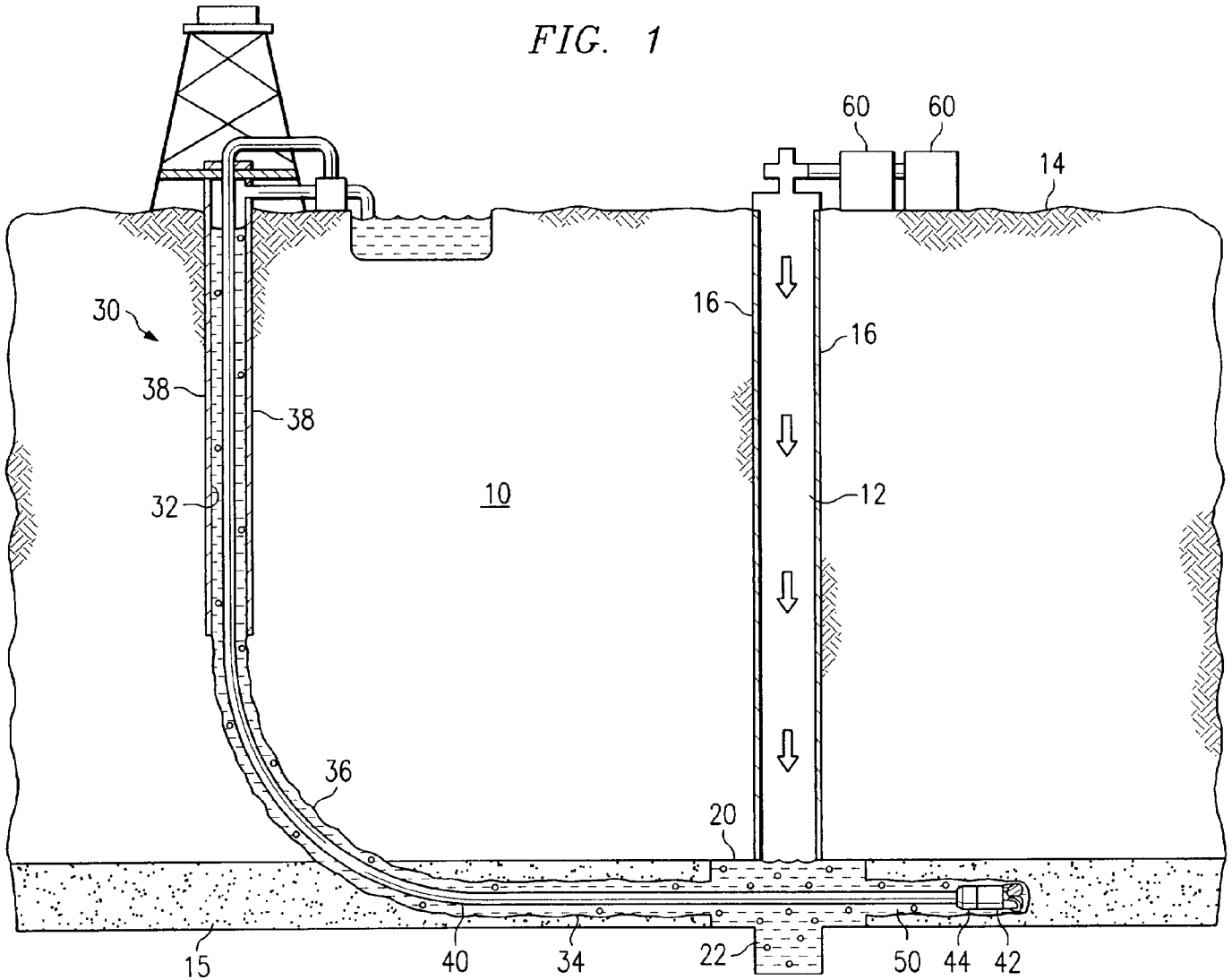
FIG. 1 is a cross-sectional diagram illustrating formation of a multi-well system for accessing a subterranean zone from the surface in accordance with one embodiment of the present invention.

FIG. 1 illustrates formation of a dual well system 10 for enhanced access to a subterranean, or subsurface, zone from the surface in accordance with an embodiment of the present invention. In this embodiment, the subterranean zone is a tight coal seam having a medium to low permeability. It will be understood that other suitable types of zones and/or other types of low pressure, ultra-low pressure, and low porosity subterranean formations can be similarly accessed using the present invention to lower reservoir or formation pressure and produce hydrocarbons such as methane gas and other products from the zone. For example, the zone may be a shale or other carbonaceous formation.

Referring to FIG. 1, the system 10 includes a well bore 12 extending from the surface 14 to a target coal seam 15. The well bore 12 intersects, penetrates and continues below the coal seam 15. The well bore 12 may be lined with a suitable well casing 16 that terminates at or above the level of the coal seam 15. The well bore 12 is substantially vertical or non-articulated in that it allows sucker rod, Moineau and other suitable rod, screw and/or other efficient bore hole pumps or pumping system to lift fluids up the bore 12 to the surface 14. Thus, the well bore 12 may include suitable angles to accommodate surface 14 characteristics, geometric characteristics of the coal seam 15, characteristics of intermediate formations and may be slanted at a suitable angle or angles along its length or parts of its length. In particular embodiments, the well bore 12 may slant up to 35 degrees along its length or in sections but not itself be fully articulated to horizontal.

The well bore 12 may be logged either during or after drilling in order to closely approximate and/or locate the exact vertical depth of the coal seam 15. As a result, the coal seam 15 is not missed in subsequent drilling operations. In addition, techniques used to locate the coal seam 15 while drilling need not be employed. The coal seam 15 may be otherwise suitably located.

An enlarged cavity 20 is formed in the well bore 12 in or otherwise proximate to the coal seam 15. As described in more detail below, the enlarged cavity 20 provides a point for intersection of the well bore 12 by an articulated well bore used to form a horizontal multi-branching or other suitable subterranean well bore pattern in the coal seam 15. The enlarged cavity 20 also provides a collection point for fluids drained from the coal seam 15 during production operations and may additionally function as a gas/water separator and/or a surge chamber. In other embodiments, the cavity may be omitted and the wells may intersect to form a junction or may intersect at any other suitable type of junction.

The cavity 20 is an enlarged area of one or both well bores and may have any suitable configuration. In one embodiment, the cavity 20 has an enlarged radius of approximately eight feet and a vertical dimension that equals or exceeds the vertical dimension of the coal seam 15. In another embodiment, the cavity 20 may have an enlarged substantially rectangular cross section perpendicular to an articulated well bore for intersection by the articulated well bore and a narrow width through which the articulated well bore passes. In these embodiments, the enlarged cavity 20 may be formed using suitable under-reaming techniques and equipment such as a dual blade tool using centrifugal force, ratcheting or a piston for actuation, a pantograph and the like. The cavity may be otherwise formed by fracing and the like. A portion of the well bore 12 may continue below the cavity 20 to form a sump 22 for the cavity 20. After formation of the cavity 20, well 12 may be capped with a suitable well head.

An articulated well bore 30 extends from the surface 14 to the enlarged cavity 20 of the well bore 12. The articulated well bore 30 may include a portion 32, a portion 34, and a curved or radiused portion 36 interconnecting the portions 32 and 34. The portion 32 is substantially vertical, and thus may include a suitable slope. As previously described, portion 32 may be formed at any suitable angle relative to the surface 14 to accommodate surface 14 geometric characteristics and attitudes and/or the geometric configuration or attitude of the coal seam 15. The portion 34 is substantially horizontal in that it lies substantially in the plane of the coal seam 15. The portion 34 intersects the cavity 20 of the well bore 12. It should be understood that portion 34 may be formed at any suitable angle relative to the surface 14 to accommodate the dip or other geometric characteristics of the coal seam 15. It will also be understood that the curved or radius portion 36 may directly intersect the cavity 20 and that the portion 34 may undulate, be formed partially or entirely outside the coal seam 15 and/or may be suitably angled.

In the embodiment illustrated in FIG. 1, the articulated well bore 30 is offset a sufficient distance from the well bore 12 at the surface 14 to permit the large radius curved section 36 and any desired portion 34 to be drilled before intersecting the enlarged cavity 20. To provide the curved portion 36 with a radius of 100–150 feet, the articulated well bore 30 may be offset a distance of about 300 feet from the well bore 12. This spacing reduces or minimizes the angle of the curved portion 36 to reduce friction in the articulated well bore 30 during drilling operations. As a result, reach of the drill string through the articulated well bore 30 is increased and/or maximized. In another embodiment, the articulated well bore 30 may be located within close proximity of the well bore 12 at the surface 14 to minimize the surface area for drilling and production operations. In this embodiment, the well bore 12 may be suitably sloped or radiused to extend down and over to a junction with the articulated bore 30. Thus, as described in more detail below in connection with FIG. 14, the multi-well system may have a vertical profile with a limited surface well bore area, a substantially larger subsurface well bore junction area and a still substantially larger subsurface coverage area. The surface well bore area may be minimized to limit environmental impact. The subsurface well bore junction area may be enlarged with respect to the surface area due to the use of large-radius curves for formation of the horizontal drainage pattern. The subsurface coverage area is drained by the horizontal pattern and may be optimized for drainage and production of gas from the coal seam 15 or other suitable subterranean zone.

In one embodiment, the articulated well bore 30 is drilled using a drill string 40 that includes a suitable down-hole motor and bit 42. A measurement while drilling (MWD) device 44 is included in the articulated drill string 40 for controlling the orientation and direction of the well bore drilled by the motor and bit 42. The portion 32 of the articulated well bore 30 is lined with a suitable casing 38.

After the enlarged cavity 20 has been successfully intersected by the articulated well bore 30, drilling is continued through the cavity 20 using the articulated drill string 40 and appropriate drilling apparatus to provide a subterranean well bore, or drainage pattern 50 in the coal seam 15. In other embodiments, the well bore 12 and/or cavity 20 may be otherwise positioned relative to the well bore pattern 50 and the articulated well 30. For example, in one embodiment, the well bore 12 and cavity 20 may be positioned at an end of the well bore pattern 50 distant from the articulated well 50. In another embodiment, the well bore 12 and/or cavity 20 may be positioned within the pattern 50 at or between sets of laterals. In addition, portion 34 of the articulated well may have any suitable length and itself form the well bore pattern 50 or a portion of the pattern 50. Also, pattern 50 may be otherwise formed or connected to the cavity 20.

The well bore pattern 50 may be substantially horizontal corresponding to the geometric characteristics of the coal seam 15. The well bore pattern 50 may include sloped, undulating, or other inclinations of the coal seam 15 or other subterranean zone. During formation of well bore pattern 50, gamma ray logging tools and conventional MWD devices may be employed to control and direct the orientation of the drill bit 42 to retain the well bore pattern 50 within the confines of the coal seam 15 and to provide substantially uniform coverage of a desired area within the coal seam 15.

In one embodiment, as described in more detail below, the drainage pattern 50 may be an omni-directional pattern operable to intersect a substantial or other suitable number of fractures in the area of the coal seam 15 covered by the pattern 50. The drainage pattern 50 may intersect a significant number of fractures of the coal seam 15 when it intersects a majority of the fractures in the coverage area and plane of the pattern 50. In other embodiments, the drainage pattern 50 may intersect five, ten, twenty-five, forty or other minority percentage of the fractures or intersect sixty, seventy-five, eighty or other majority or super majority percentage of the fractures in the coverage area and plane of the pattern 50. The coverage area may be the area between the well bores of the drainage network of the pattern 50.

The drainage pattern 50 may be a pinnate pattern, other suitable multi-lateral or multi-branching pattern, other pattern having a lateral or other network of bores or other patterns of one or more bores with a significant percentage of the total footage of the bores having disparate orientations. The percentage of the bores having disparate orientations is significant when twenty-five to seventy-five percent of the bores have an orientation at least twenty degrees offset from other bores of the pattern. In a particular embodiment, the well bores of the pattern 50 may have three or more main orientations each including at least 10 percent of the total footage of the bores. As described below, the pattern 50 may have a plurality of bores extending outward of a center point. The bores may be oriented with a substantially equal radial spacing between them. The bores may in some embodiments be main bores with a plurality of lateral bores extending from each main bore. In another embodiment, the radially extending bores may together and alone form a multi-lateral pattern.

During the process of drilling the well bore pattern 50, drilling fluid or "mud" is pumped down the drill string 40 and circulated out of the drill string 40 in the vicinity of the bit 42, where it is used to scour the formation and to remove formation cuttings. The cuttings are then entrained in the drilling fluid which circulates up through the annulus between the drill string 40 and the walls of well bore 30 until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore 30 corresponding to the well bore 30 depth. Because coal seams 15 tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an over-balanced drilling operation in which the hydrostatic fluid pressure in the well bore 30 exceeds the ability of the formation to withstand the pressure. Loss of drilling fluids and cuttings into the formation not only is expensive in terms of the lost drilling fluids, which must be made up, but it also tends to plug the pores in the coal seam 15, which are needed to drain the coal seam 15 of gas and water.

To prevent over-balance drilling conditions during formation of the well bore pattern 50, air compressors 60 may be provided to circulate compressed air down the well bore 12 and back up through the articulated well bore 30. The circulated air will admix with the drilling fluids in the annulus around the drill string 40 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to less than the pressure of the hydrostatic column. For example, in some formations, down-hole pressure may be reduced to approximately 150–200 pounds per square inch (psi). Accordingly, low pressure coal seams and other subterranean resources can be drilled without substantial loss of drilling fluid and contamination of the resource by the drilling fluid.

Foam, which may be compressed air mixed with water or other suitable fluid, may also be circulated down through the drill string 40 along with the drilling mud in order to aerate the drilling fluid in the annulus as the articulated well bore 30 is being drilled and, if desired, as the well bore pattern 50 is being drilled. Drilling of the well bore pattern 50 with the use of an air hammer bit or an air-powered down-hole motor will also supply compressed air or foam to the drilling fluid. In this case, the compressed air or foam which is used to power the down-hole motor and bit 42 exits the articulated drill string 40 in the vicinity of the drill bit 42. However, the larger volume of air which can be circulated down the well bore 12 permits greater aeration of the drilling fluid than generally is possible by air supplied through the drill string 40.

Figure 2:
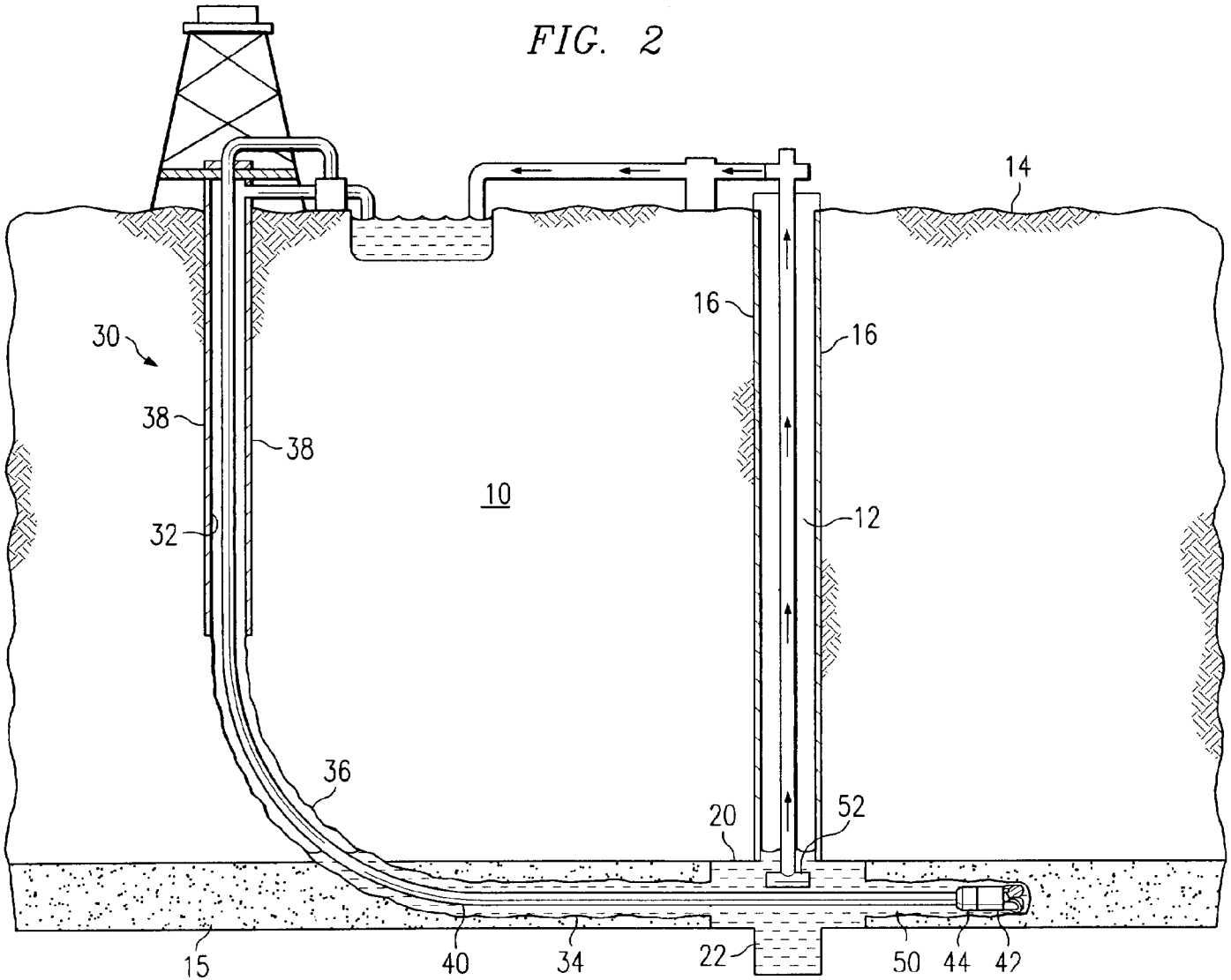
FIG. 2 is a cross-sectional diagram illustrating formation of the multi-well system for accessing the subterranean zone from the surface in accordance with another embodiment of the present invention.

FIG. 2 is a diagram illustrating formation of the multi-well system 10 in accordance with another embodiment of the present invention. In this embodiment, the well bore 12, cavity 20 and articulated well bore 30 are positioned and formed as previously described in connection with FIG. 1. Referring to FIG. 2, after intersection of the cavity 20 by the articulated well bore 30, a Moineau or other suitable pump 52 is installed in the cavity 20 to pump drilling fluid and cuttings to the surface 14 through the well bore 12. This eliminates or reduces both the head pressure and the friction of air and fluid returning up the articulated well bore 30 and reduces down-hole pressure to nearly zero. Accordingly, coal seams and other subterranean resources having ultra low pressures below 150 psi can be accessed from the surface 14. Additionally, the risk of combining air and methane in the well is eliminated.

Figure 3A:
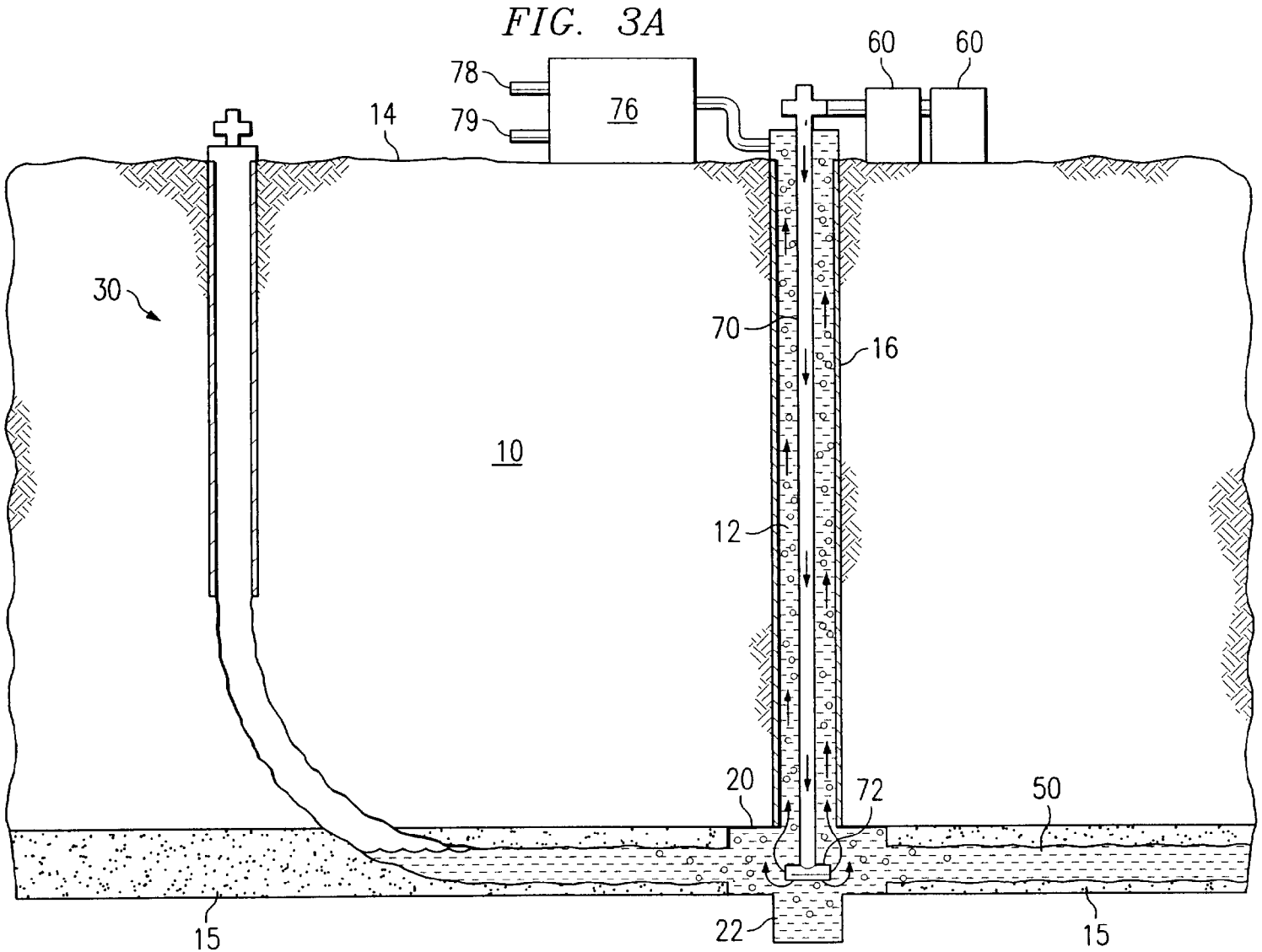
FIGS. 3A–B are cross-sectional diagrams illustrating production from the subterranean zone to the surface using the multi-well system in accordance with several embodiments of the present invention.
Figure 3B:
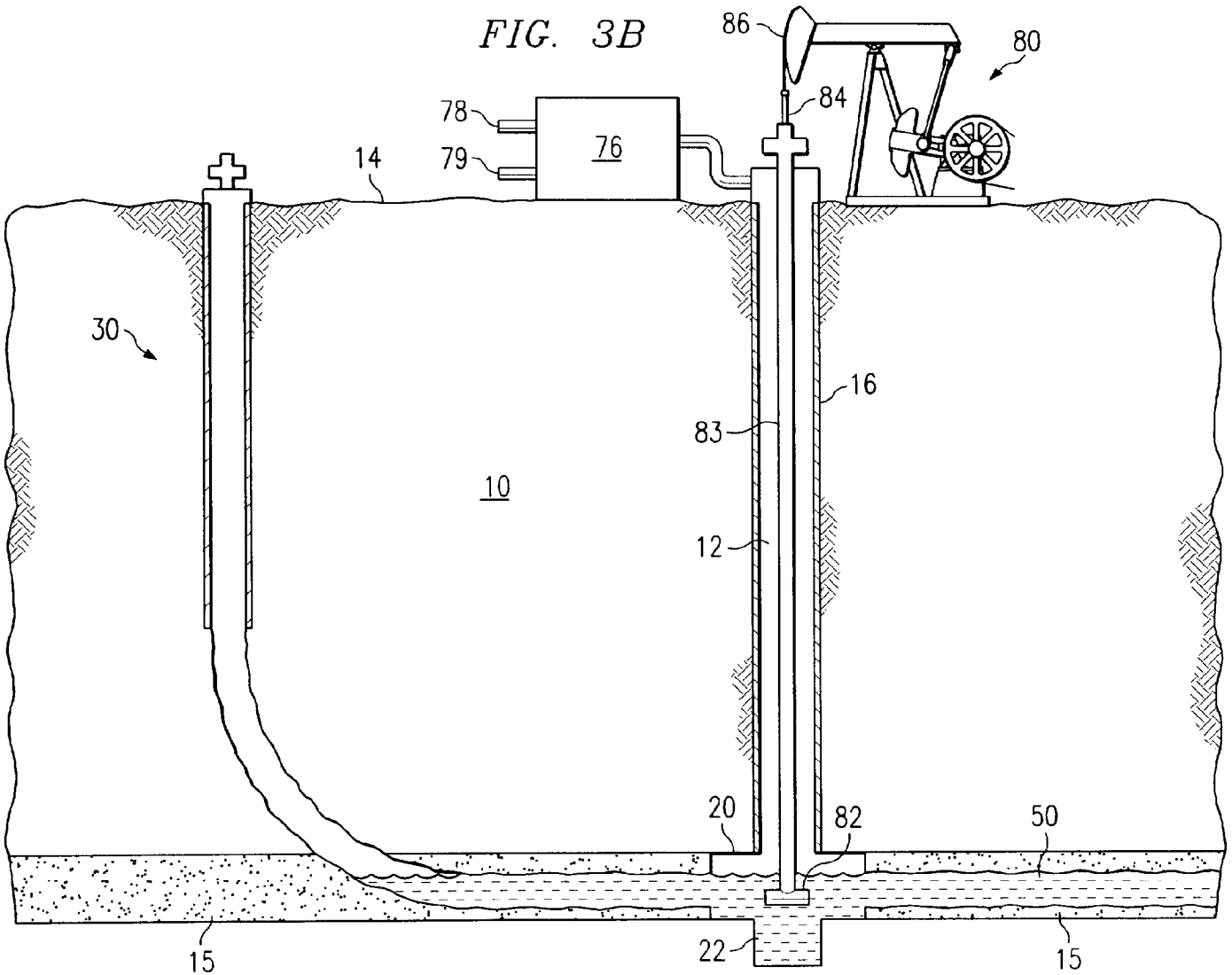

FIGS. 3A–B illustrate production from the coal seam 15 to the surface using the multi-well system 10 in accordance with several embodiments of the present invention. In particular, FIG. 3A illustrates the use of gas lift to produce water from a coal seam 15. FIG. 3B illustrates the use of a rod pump to produce water from the coal seam 15. In one embodiment, water production may be initiated by gas lift to clean out the cavity 20 and kick-off production. After production kick-off, the gas lift equipment may be replaced with a rod pump for further removal of water during the life of the well. Thus, while gas lift may be used to produce water during the life of the well, for economic reasons, the gas lift system may be replaced with a rod pump for further and/or continued removal of water from the cavity 20 over the life of the well. In these and other embodiments, evolving gas disorbed from coal in the seam 15 and produced to the surface 14 is collected at the well head and after fluid separation may be flared, stored or fed into a pipeline.

As described in more detail below, for water saturated coal seams 15 water pressure may need to be reduced below the initial reservoir pressure of an area of the coal seam 15 before methane and other gas will start to diffuse or disorb from the coal in that area. For shallow coal beds at or around 1000 feet, the initial reservoir pressure is typically about 300 psi. For undersaturated coals, pressure may need to be reduced well below initial reservoir pressure down to the critical disorbtion pressure. Sufficient reduction in the water pressure for gas production may take weeks and/or months depending on configuration of the well bore pattern 50, water recharge in the coal seam 15, cavity pumping rates and/or any subsurface drainage through mines and other man made or natural structures that drain water from the coal seam 15 without surface lift. From non-water saturated coal seams 15, reservoir pressure may similarly need to be reduced before methane gas will start to diffuse or disorb from coal in the coverage area. Free and near-well bore gas may be produced prior to the substantial reduction in reservoir pressure or the start of disorbtion. The amount of gas disorbed from coal may increase exponentially or with other non-linear geometric progression with a drop in reservoir pressure. In this type of coal seam, gas lift, rod pumps and other water production equipment may be omitted.

Referring to FIG. 3A, after the well bores 12 and 30, and well bore pattern 50 have been drilled, the drill string 40 is removed from the articulated well bore 30 and the articulated well bore 30 is capped. A tubing string 70 is disposed into well bore 12 with a port 72 positioned in the enlarged cavity 20. The enlarged cavity 20 provides a reservoir for water or other fluids collected through the drainage pattern 50 from the coal seam 15. In one embodiment, the tubing string 70 may be a casing string for a rod pump to be installed after the completion of gas lift and the port 72 may be the intake port for the rod pump. In this embodiment, the tubing may be a 2⅞ tubing used for a rod pump. It will be understood that other suitable types of tubing operable to carry air or other gases or materials suitable for gas lift may be used.

At the surface 14, an air compressor 74 is connected to the tubing string 70. Air compressed by the compressor 74 is pumped down the tubing string 70 and exits into the cavity 20 at the port 72. The air used for gas lift and/or for the previously described under balanced drilling may be ambient air at the site or may be or include any other suitable gas. For example, produced gas may be returned to the cavity and used for gas lift. In the cavity, the compressed air expands and suspends liquid droplets within its volume and lifts them to the surface. In one embodiment, for shallow coal beds 15 at or around one thousand feet, air may be compressed to three hundred to three hundred fifty psi and provided at a rate of nine hundred cubic feet per minute (CFM). At this rate and pressure, the gas lift system may lift up to three thousand, four thousand or five thousand barrels a day of water to the surface.

At the surface, air and fluids are fed into a fluid separator 76. Produced gas and lift air may be outlet at air/gas port 78 and flared while remaining fluids are outlet at fluid port 79 for transport or other removal, reinjection or surface runoff. It will be understood that water may be otherwise suitably removed from the cavity 20 and/or drainage pattern 50 without production to the surface. For example, the water may be reinjected into an adjacent or other underground structure by pumping, directing or allowing the flow of the water to the other structure.

During gas lift, the rate and/or pressure of compressed air provided to the cavity may be adjusted to control the volume of water produced to the surface. In one embodiment, a sufficient rate and/or pressure of compressed air may be provided to the cavity 20 to lift all or substantially all of the water collected by the cavity 20 from a coal seam 15. This may provide for a rapid pressure drop in the coverage area of the coal seam 15 and allow for kick-off of the well to self-sustaining flow within one, two or a few weeks. In other embodiments, the rate and/or pressure of air provided may be controlled to limit water production below the attainable amount due to limitations in disposing of produced water and/or damage to the coal seam 15 or equipment by high rates of production. In a particular embodiment, a turbidity meter may be used at the well head to monitor the presence of particles in the produced water. If the amount of particles is over a specified limit, a controller may adjust a flow control valve to reduce the production rate. The controller may adjust the valve to specific flow rates and/or use feedback from the turbidity meter to adjust the flow control valve to a point where the amount of particles in the water is at a specified amount.

Referring to FIG. 3B, a pumping unit 80 is disposed in the well bore 12 and extends to the enlarged cavity 20. The enlarged cavity 20 provides a reservoir for accumulated fluids that may act as a surge tank and that may allow intermittent pumping without adverse effects of a hydrostatic head caused by accumulated fluids in the well bore 12. As a result, a large volume of fluids may be collected in the cavity 20 without any pressure or any substantial pressure being exerted on the formation from the collected fluids. Thus, even during non-extended periods of non-pumping, water and/or gas may continue to flow from the well bore pattern 50 and accumulate in the cavity 20.

The pumping unit 80 includes an inlet port 82 in the cavity 20 and may comprise a tubing string 83 with sucker rods 84 extending through the tubing string 83. The inlet 82 may be positioned at or just above a center height of the cavity 20 to avoid gas lock and to avoid debris that collects in the sump 22 of the cavity 20. The inlet 82 may be suitably angled with or within the cavity.

The sucker rods 84 are reciprocated by a suitable surface mounted apparatus, such as a powered walking beam 86 to operate the pumping unit 80. In another embodiment, the pumping unit 80 may comprise a Moineau or other suitable pump operable to lift fluids vertically or substantially vertically. The pumping unit 80 is used to remove water and entrained coal fines from the coal seam 15 via the well bore pattern 50. Once the water is removed to the surface 14, it may be treated in gas/water separator 76 for separation of methane which may be dissolved in the water and for removal of entrained fines.

After sufficient water has been removed from the coal seam 15, via gas lift, fluid pumping or other suitable manner, or pressure is otherwise lowered, coal seam gas may flow from the coal seam 15 to the surface 14 through the annulus of the well bore 12 around the tubing string 83 and be removed via piping attached to a wellhead apparatus.

The pumping unit 80 may be operated continuously or as needed to remove water drained from the coal seam 15 into the enlarged cavity 20. In a particular embodiment, gas lift is continued until the well is kicked-off to a self-sustaining flow at which time the well is briefly shut-in to allow replacement of the gas lift equipment with the fluid pumping equipment. The well is then allowed to flow in self-sustaining flow subject to periodic periods of being shut-in for maintenance, lack of demand for gas and the like. After any shut-in, the well may need to be pumped for a few cycles, a few hours, days or weeks, to again initiate self-sustaining flow or other suitable production rate of gas. In a particular embodiment, the rod pump may produce approximately eight gallons per minute of water from the cavity 20 to the surface. The well is at self sustaining flow when the flow of gas is operable to lift any produced water such that the well may operate for an extended period of six weeks or more without pumping or artificial gas lift. Thus, the well may require periodic pumping between periods of self sustaining flow.

In a particular embodiment, the well bore pattern 50 may be configured to result in a net reduction of water volume in the coverage area of the drainage pattern (overall water volume pumped to the surface 14 less influx water volume from the surrounding areas and/or formations) of one tenth of the initial insitu water volume in the first five to ten days of water production with gas lift or in the first 17 to 25 days of water production with a rod pump in order to kick-off or induce early and/or self-sustaining gas release. The start of water production may be the initial blow down or pump down of the well during a post-drilling testing and/or production phase.

In one embodiment, early or accelerated gas release may be through a chain reaction through an ever reducing reservoir pressure. Self-sustaining gas release provides gas lift to remove water without further pumping. Such gas may be produced in two-phase flow with the water. In addition, the blow down or rapid removal of water from the coverage area of the coal seam 15 may provide a pull or "jerk" on the formation and the high rate of flow in the bores may create an eductor affect in the intersecting fractures to "pull" water and gas from the coal seam 15. Also, the released gas may lower the specific gravity and/or viscosity of the produced fluid thereby further accelerating gas production from the formation. Moreover, the released gas may act as a propellant for further two-phase flow and/or production. The pressure reduction may affect a large rock volume causing a bulk coal or other formation matrix shrinkage and further accelerating gas release. For the coal seam 15, an attended increase in cleat width may increase formation permeability and thereby further expedite gas production from the formation. It will be understood that early gas release may be initiated with all, some or none of the further enhancements to production.

During gas release, as described in more detail below, a majority or other substantial portion of water and gas from the coal seam 15 may flow into the drainage pattern 50 for production to the surface through intersections of the pattern 50 with natural fractures in the coal seam 15. Due to the size of the fractures, the disabsorption of gas from coal that lowers the relative permeability of the coal matrix to gas and/or water to less than twenty percent of the absolute permeability does not affect or substantially affect flow into the pattern 50 from the fractures. As a result, gas and water may be produced in substantial qualities in formations having medium and low effective permeability despite low relative permeabilities of the formations.

FIGS. 4–14 illustrate well bore or drainage patterns 50 for accessing the coal seam 15 or other subterranean zone in accordance with various embodiments of the present invention. The pattern 50 may be used to remove or inject water. In these embodiments, the well bore patterns 50 comprise one or more pinnate well bore patterns that each have a central diagonal or other main bore with generally symmetrically arranged and appropriately spaced laterals extending from each side of the diagonal. As used herein, the term each means every one of at least a subset of the identified items. It will be understood that other suitable multi-branching patterns including or connected to a surface production bore and having the significant percentage of their total length at different angles, directions or orientations than each other or the production bore may be used without departing from the scope of the present invention.

The pinnate patterns approximate the pattern of veins in a leaf or the design of a feather in that it has similar, substantially parallel, auxiliary drainage bores arranged in substantially equal and parallel spacing on opposite sides of an axis. The pinnate drainage patterns with their central bore and generally symmetrically arranged and appropriately spaced auxiliary drainage bores on each side provide a substantially uniform pattern for draining fluids from a coal seam 15 or other subterranean formation. The number and spacing of the lateral bores may be adjusted depending on the absolute, relative and/or effective permeability of the coal seam and the size of the area covered by the pattern. The area covered by the pattern may be the area drained by the pattern, the area of a spacing unit that the pattern is designed to drain, the area within the distal points or periphery of the pattern and/or the area within the periphery of the pattern as well as the surrounding area out to a periphery intermediate to adjacent or neighboring patterns. The coverage area may also include the depth, or thickness of the coal seam or, for thick coal seams, a portion of the thickness of the seam. Thus, the pattern may include upward or downward extending branches in addition to horizontal branches.

In a particular embodiment, for a coal seam having an effective permeability of seven millidarcies and a coverage area of three hundred acres, the laterals may be spaced approximately six hundred feet apart from each other. For a low permeability coal seam having an effective permeability of approximately one millidarcy and a coverage area of three hundred acres, the lateral spacing may be four hundred feet. The effective permeability may be determined by well testing and/or analysis of long-term production trends.

As described in more detail below, the pinnate patterns may provide substantially uniform coverage of a quadrilateral or other non-disjointed area having a high area to perimeter ratio. Coverage is substantially uniform when, except for pressure due to hydrostatic head, friction or blockage, the pressure differential across the coverage area is less than or equal to twenty psi for a mature well the differential at any time after an initial month of production is less than twenty psi or when less than ten percent of the area bounded by the pattern comprises trapped cells. In a particular embodiment, the pressure differential may be less than ten psi. The coverage area may be a square, other quadrilateral, or other polygon, circular, oval or other ellipsoid or grid area and may be nested with other patterns of the same or similar type. It will be understood that other suitable well bore patterns 50 may be used in accordance with the present invention.

The pinnate and other suitable well bore patterns 50 drilled from the surface 14 provide surface access to subterranean formations. The well bore pattern 50 may be used to uniformly remove and/or insert fluids or otherwise manipulate a subterranean zone. In non-coal applications, the well bore pattern 50 may be used initiating in-situ burns, "huff-puff" steam operations for heavy crude oil, and the removal of hydrocarbons from low porosity reservoirs. The well bore pattern 50 may also be used to uniformly inject or introduce a gas, fluid or other substance into a subterranean zone. For example, carbon dioxide may be injected into a coal seam for sequestration through the pattern 50.

Figure 4:
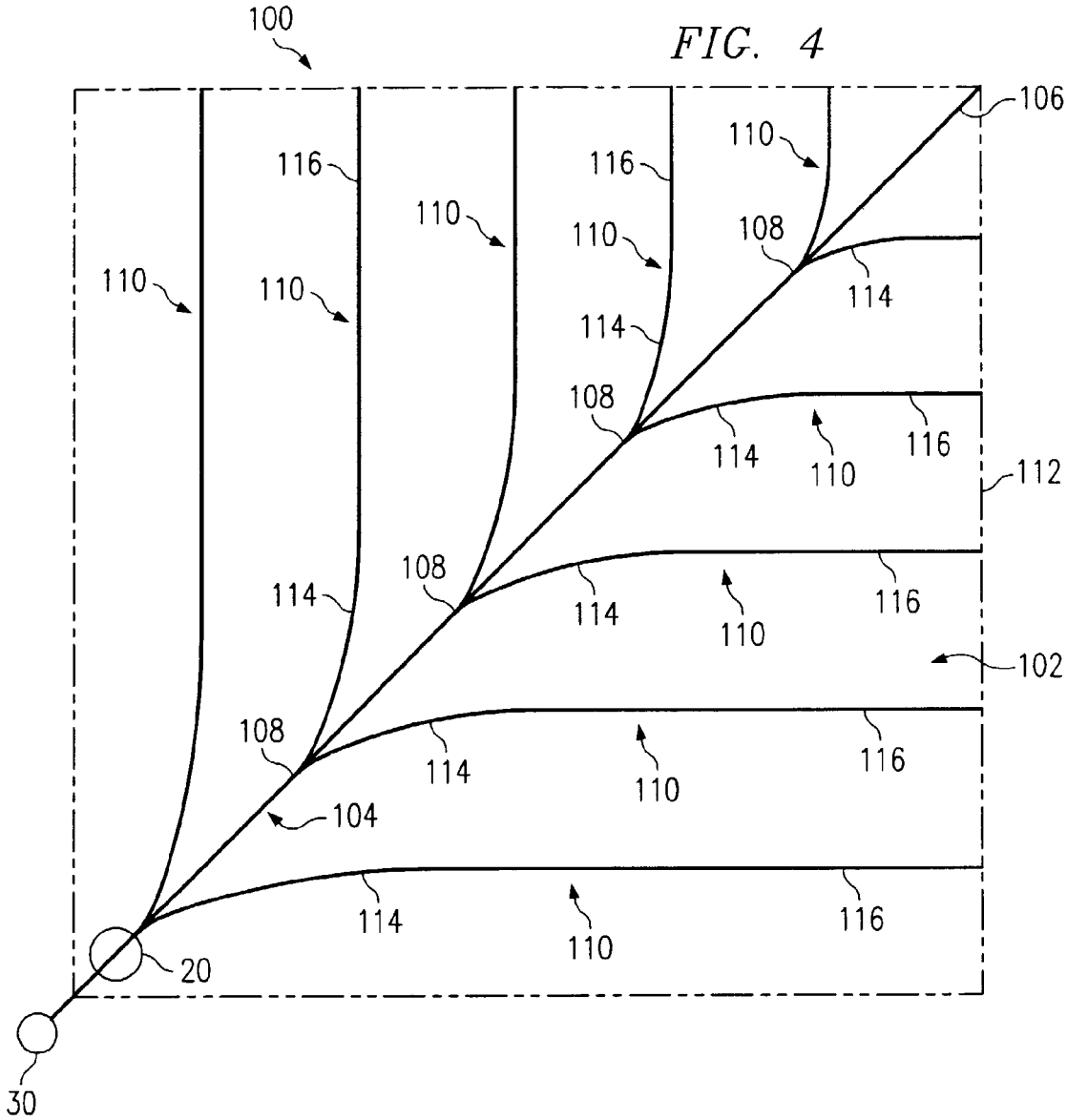
FIG. 4 is a top plan diagram illustrating a pinnate well bore pattern for accessing products in the subterranean zone in accordance with one embodiment of the present invention.

FIG. 4 illustrates a pinnate well bore pattern 100 in accordance with one embodiment of the present invention. In this embodiment, the pinnate well bore pattern 100 provides access to a substantially square coverage area 102 of the subterranean zone. A number of the pinnate well bore patterns 100 may be used together to provide uniform access to a large subterranean region.

Referring to FIG. 4, the enlarged cavity 20 defines a first corner of the area 102. The pinnate pattern 100 includes a main well bore 104 extending diagonally across the coverage area 102 to a distant corner 106 of the area 102. In one embodiment, the well bores 12 and 30 are positioned over the area 102 such that the main well bore 104 is drilled up the slope of the coal seam 15. This may facilitate collection of water, gas, and other fluids from the area 102. The well bore 104 is drilled using the drill string 40 and extends from the enlarged cavity 20 in alignment with the articulated well bore 30.

A plurality of lateral well bores 110 extend from opposites sides of well bore 104 to a periphery 112 of the area 102. The lateral bores 110 may mirror each other on opposite sides of the well bore 104 or may be offset from each other along the well bore 104. Each of the lateral bores 110 includes a radius curving portion 114 extending from the well bore 104 and an elongated portion 116 formed after the curved portion 114 has reached a desired orientation. For uniform coverage of the square area 102, pairs of lateral bores 110 may be substantially evenly spaced on each side of the well bore 104 and extend from the well bore 104 at an angle of approximately 45 degrees. The lateral bores 110 shorten in length based on progression away from the enlarged cavity 20.

The pinnate well bore pattern 100 using a single well bore 104 and five pairs of lateral bores 110 may drain a coal seam area of approximately 150 acres in size. For this and other pinnate patterns, where a smaller area is to be drained, or where the coal seam 15 has a different shape, such as a long, narrow shape, other shapes due to surface or subterranean topography, alternate pinnate well bore patterns may be employed by varying the angle of the lateral bores 110 to the well bore 104 and the orientation of the lateral bores 110. Alternatively, lateral bores 110 can be drilled from only one side of the well bore 104 to form a one-half pinnate pattern.

As previously described, the well bore 104 and the lateral bores 110 of pattern 100 as well as bores of other patterns are formed by drilling through the enlarged cavity 20 using the drill string 40 and an appropriate drilling apparatus. During this operation, gamma ray logging tools and conventional MWD technologies may be employed to control the direction and orientation of the drill bit 42 so as to retain the well bore pattern within the confines of the coal seam 15 and to maintain proper spacing and orientation of the well bores 104 and 110.

In a particular embodiment, the well bore 104 and that of other patterns are drilled with an incline at each of a plurality of lateral branch points 108. After the well bore 104 is complete, the articulated drill string 40 is backed up to each successive lateral point 108 from which a lateral bore 110 is drilled on each side of the well bore 104. It will be understood that the pinnate drainage pattern 100 may be otherwise suitably formed.

Figure 5:
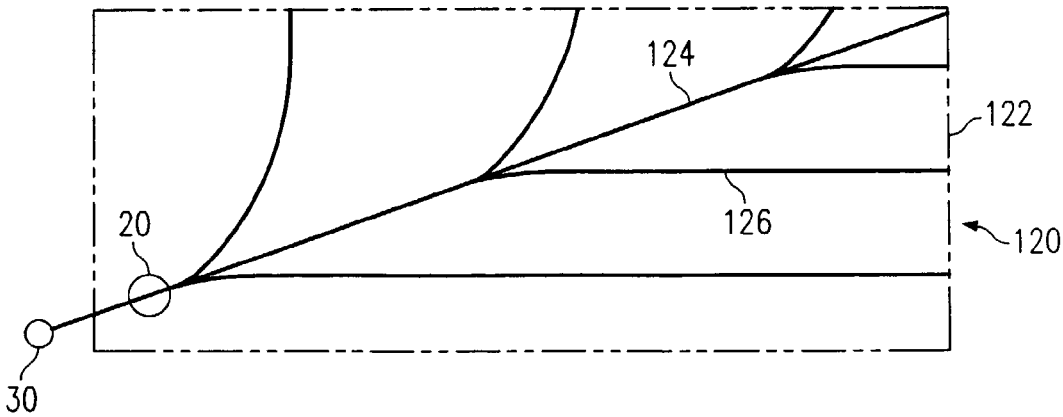
FIG. 5 is a top plan diagram illustrating a pinnate well bore pattern for accessing products in the subterranean zone in accordance with another embodiment of the present invention.

FIG. 5 illustrates a pinnate well bore pattern 120 in accordance with another embodiment of the present invention. In this embodiment, the pinnate well bore pattern 120 drains a substantially rectangular area 122 of the coal seam 15. The pinnate well bore pattern 120 includes a main well bore 124 and a plurality of lateral bores 126 that are formed as described in connection with well bores 104 and 110 of FIG. 4. For the substantially rectangular area 122, however, the lateral well bores 126 on a first side of the well bore 124 include a shallow angle while the lateral bores 126 on the opposite side of the well bore 124 include a steeper angle to together provide uniform coverage of the area 122.

Figure 6:
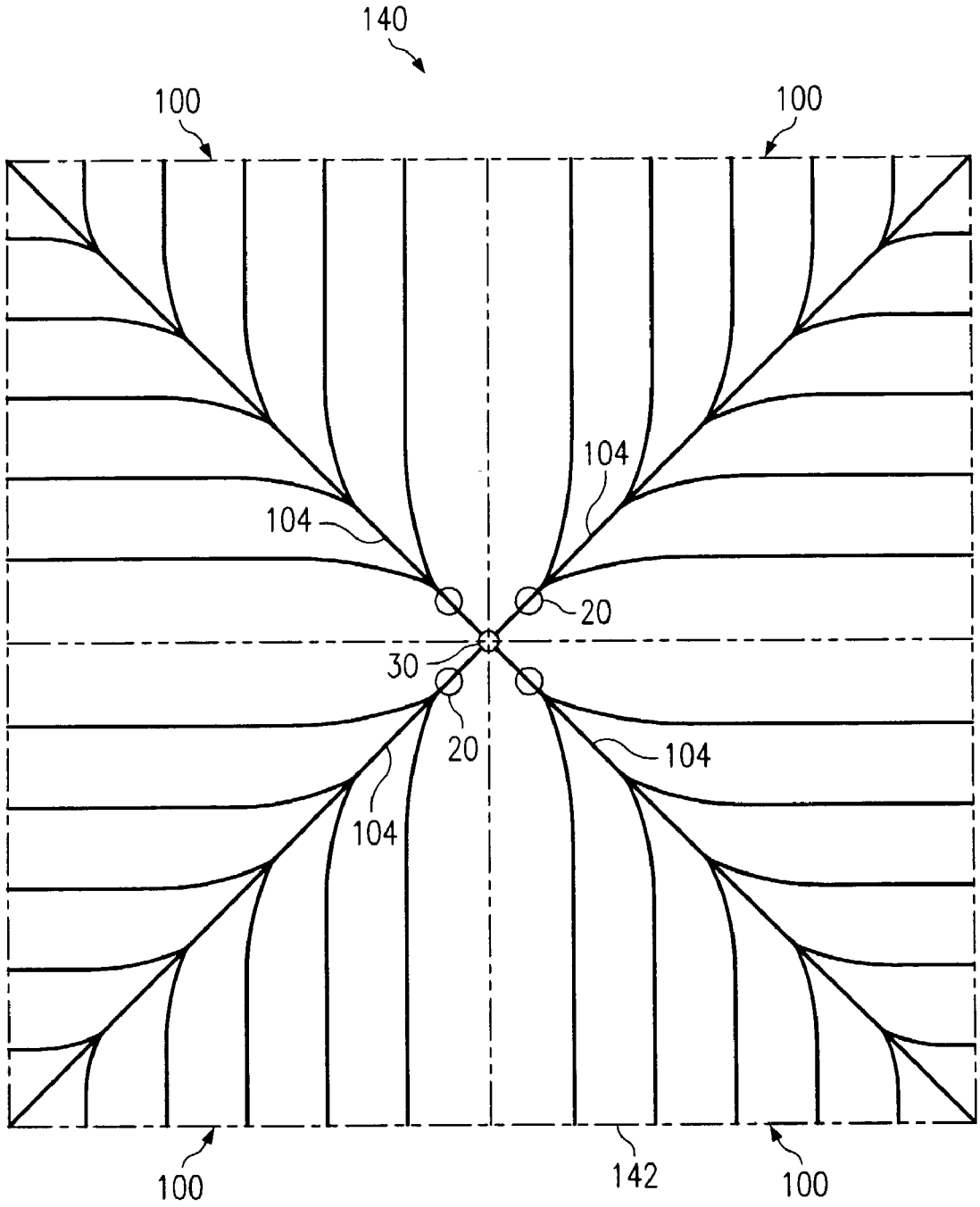
FIG. 6 is a top plan diagram illustrating a quad-pinnate well bore pattern for accessing products in the subterranean zone in accordance with one embodiment of the present invention.

FIG. 6 illustrates a quad-pinnate well bore pattern 140 in accordance with one embodiment of the present invention. The quad-pinnate well bore pattern 140 includes four discrete sub-patterns extending from a substantial center of the area. In this embodiment, the wells are interconnected in that the articulated bores are drilled from the same surface bore. It will be understood that a plurality of sub-patterns may be formed from main bores extending away from a substantial center of an area in different directions. The main bores may be substantially evenly oriented about the center to uniform coverage and may be the same, substantially the same or different from each other.

The sub-patterns may each be a pinnate well bore patterns 100 that access a quadrant of a region 142 covered by the pinnate well bore pattern 140. Each of the pinnate well bore patterns 100 includes a main well bore 104 and a plurality of lateral well bores 110 extending from the well bore 104. In the quad-pinnate embodiment, each of the well bores 104 and 110 is drilled from a common articulated well bore 30 through a cavity 20. This allows tighter spacing of the surface production equipment, wider coverage of a well bore pattern, and reduces drilling equipment and/or operations.

Figure 7:
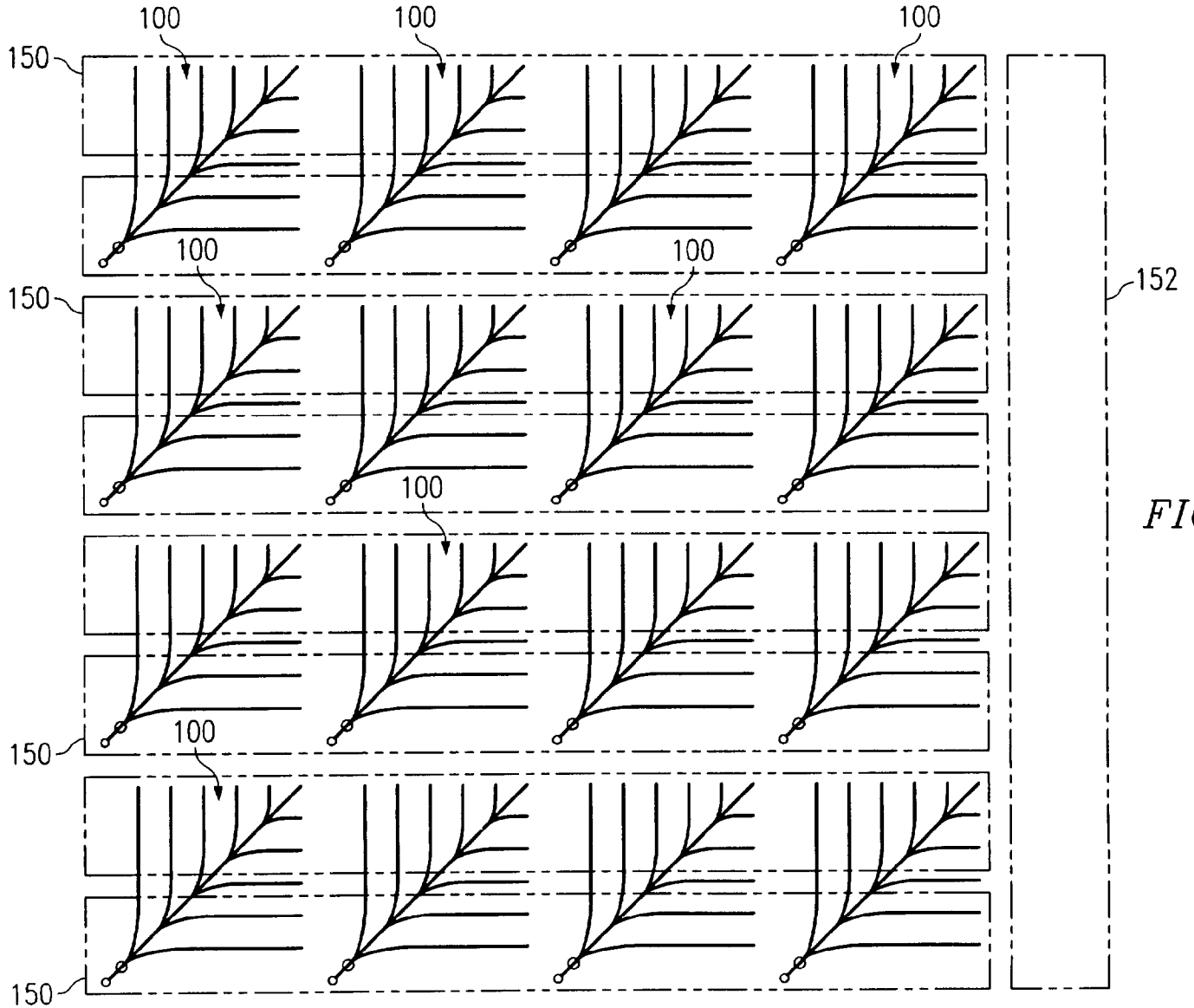
FIG. 7 is a top plan diagram illustrating an alignment of pinnate well bore patterns in the subterranean zone in accordance with one embodiment of the present invention.

FIG. 7 illustrates the alignment of pinnate well bore patterns 100 with planned subterranean structures of a coal seam 15 for degasifying and preparing the coal seam 15 for mining operations in accordance with one embodiment of the present invention. In this embodiment, the coal seam 15 will be mined using a longwall process. It will be understood that the present invention can be used to degasify coal seams for other types of mining operations.

Referring to FIG. 7, planned coal panels 150 extend longitudinally from a longwall 152. In accordance with longwall mining practices, each panel 150 will be subsequently mined from a distant end toward the longwall 152 and the mine roof allowed to cave and fracture into the opening behind the mining process. Prior to mining, the pinnate well bore patterns 100 are drilled into the panels 150 from the surface to degasify the panels 150 well ahead of mining operations. Each of the pinnate well bore patterns 100 is aligned with the planned longwall 152 and panel 150 grid and covers portions of one or more panels 150. In this way, a region of a planned mine can be degasified from the surface based on subterranean structures and constraints, allowing a subsurface formation to be degasified and mined within a short period of time.

Figure 8:
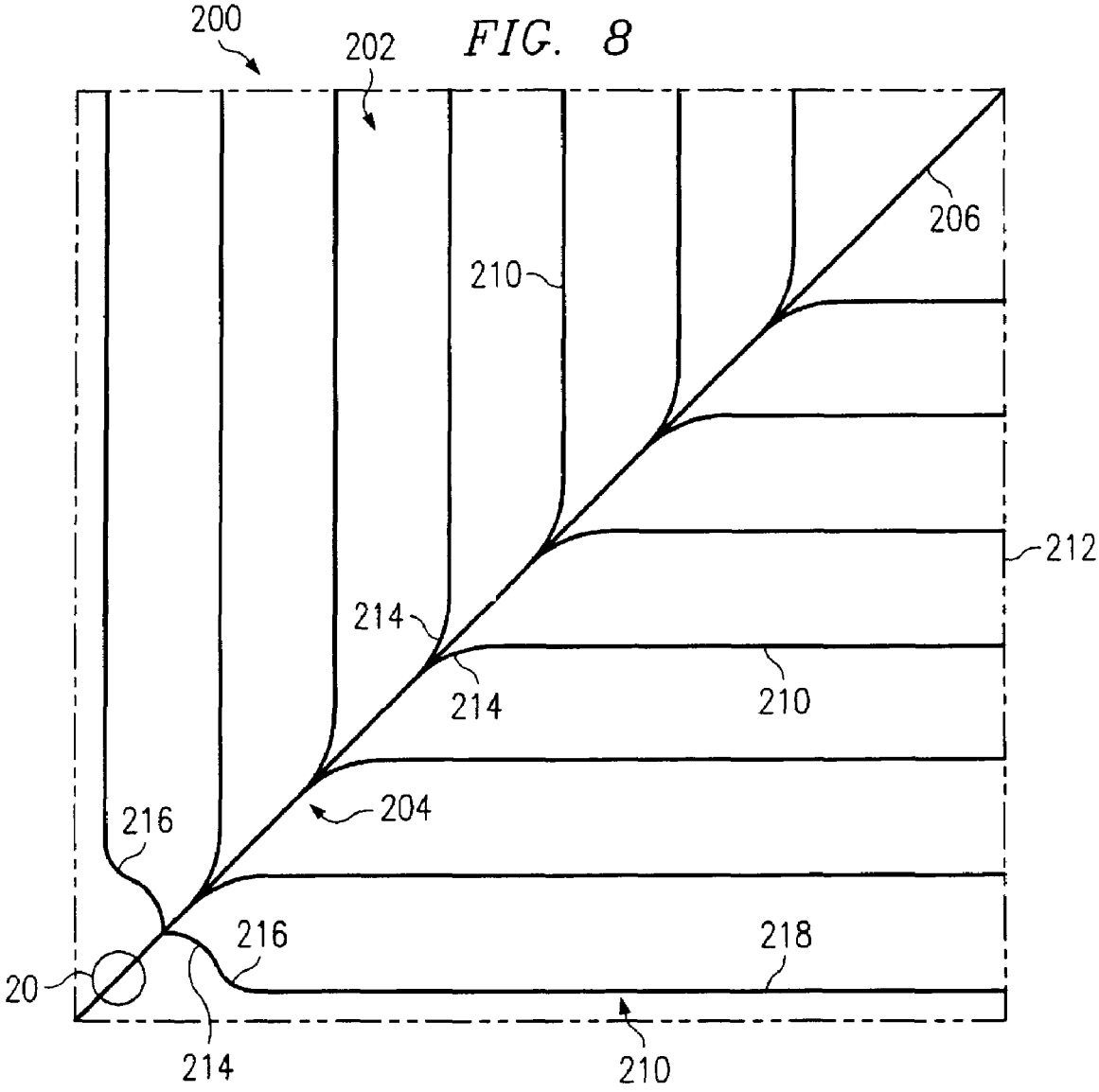
FIG. 8 is a top plan diagram illustrating a pinnate well bore pattern for accessing products in the subterranean zone in accordance with another embodiment of the present invention.

FIG. 8 illustrates a pinnate well bore pattern 200 in accordance with another embodiment of the present invention. In this embodiment, the pinnate well bore pattern 200 provides access to a substantially square area 202 of a subterranean zone. As with the other pinnate patterns, a number of the pinnate patterns 200 may be used together in dual, triple, and quad pinnate structures to provide uniform access to a large subterranean region.

Referring to FIG. 8, the enlarged cavity 20 defines a first corner of the area 202, over which a pinnate well bore pattern 200 extends. The enlarged cavity 20 defines a first corner of the area 202. The pinnate pattern 200 includes a main well bore 204 extending diagonally across the area 202 to a distant corner 206 of the area 202. Preferably, the main well bore 204 is drilled up the slope of the coal seam 15. This may facilitate collection of water, gas, and other fluids from the area 202. The main well bore 204 is drilled using the drill string 40 and extends from the enlarged cavity 20 in alignment with the articulated well bore 30.

A plurality of lateral well bores 210 extend from the opposite sides of well bore 204 to a periphery 212 of the area 202. The lateral bores 210 may mirror each other on opposite sides of the well bore 204 or may be offset from each other along the well bore 204. Each of the lateral well bores 210 includes a first radius curving portion 214 extending from the well bore 204, and an elongated portion 218. The first set of lateral well bores 210 located proximate to the cavity 20 may also include a second radius curving portion 216 formed after the first curved portion 214 has reached a desired orientation. In this set, the elongated portion 218 is formed after the second curved portion 216 has reached a desired orientation. Thus, the first set of lateral well bores 210 kicks or turns back towards the enlarged cavity 20 before extending outward through the formation, thereby extending the coverage area back towards the cavity 20 to provide enhanced uniform coverage of the area 202. For uniform coverage of the square area 202, pairs of lateral well bores 210 may be substantially evenly spaced on each side of the well bore 204 and extend from the well bore 204 at an angle of approximately 45 degrees. The lateral well bores 210 shorten in length based on progression away from the enlarged cavity 20. Stated another way, the lateral well bores 210 lengthen based on proximity to the cavity 20 in order to provide an enlarged and uniform coverage area. Thus, the length from a tip of each lateral to the cavity is substantially equal and at or close to the maximum reach of the drill string through the articulated well 30.

Figure 9:
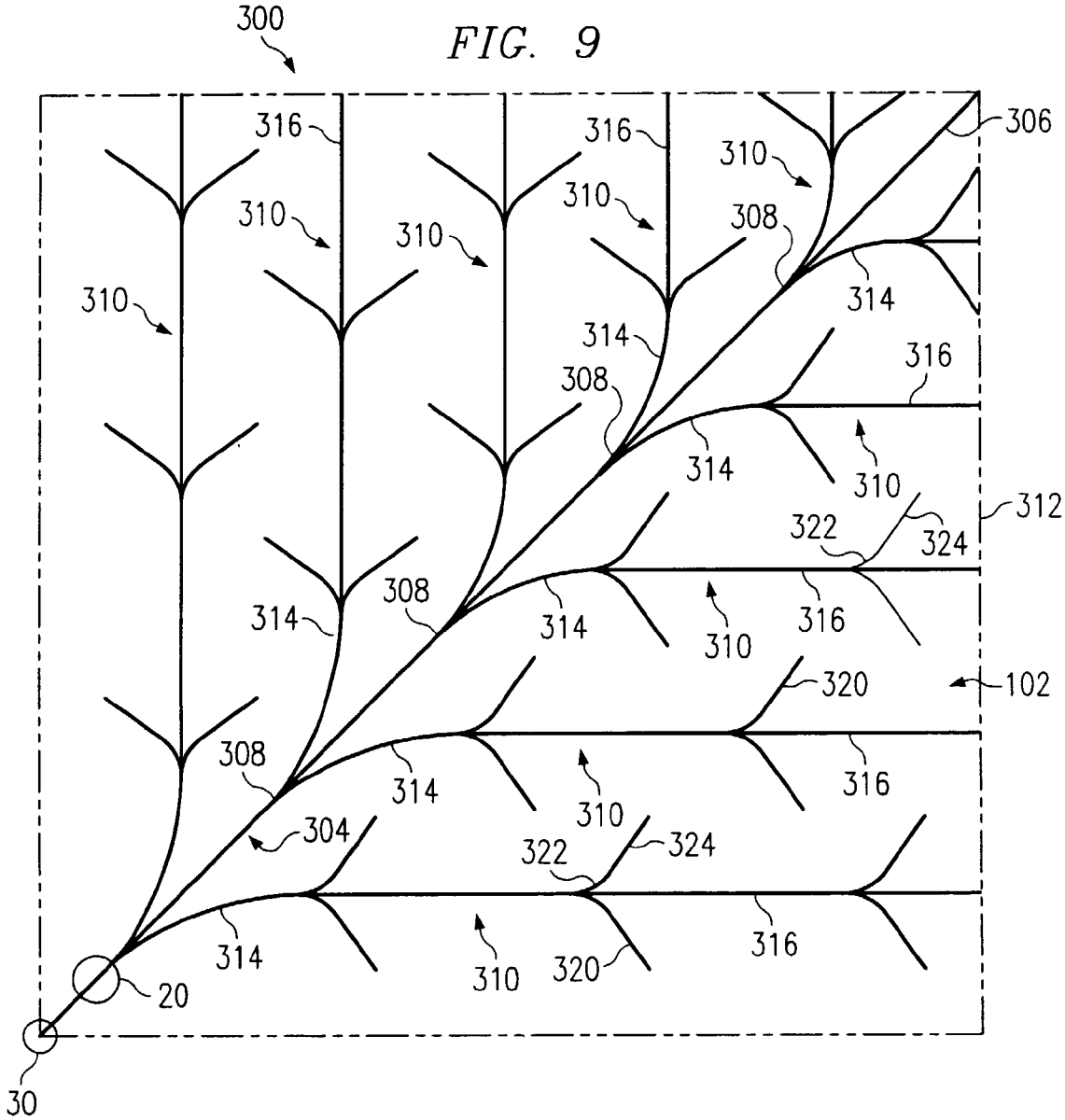
FIG. 9 is a top plan diagram illustrating a pinnate well bore pattern for accessing products in the subterranean zone in accordance with still another embodiment of the present invention.

FIG. 9 illustrates a pinnate well bore pattern 300 in accordance with another embodiment of the present invention. In this embodiment, the pinnate well bore pattern 300 provides access to a substantially square area 302 of a subterranean zone. A number of the pinnate patterns 300 may be used together to provide uniform access to a large subterranean region.

Referring to FIG. 9, the enlarged cavity 20 defines a first corner of the area 302. The pinnate well bore pattern 300 includes a main well bore 304 extending diagonally across the area 302 to a distant corner 306 of the area 302. In one embodiment, the well bore 304 is drilled up the slope of the coal seam 15. This may facilitate collection of water, gas, and other fluids from the area 302. The well bore 304 is drilled using the drill string 40 and extends from the enlarged cavity 20 in alignment with the articulated well bore 30.

A set of lateral well bores 310 extends from opposite sides of well bore 304 to a periphery 312 of the area 302. The lateral well bores 310 may mirror each other on opposite sides of the well bore 304 or may be offset from each other along the well bore 304. Each of the lateral well bores 310 includes a radius curving portion 314 extending from the well bore 304 and an elongated portion 316 formed after the curved portion 314 has reached a desired orientation. For uniform coverage of the square area 302, pairs of lateral well bores 310 may be substantially evenly spaced on each side of the well bore 304 and extend from the well bore 304 at an angle of approximately 45 degrees. However, the lateral well bores 310 may be formed at other suitable angular orientations relative to well bore 304.

The lateral well bores 310 shorten in length based on progression away from the enlarged diameter cavity 20. Thus, as illustrated in FIG. 9, a distance to the periphery 312 for the pattern 300 as well as for other pinnate patterns from the cavity 20 or well bore 30 measured along the lateral well bores 310 is substantially equal for each lateral well bore 310, thereby enhancing coverage by drilling substantially to a maximum distance by each lateral.

In the embodiment illustrated in FIG. 9, well bore pattern 300 also includes a set of secondary lateral well bores 320 extending from lateral well bores 310. The secondary lateral well bores 320 may mirror each other on opposite sides of the lateral well bore 310 or may be offset from each other along the lateral well bore 310. Each of the secondary lateral well bores 320 includes a radius curving portion 322 extending from the lateral well bore 310 and an elongated portion 324 formed after the curved portion 322 has reached a desired orientation. For uniform coverage of the area 302, pairs of secondary lateral well bores 320 may be disposed substantially equally spaced on each side of the lateral well bore 310. Additionally, secondary lateral well bores 320 extending from one lateral well bore 310 may be disposed to extend between secondary lateral well bores 320 extending from an adjacent lateral well bore 310 to provide uniform coverage of the area 302. However, the quantity, spacing, and angular orientation of secondary lateral well bores 320 may be varied to accommodate a variety of resource areas, sizes and drainage requirements. It will be understood that secondary lateral well bores 320 may be used in connection with other main laterals of other suitable pinnate patterns.

Figure 10:
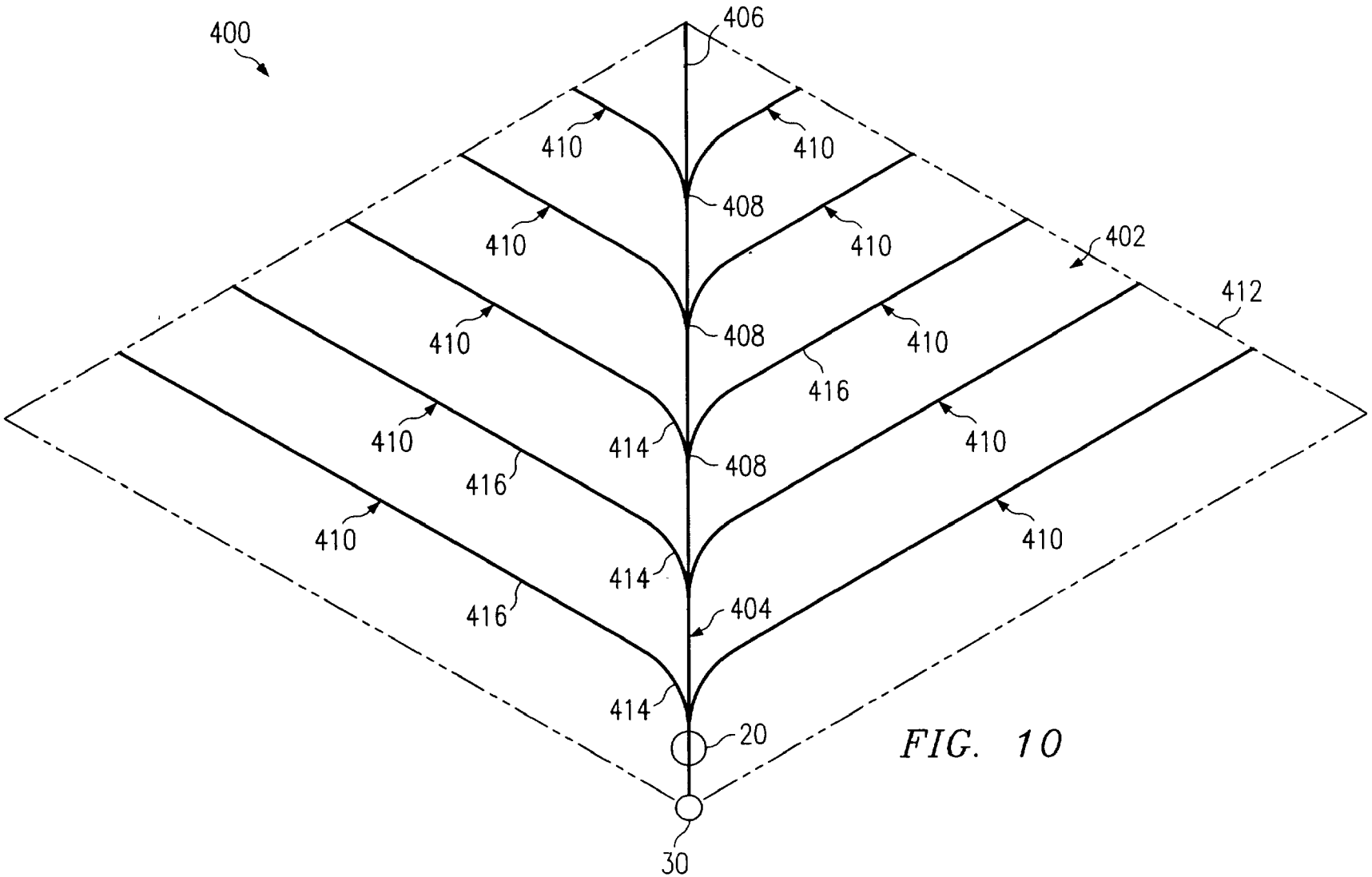
FIG. 10 is a top plan diagram illustrating a pinnate well bore pattern for accessing products in the subterranean zone in accordance with still another embodiment of the present invention.

FIG. 10 illustrates a well bore pattern 400 in accordance with still another embodiment of the present invention. In this embodiment, the well bore pattern 400 provides access to a substantially diamond or parallelogram-shaped area 402 of a subterranean resource. A number of the well bore patterns 400 may be used together to provide uniform access to a large subterranean region.

Referring to FIG. 10 the articulated well bore 30 defines a first corner of the area 402. The well bore pattern 400 includes a main well bore 404 extending diagonally across the area 402 to a distant corner 406 of the area 402. For drainage applications, the well bores 12 and 30 may be positioned over the area 402 such that the well bore 404 is drilled up the slope of the coal seam 15. This may facilitate collection of water, gas, and other fluids from the area 402. The well bore 404 is drilled using the drill string 40 and extends from the enlarged cavity 20 in alignment with the articulated well bore 30.

A plurality of lateral well bores 410 extend from the opposite sides of well bore 404 to a periphery 412 of the area 402. The lateral well bores 410 may mirror each other on opposite sides of the well bore 404 or may be offset from each other along the well bore 404. Each of the lateral well bores 410 includes a radius curving portion 414 extending from the well bore 404 and an elongated portion 416 formed after the curved portion 414 has reached a desired orientation. For uniform coverage of the area 402, pairs of lateral well bores 410 may be substantially equally spaced on each side of the well bore 404 and extend from the well bore 404 at an angle of approximately 60 degrees. The lateral well bores 410 shorten in length based on progression away from the enlarged diameter cavity 20. As with the other pinnate patterns, the quantity and spacing of lateral well bores 410 may be varied to accommodate a variety of resource areas, sizes and well bore requirements. For example, lateral well bores 410 may be drilled from a single side of the well bore 404 to form a one-half pinnate pattern.

Figure 11:
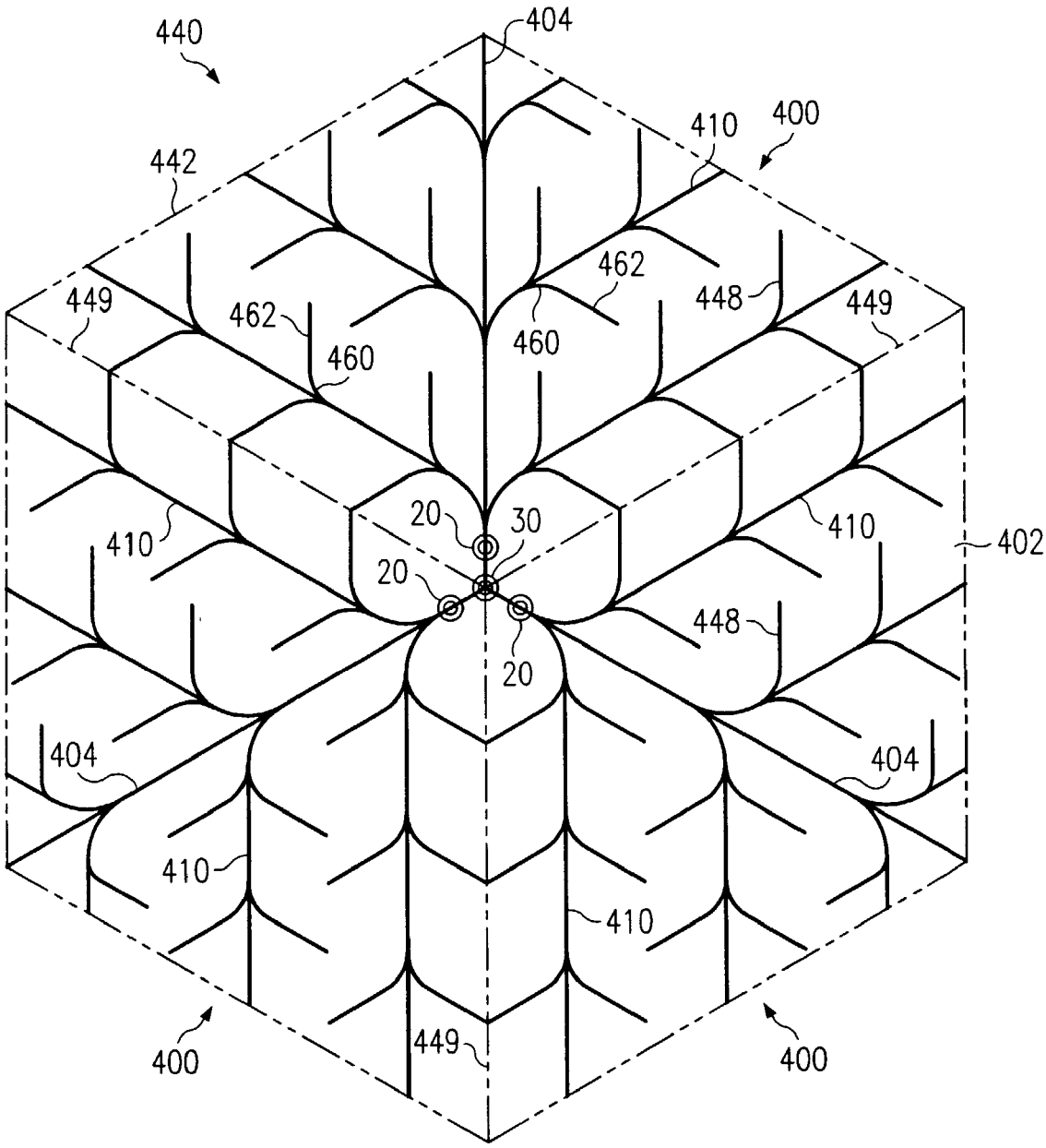
FIG. 11 is a top plan diagram illustrating a tri-pinnate well bore pattern for accessing products in the subterranean zone in accordance with one embodiment of the present invention.

FIG. 11 illustrates a tri-pinnate well bore pattern 440 in accordance with one embodiment of the present invention. The tri-pinnate well bore pattern 440 includes three discrete well bore patterns 400 each draining a portion of a region 442 covered by the well bore pattern 440. Each of the well bore patterns 400 includes a well bore 404 and a set of lateral well bores 410 extending from the well bore 404. In the tri-pinnate pattern embodiment illustrated in FIG. 11, each of the well bores 404 and 410 are drilled from a common articulated well bore 30 and fluid and/or gas may be removed from or introduced into the subterranean zone through a cavity 20 in communication with each well bore 404. This allows tighter spacing of the surface production equipment, wider coverage of a well bore pattern and reduces drilling equipment and operations.

Each well bore 404 is formed at a location relative to other well bores 404 to accommodate access to a particular subterranean region. For example, well bores 404 may be formed having a spacing or a distance between adjacent well bores 404 to accommodate access to a subterranean region such that only three well bores 404 are required. Thus, the spacing between adjacent well bores 404 may be varied to accommodate varied concentrations of resources of a subterranean zone. Therefore, the spacing between adjacent well bores 404 may be substantially equal or may vary to accommodate the unique characteristics of a particular subterranean resource. For example, in the embodiment illustrated in FIG. 11, the spacing between each well bore 404 is substantially equal at an angle of approximately 120 degrees from each other, thereby resulting in each well bore pattern 400 extending in a direction approximately 120 degrees from an adjacent well bore pattern 400. However, other suitable well bore spacing angles, patterns or orientations may be used to accommodate the characteristics of a particular subterranean resource. Thus, as illustrated in FIG. 11, each well bore 404 and corresponding well bore pattern 400 extends outwardly from well bore 444 in a different direction, thereby forming a substantially symmetrical pattern. As will be illustrated in greater detail below, the symmetrically formed well bore patterns may be positioned or nested adjacent each other to provide substantially uniform access to a subterranean zone.

In the embodiment illustrated in FIG. 11, each well bore pattern 400 also includes a set of lateral well bores 448 extending from lateral well bores 410. The lateral well bores 448 may mirror each other on opposite sides of the lateral well bore 410 or may be offset from each other along the lateral well bore 410. Each of the lateral well bores 448 includes a radius curving portion 460 extending from the lateral well bore 410 and an elongated portion 462 formed after the curved portion 460 has reached a desired orientation. For uniform coverage of the region 442, pairs of lateral well bores 448 may be disposed substantially equally spaced on each side of the lateral well bore 410. Additionally, lateral well bores 448 extending from one lateral well bore 410 may be disposed to extend between or proximate lateral well bores 448 extending from an adjacent lateral well bore 410 to provide uniform coverage of the region 442. However, the quantity, spacing, and angular orientation of lateral well bores 448 may be varied to accommodate a variety of resource areas, sizes and well bore requirements.

As described above in connection with FIG. 10, each well bore pattern 400 generally provides access to a quadrilaterally shaped area or region 402. In FIG. 10, the region 402 is substantially in the form of a diamond or parallelogram. As illustrated in FIG. 11, the well bore patterns 400 may be arranged such that sides 449 of each quadrilaterally shaped region 448 are disposed substantially in common with each other to provide uniform coverage of the region 442.

Figure 12:
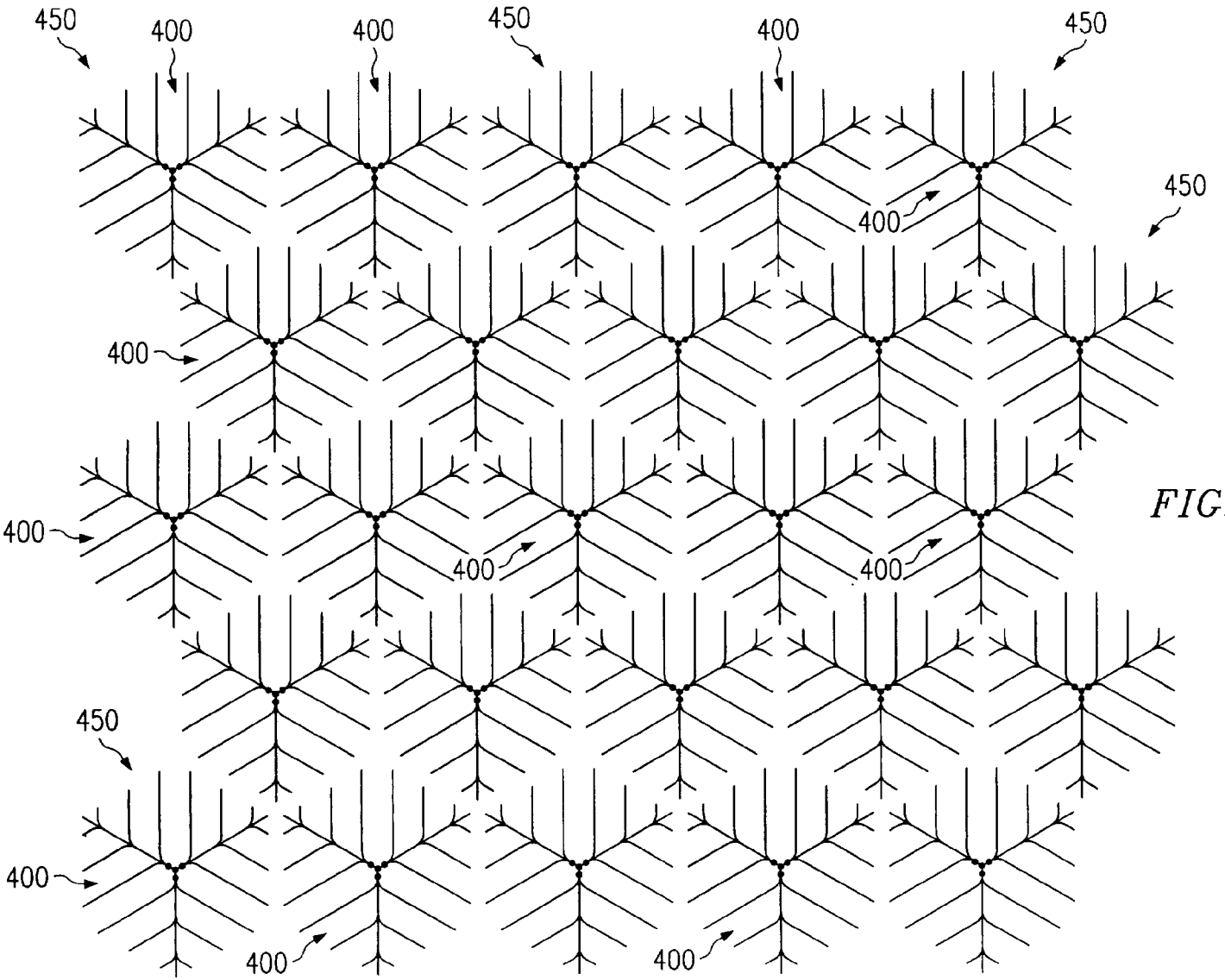
FIG. 12 is a top plan diagram illustrating an alignment of tri-pinnate well bore patterns in the subterranean zone in accordance with one embodiment of the present invention.

FIG. 12 illustrates an alignment or nested arrangement of well bore patterns within a subterranean zone in accordance with an embodiment of the present invention. In this embodiment, three discreet well bore patterns 400 are used to form a series of generally hexagonally configured well bore patterns 450, for example, similar to the well bore pattern 440 illustrated in FIG. 11. Thus, the well bore pattern 450 comprises a set of well bore sub-patterns, such as well bore patterns 400, to obtain a desired geometrical configuration or access shape. The well bore patterns 450 may be located relative to each other such that the well bore patterns 450 are nested in a generally honeycomb-shaped arrangement, thereby maximizing the area of access to a subterranean resource using fewer well bore patterns 450. Prior to mining of the subterranean resource, the well bore patterns 450 may be drilled from the surface to degasify the subterranean resource well ahead of mining operations.

The quantity of discreet well bore patterns 400 may also be varied to produce other geometrically-configured well bore patterns such that the resulting well bore patterns may be nested to provide uniform coverage of a subterranean resource. For example, in FIGS. 11–12, three discreet well bore patterns 400 are illustrated in communication with a central well bore 404, thereby forming a six-sided or hexagonally configured well bore pattern 440 and 450. However, greater or fewer than three discreet well bore patterns 400 may also be used in communication with a central well bore 404 such that a plurality of the resulting multi-sided well bore patterns may be nested together to provide uniform coverage of a subterranean resource and/or accommodate the geometric characteristics of a particular subterranean resource. For example, the pinnate and quad-pinnate patterns may be nested to provide uniform coverage of a subterranean field.

Figure 13:
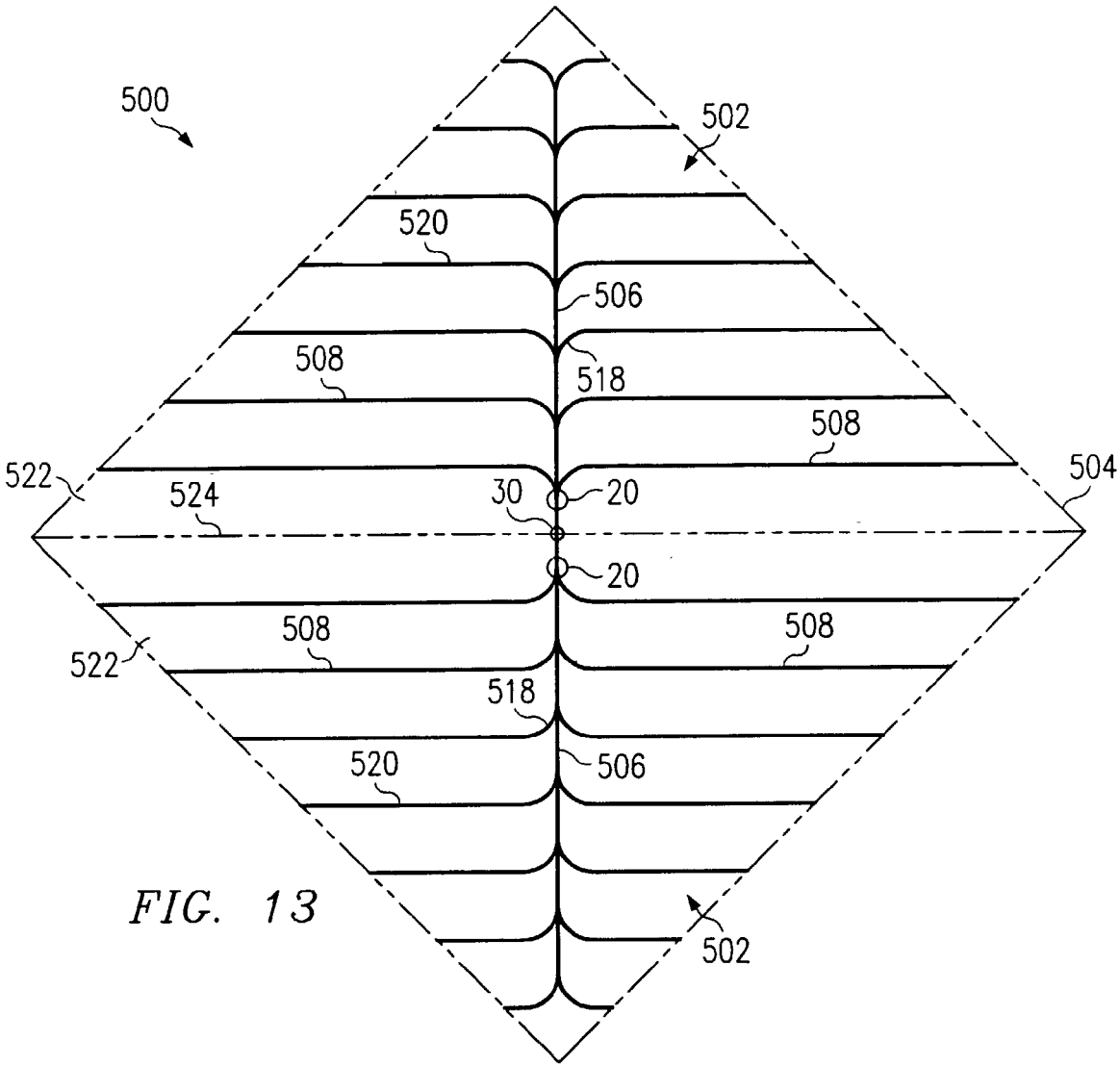
FIG. 13 is a top plan diagram illustrating a pinnate well bore pattern for accessing products in the subterranean zone in accordance with still another embodiment of the present invention.

FIG. 13 illustrates a well bore pattern 500 in accordance with an embodiment of the present invention. In this embodiment, well bore pattern 500 comprises two discreet well bore patterns 502 each providing access to a portion of a region 504 covered by the well bore pattern 500. Each of the well bore patterns 502 includes a well bore 506 and a set of lateral well bores 508 extending from the well bore 506. In the embodiment illustrated in FIG. 13, each of the well bores 506 and 508 are drilled from a common articulated well bore 30 and fluid and/or gas may be removed from or introduced into the subterranean zone through the cavity 20 of well bore 12 in communication with each well bore 506. In this embodiment, the well bores 20 and 30 are illustrated offset from each other; however, it should be understood that well bore pattern 500 as well as other suitable pinnate patterns may also be formed using a common surface well bore configuration with the wells slanting or otherwise separating beneath the surface. This may allow tighter spacing of the surface production equipment, wider coverage of a well bore pattern and reduce drilling equipment and operations.

Referring to FIG. 13, the well bores 506 are disposed substantially opposite each other at an angle of approximately 180 degrees, thereby resulting in each well bore pattern 502 extending in an opposite direction. However, other suitable well bore spacing angles, patterns or orientations may be used to accommodate the characteristics of a particular subterranean resource. In the embodiment illustrated in FIG. 13, each well bore pattern 502 includes lateral well bores 508 extending from well bores 506. The lateral well bores 508 may mirror each other on opposite sides of the well bores 506 or may be offset from each other along the well bores 506. Each of the lateral well bores 508 includes a radius curving portion 518 extending from the well bore 506 and an elongated portion 520 formed after the curved portion 518 has reached a desired orientation. For uniform coverage of the region 504, pairs of lateral well bores 508 may be disposed substantially equally spaced on each side of the well bore 506. However, the quantity, spacing, and angular orientation of lateral well bores 508 may be varied to accommodate a variety of resource areas, sizes and well bore requirements. As described above, the lateral well bores 508 may be formed such that the length of each lateral well bore 508 decreases as the distance between each respective lateral well bore 508 and the well bores 20 or 30 increases. Accordingly, the distance from the well bores 20 or 30 to a periphery of the region 504 along each lateral well bore 508 is substantially equal, thereby providing ease of well bore formation.

In this embodiment, each well bore pattern 502 generally provides access to a triangular shaped area or region 522. The triangular shaped regions 522 are formed by disposing the lateral well bores 508 substantially orthogonal to the well bores 506. The triangular shaped regions 522 are disposed adjacent each other such that each region 522 has a side 524 substantially in common with each other. The combination of regions 522 thereby forms a substantially quadrilateral shaped region 504. As described above, multiple well bore patterns 500 may be nested together to provide substantially uniform access to subterranean zones.

Figure 14:
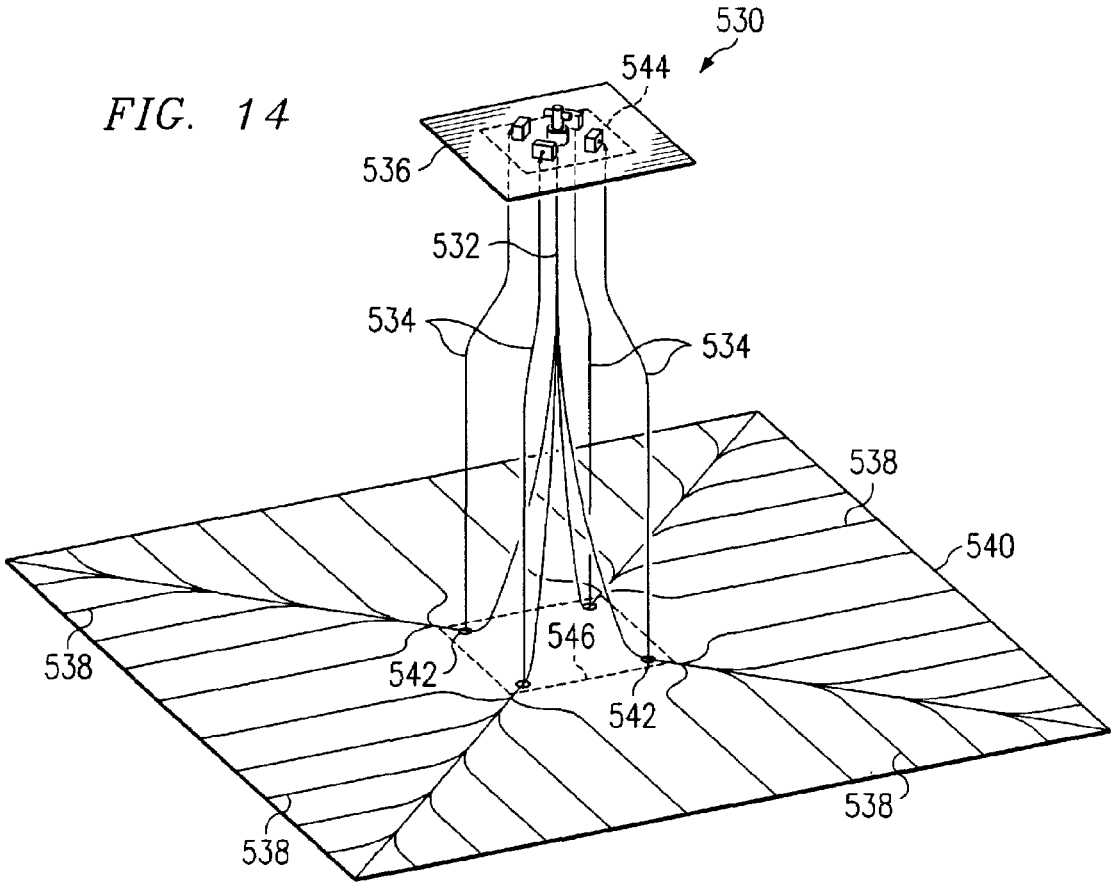
FIG. 14 is a diagram illustrating a multi-well system for accessing a subterranean zone from a limited surface area in accordance with one embodiment of the present invention.

FIG. 14 illustrates a multi-well system for accessing a subterranean zone from a limited surface area in accordance with one embodiment of the present invention. In this embodiment, a small surface well bore area 544 bounding the wells at the surface allows a limited drilling and production pad 536 size at the surface and thus may minimize or reduce environmental disturbance in the drilling and production site and/or allows accessing a large subterranean area from a roadside or other small area in steep or other terrain. It will be understood that other suitable multi-well systems may be used for accessing a subterranean zone from a limited or other surface area without departing from the scope of the present invention. For example, wells slanting in whole or in part from the surface with horizontal and/or other suitable patterns drilled off the slant may be used in connection with the present invention without intersection of disparate surface wells. In this embodiment, water or other fluids from one or more horizontal patterns overflow into the slanted well where it is collected in a cavity or other bottom hole location and removed by gas lift or pumping to the surface or by diversion to another area or subterranean formation.

Referring to FIG. 14, a central surface well bore 532 is disposed offset relative to a pattern of well bores 534 at the surface 536 and intersects each of the well bores 534 below the surface. In this embodiment, the well bores 532 and 534 are disposed in a substantially non-linear pattern in close proximity to each other to reduce or minimize the area required for the well bores 532 and 534 on the surface 536. It will be understood that the well bores 534 may be otherwise positioned at the surface relative to each other and the central articulating surface bore 532. For example, the bores may have inline configuration.

Well bore patterns 538 are formed within target zone 540 exiting from cavities 542 located at the intersecting junctions of the well bores 532 and 534. Well bore patterns 538 may comprise pinnate patterns as illustrated by FIG. 8, or may include other suitable patterns for accessing the zone 540.

As illustrated by FIG. 14, the well bores 532 and 534 may be disposed in close proximity to each other at the surface while providing generally uniform access to a large area of the target zone 540. For example, well bores 532 and 534 may each be disposed within approximately thirty feet of another well and/or within two hundred feet, one hundred feet or less of every other well at the surface site while providing access to three hundred, five hundred, seven hundred fifty, one thousand or even twelve hundred or more acres in the zone 540. Further, for example, the well bores 532 and 534 may be disposed in a surface well bore area 544 less than two thousand, one thousand, seven hundred fifty, or even five hundred square feet, thereby reducing or minimizing the footprint required on the surface. The surface well bore area 544 is a smallest quadrilateral that bounds the wells at the surface and may have the dimensions of thirty-two feet by thirty-two feet and form a substantial square or may have the dimensions of fifty feet by two hundred feet and form a substantial rectangle. The drilling pad 536 may have an area of three-quarters of an acre for a tight well spacing at the surface with each well being within approximately thirty feet of at least one other well at the site. In another embodiment, the surface pad 536 may have an area of two acres with three-quarters of an acre for the center articulated well and one-quarter of an acre for each of four substantially vertical wells offset by about three hundred feet at the surface from the center well. The drilling pad 536 may be a square or other suitable quadrilateral and may include small areas that jut out and/or in of the quadrilateral, polygonal or other shape of the pad. In addition, one or more sides may be non-linear and/or one or more corners may be non-congruent.

Beneath the surface, well bore junctions or cavities 542 in wells 534 may be horizontally displaced or outward of the surface location of the wells such that a subsurface well bore junction area 546 bounding the junctions is substantially larger in size than the surface well bore area. This junction placement is due to, or allows, large radius curves for formation of the horizontal pattern, which improves or optimizes the subsurface reach of drilling equipment to form the horizontal drainage pattern. In a particular embodiment the subsurface junction area is the smallest quadrilateral to include all the cavities formed from this site and, in this and other embodiments, may be between four and five acres. As previously described, the coverage, or drainage area may be still substantially larger covering three hundred, five hundred or more acres in the zone 540. Thus, the multi-well system provides a vertical profile with a minimal or limited surface area and impact; enlarged, optimized or maximized subsurface drainage area; and an intermediate subsurface junction area to which fluids from the drainage pattern flow for collection and production to the surface.

Figure 15:
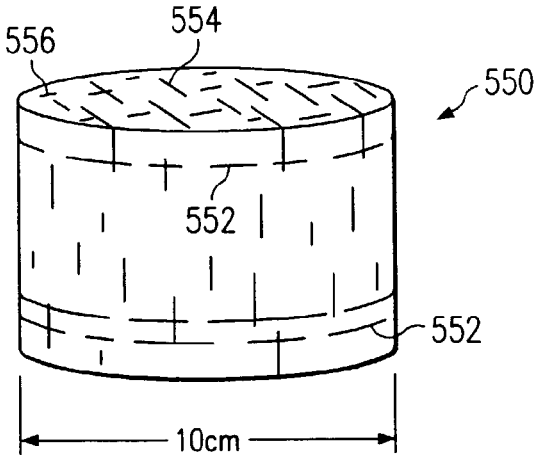
FIG. 15 is a diagram illustrating the matrix structure of coal in accordance with one embodiment of the present invention.

FIG. 15 illustrates the matrix structure 550 of coal in the seam 15 in accordance with one embodiment of the present invention. The coal may be bright banded coal with closely spaced cleats, dull banded coal with widely spaced cleats and/or other suitable types of coals.

Referring to FIG. 15, the coal structure 550 includes bedding planes 552, face, or primary, cleats 554, and butt, or secondary, cleats 556. The face and butt cleats 554 and 556 are perpendicular to the bedding plane 552 and to each other. In one embodiment, the face and butt cleats 554 and 556 may have a spacing between cleavage planes of one-eighth to one half of an inch.

In accordance with the present invention, the coal structure 550 has a medium effective permeability between three and ten millidarcies or a low effective permeability of below three millidarcies. In particular embodiments, the coal structure 550 may have an ultra low effective permeability below one millidarcy. Permeability is the capacity of a matrix to transmit a fluid and is the measure of the relative ease of fluid flow under an equal pressure drop. Effective permeability is a permeability of the coal or other formation matrix to gas or water and may be determined by well testing and/or long-term trends. For example, effective permeability may be determined by insitu slug tests, injection or draw down tests or other suitable direct or indirect well testing methods. Effective permeability may also be determined based on suitable data and modeling. The effective permeability is the matrix or formation permeability and may change during the life of a well. As used herein, the effective permeability of a formation and/or area of a formation is the median or mean effective permeability at substantially continuous flow conditions or simulated substantially continuous flow conditions of a formation or area over the life of the well, or over the period during which a majority of gas in the area is produced. The coal structure 550 may also have a medium absolute permeability between three and millidarcies or a low absolute permeability below three millidarcies. Absolute permeability is the ability of the matrix to conduct a fluid, such as a gas or liquid at one hundred percent saturation of that fluid. The relative permeability of the formation is the relationship between the permeability to gas versus the permeability to water.

As water is removed from the coal structure 550 through the pinnate or other multi-branching pattern at an accelerated rate, the large area pressure reduction of the coverage area affects a large rock volume. The bulk coal matrix 550 may shrink as it releases methane and causes an attendant increase in the width of the face and/or butt cleats 554 and 556. The increase in cleat width may increase permeability, which may further accelerate removal of water and gas from the coal seam 15.

Figure 16:
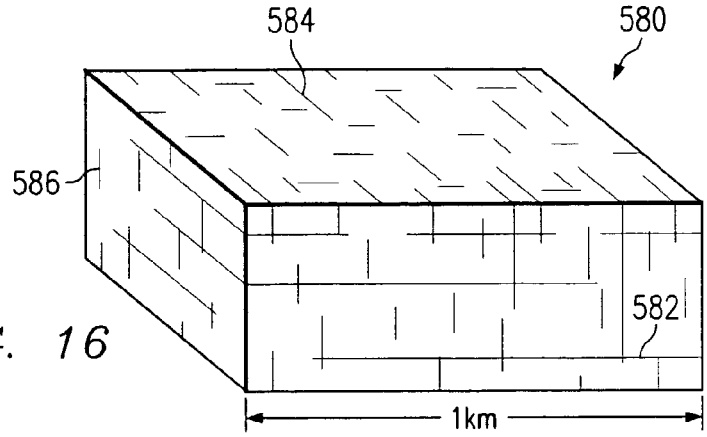
FIG. 16 is a diagram illustrating natural fractures in a coal seam in accordance with one embodiment of the present invention.

FIG. 16 illustrates the structure 580 of an area of the coal seam 15 in accordance with one embodiment of the present invention. The coal bed structure 580 includes natural fractures 582, 584 and 586. The natural fractures may be interconnected bedding planes, face cleats and/or butt cleats. Thus, the natural fractures may have one or more primary orientations in the coal seam that are perpendicular to each other and may hydraulically connect a series of smaller scale cleats. The natural fractures form high capacity pathways, may increase system permeability by an order of magnitude and thus may not suffer large reductions in permeability through relative permeability effects in medium and low permeability coals.

During production, as water and/or reservoir pressure is dropped in the coal seam 15, gas evolves from the coal matrix 550. The presence of gas in two-phase flow with the water may, for example, reduce the relative permeability of the coal matrix 550 relative to gas down to less than five percent of the absolute permeability. In other embodiments, the relative permeability of the coal matrix relative to gas may be reduced down to between three and twenty percent of absolute permeability or down to between eighteen and thirty percent of absolute permeability. As water saturation and/or pressure in the seam 15 is further reduced, the relative permeability may increase up to about twelve percent of absolute permeability at an irreducible water saturation. The irreducible water saturation may be at about seventy to eighty percent of full saturation. Travel of gas and water through natural cleats or fractures, however, may not be affected or not significantly affected by the relative permeability of the matrix 550. Thus, gas and water may be collected from the coal seam 15 through the natural fractures despite a relatively low relative permeability of the coal matrix 550 due to two-phase flow of gas and water.

Figure 17:
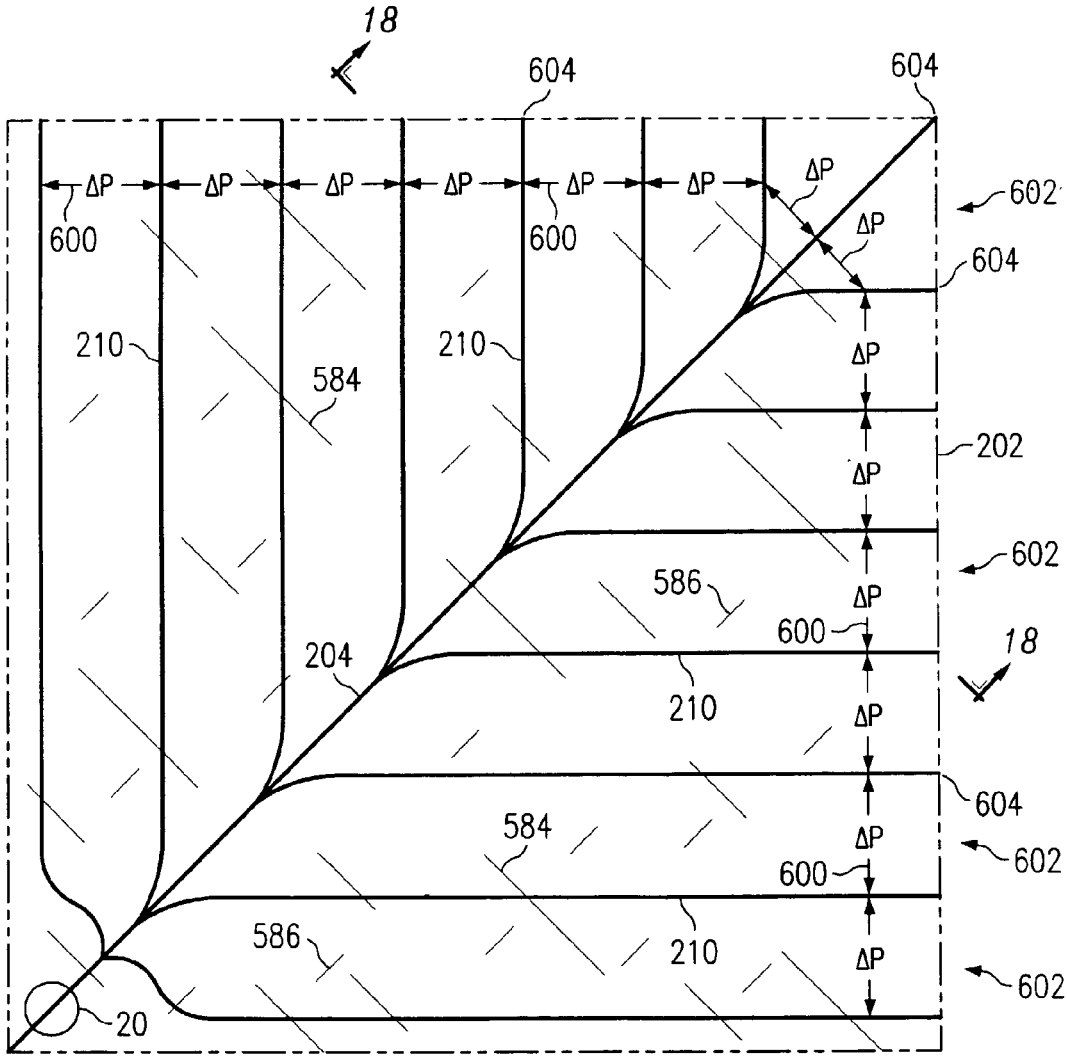
FIG. 17 is a top plan diagram illustrating pressure drop in the subterranean zone across a coverage area of the pinnate well bore pattern of FIG. 8 during production of gas and water in accordance with one embodiment of the present invention.
Figure 18:
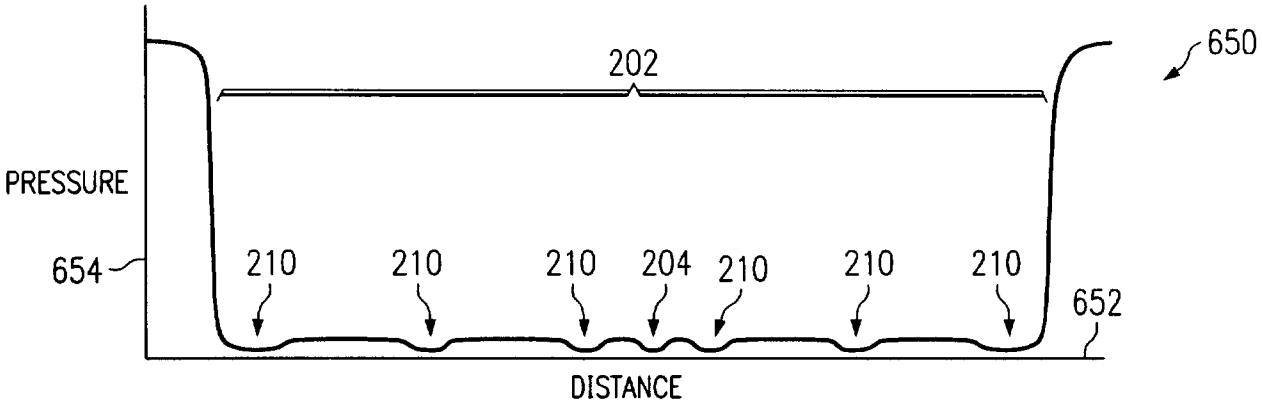
FIG. 18 is a chart illustrating pressure drop in the subterranean zone across line 18—18 of FIG. 17 in accordance with one embodiment of the present invention.

FIGS. 17–18 illustrate provision of a well bore pattern 50 in a coal seam 15 and pressure drop across a coverage area of the pattern 50 in accordance with one embodiment of the present invention. In this embodiment, the well bore pattern 50 is the pinnate pattern 200 described in connection with FIG. 8. It will be understood that the other pinnate and suitable multi-branching patterns may generate a similar pressure drop across the coverage area.

Referring to FIG. 17, the pinnate pattern 200 is provided in the coal seam 15 by forming the pattern in the coal seam 15, having the pattern formed, or using a preexisting pattern. The pinnate pattern 200 includes the main bore 204 and a plurality of equally spaced laterals 210. Laterals 210 are substantially perpendicular to each other and offset from the main bore by forty-five degrees. As a result, the pattern 200 is omni-directional in that significant portions of bore length have disparate orientations. The omni-directional nature of the pinnate pattern 200 may allow the pattern to intersect a substantial or other suitable percentage of the natural fractures 582, 584 and 586 of the coal seam 15 regardless of the orientation of the pattern in the seam magnifying the effective well bore radius. During production operations, such intensive coverage of natural fractures by the well bore pattern may allow for otherwise trapped water and gas to use the nearest natural fracture and easily drain to the well bore. In this way, high initial gas production rates realized. In a particular embodiment, the natural fractures may carry a majority or other suitable portion of gas and water from the coal seam 15 into the pinnate pattern 200 for collection at the cavity 20 and production to the surface 14.

In one embodiment, the pinnate pattern 200 may cover an area of two hundred fifty acres, have a substantially equal width to length ratio and have the laterals 210 each spaced approximately eight hundred feet apart. In this embodiment, a substantial portion of the coverage area 202 may be within four hundred feet from the main and/or lateral bores 204 and 210 with over fifty percent of the coverage area 202 being more than one hundred fifty to two hundred feet away from the bores. The pattern 200, in conjunction with a pump, may be operable to expose and drain five hundred barrels per day of water, of which about ninety percent may be non recharge water. In gas lift and other embodiments, up to and/or over four thousand or five thousand barrels per day of water may be removed.

Opposing bores 204 and/or 210 of the pinnate pattern 200 cooperate with each other to drain the intermediate area of the formation and thus reduce pressure of the formation. Typically, in each section of the formation between the bores 204 and/or 210, the section is drained by the nearest bore 204 and/or 210 resulting in a uniform drop in pressure between the bores. A pressure distribution 600 may be steadily reduced during production.

The main and lateral well bores 204 and 210 effectively increase well-bore radius with the large surface area of the lateral bores 210 promoting high flow rates with minimized skin damage effects. In addition, the trough pressure production of the bores 204 and 210 affects an extended area of the formation. Thus, essentially all the formation in the coverage are 202 is exposed to a drainage point and continuity of the flow unit is enhanced. As a result, trap zones of unrecovered gas are reduced.

Under virgin or drilled-in reservoir conditions for a thousand feet deep coal bed, formation pressure may initially be three hundred psi. Thus, at the time the pinnate pattern 200 is formed, the pressure at the bores 204 and 210 and at points equal distance between the bores 204 and 210 may be at or close to the initial reservoir pressure.

During water and/or gas production, water is continuously or otherwise drained from the coverage area 202 to the bores 204 and 210 and collected in the cavity 20 for removal to the surface. Influx water 602 from surrounding formations is captured at the tips of 604 of the main and lateral bores 204 and 210 to prevent recharge of the coverage area and thus allow continued pressure depletion. Thus, the coverage area is shielded from the surrounding formation with ninety percent or more of produced water being non recharge water. Water pressure may be steadily and substantially uniformly reduced across or throughout the coverage area 202 until a minimal differential is obtained. In one embodiment, for a mature well, the differential may be less than or equal to 20 to 50 psi within, for example, three to eight years in a medium or low pressure well. In a particular embodiment, the pressure differential may be less than 10 psi.

During dewatering, water saturation in the drainage or coverage area may be reduced by ten to thirty percent within one to three years. In a particular embodiment, water saturation may be reduced by ten percent within two years of the start of water production and thirty percent within three years of the start of water production. Reduction to an irreducible level may be within three, five or eight or more years of the start of water production.

As reservoir and/or water pressure decreases in the coverage area 202, methane gas is diffused from the coal and produced through the cavity 20 to the surface 14. In accordance with one embodiment of the present invention, removal of approximately 500 barrels a day or other suitable large volume of water from a 200–250 acre area of the coal seam 15, in connection with the pinnate or other pattern 200 and/or a substantial uniform pressure drop in the coverage area 202, initiates kick-off of the well, which includes the surface or production bore or bores as well as the hydraulically connected drainage bore or bores in the target zone. Removal volumes for kick-off may be about one tenth of the original water volume, or in a range of one eighth to one twelfth, and may suitably vary based on reservoir conditions. Early gas release may begin within one to two months of pumping operations. Early gas release and kick-off may coincide or be at separate times.

Upon early gas release, gas may be produced in two-phase flow with the water. The inclusion of gas in two-phase flow may lower the hydrostatic specific gravity of the combined stream below that of water thereby further dropping formation pressure in the area of two-phase flow and accelerating production from the formation. Moreover, the gas release may act as a propellant for two-phase flow production. In addition, the pressure reduction may affect a large rock volume causing a coal or other formation matrix to shrink and further accelerate gas release. For the coal seam 15, the attendant increase in cleat width may increase formation permeability and may thereby further expedite gas production from the formation. During gas release, kick off occurs when the rate of gas produced increases sharply and/or abruptly and gas production may then become self-sustaining.

FIG. 18 illustrates pressure differential in the coal seam 15 across line 18—18 of FIG. 17 in accordance with one embodiment of the present invention. In this embodiment, the well is in a relatively shallow, water saturated, 1000 feet deep coal seam 15. The lateral bores 210 are spaced approximately 800 feet apart.

Referring to FIG. 18, distance across the coverage area 202 is shown on the X axis 652 with pressure on the Y axis 654. Pressure differential, excepting blockage and friction, is in a particular embodiment at or substantially near 3 psi at the lateral bores 210 and the main bore 204. In the coverage area between the bores 264 and 210, the pressure differential, which does not include pressure due to blockage, friction and the like is less than or equal to 7 psi. Thus, substantially all the formation in the coverage area is exposed to a drainage point, continuity of the flow unit is maintained and water pressure and saturation is reduced through the coverage area. Trap zones of unrecovered gas are minimized. Pressure outside the coverage area may be at an initial reservoir pressure of 300 psi. The pressure increase gradiant may be steep as shown or more gradual.

A substantially uniform pressure gradiant within the coverage area 202 may be obtained within three months of the start of water production using gas lift and within six to nine months using rod pumps. Under continued substantially continuous flow conditions, the pressure differential may be maintained throughout the life of the well. It will be understood that the pressure may increase due to recharge water and gas if the well is shut in for any appreciable period of time. In this case, the water may again be removed using gas lift or rod pumps. It will be further understood that water may be otherwise suitably removed without production to the surface by down hole reinjection, a subsurface system of circuits, and the like. In some areas, a pressure differential of ten psi may be obtained in one or more years. In these and other areas, the pressure may be about seventy percent of the drilled-in pressure within three months.

Figure 19:
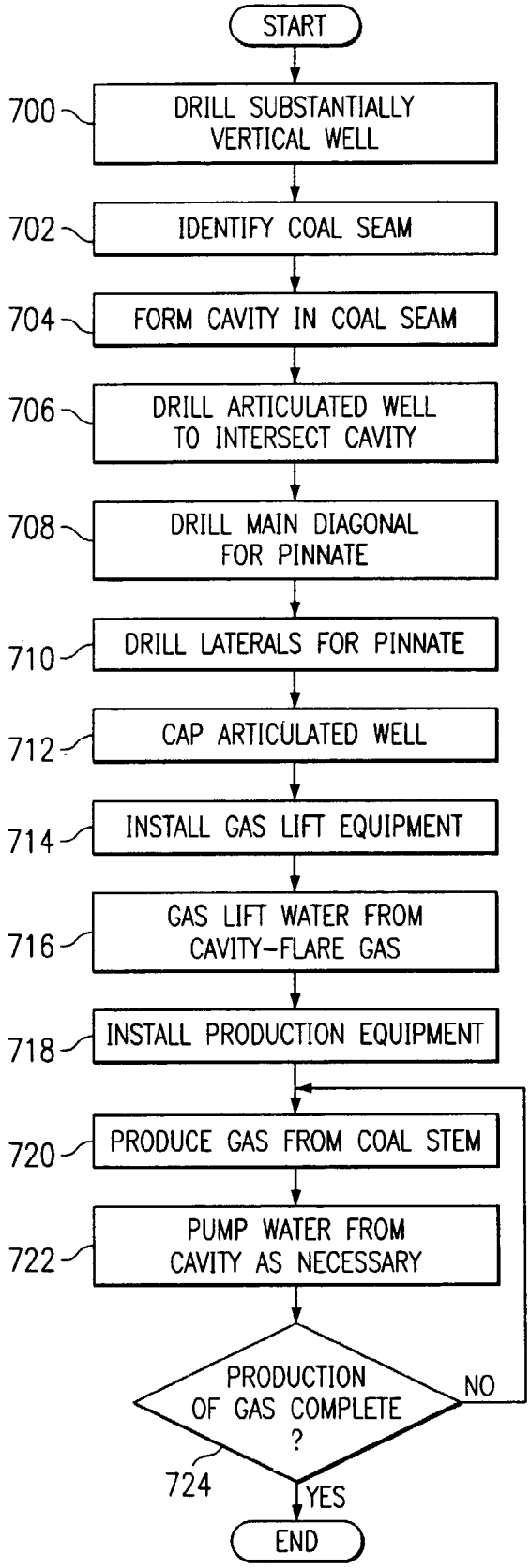
FIG. 19 is a flow diagram illustrating a method for surface production of gas from the coverage area of the subterranean zone in accordance with embodiment of the present invention.

FIG. 19 is a flow diagram illustrating a method for surface production of gas from a subterranean zone in accordance with one embodiment of the present invention. In this embodiment, the subterranean zone is a coal seam with a medium to low effective permeability and a multi-well system with a cavity is used to produce the coal seam. It will be understood that the subterranean zone may comprise gas bearing shales and other suitable formations.

Referring to FIG. 19, the method begins after the region to be drained and the type of drainage patterns 50 for the region have been determined. Any suitable pinnate, other substantially uniform pattern providing less than ten or even five percent trapped zones in the coverage area, omni-directional or multi-branching pattern may be used to provide coverage for the region.

At step 700, in an embodiment in which dual intersecting wells are used, the substantially vertical well 12 is drilled from the surface 14 through the coal seam 15. Slant and other single well configurations may instead be used. In a slant well configuration, the drainage patterns may be formed off of a slant well or a slanting portion of a well with a vertical or other section at the surface.

Next, at step 702, down hole logging equipment is utilized to exactly identify the location of the coal seam 15 in the substantially well bore 12. At step 704, the enlarged diameter or other cavity 20 is formed in the substantially vertical well bore 12 at the location of the coal seam 15. As previously discussed, the enlarged diameter cavity 20 may be formed by underreaming and other suitable techniques. For example, the cavity may be formed by fracing.

Next, at step 706, the articulated well bore 30 is drilled to intersect the enlarged diameter cavity 20. At step 708, the main well bore for the pinnate drainage pattern is drilled through the articulated well bore 30 into the coal seam 15. As previously described, lateral kick-off points, or bumps may be formed along the main bore during its formation to facilitate drilling of the lateral bores. After formation of the main well bore, lateral bores for the pinnate drainage pattern are drilled at step 710.

At step 712, the articulated well bore 30 is capped. Next, at step 714, gas lift equipment is installed in preparation for blow-down of the well. At step 716, compressed air is pumped down the substantially vertical well bore 12 to provide blow-down. The compressed air expands in the cavity 20, suspends the collected fluids within its volume and lifts the fluid to the surface. At the surface, air and produced methane or other gases are separated from the water and flared. The water may be disposed of as runoff, reinjected or moved to a remote site for disposal. In addition to providing gas lift, the blow-down may clean the cavity 20 and the vertical well 12 of debris and kick-off the well to initiate self-sustaining flow. In a particular embodiment, the blow-down may last for one, two or a few weeks and produce 3000, 4000, or 5000 or more barrels a day of water.

At step 718, production equipment is installed in the substantially vertical well bore 12 in place of the gas lift equipment. The production equipment may include a well head and a sucker rod pump extending down into the cavity 20 for removing water from the coal seam 15. If the well is shut in for any period of time, water builds up in the cavity 20 or self-sustaining flow is otherwise terminated, the pump may be used to remove water and drop the pressure in the coal seam 15 to allow methane gas to continue to be diffused and to be produced up the annulus of the substantially vertical well bore 12.

At step 720, methane gas diffused from the coal seam 15 is continuously produced at the surface 14. Methane gas may be produced in two-phase flow with the water or otherwise produced with water and/or produced after reservoir pressure has been suitably reduced. As previously described, the removal of large amounts of water from and/or rapid pressure reduction in the coverage area of the pinnate pattern may initiate and/or kick-off early gas release and allow the gas to be produced based on an accelerated production curve. Proceeding to step 722, water that drains through the drainage pattern into the cavity 20 that is not lifted by the produced gas is pumped to the surface with the rod pumping unit. Water may be continuously or intermittently pumped as needed for removal from the cavity 20. In one embodiment, to accelerate gas production, water may be initially removed at a rate of 500 barrels a day or greater.

Next, at decisional step 724 it is determined whether the production of gas from the coal seam 15 is complete. In a particular embodiment, approximately seventy-five percent of the total gas in the coverage area of the coal seam may be produced at the completion of gas production. The production of gas may be complete after the cost of the collecting the gas exceeds the revenue generated by the well. Alternatively, gas may continue to be produced from the well until a remaining level of gas in the coal seam 15 is below required levels for mining or other operations. If production of the gas is not complete, the No branch of decisional step 724 returns to steps 720 and 722 in which gas and/or water continue to be removed from the coal seam 15.

Upon completion of production, the Yes branch of decisional step 724 leads to the end of the process by which gas production from a coal seam has been expedited. The expedited gas production provides an accelerated rate of return on coal bed methane and other suitable gas production projects. Particularly, the accelerated production of gas allows drilling and operating expenses for gas production of a field to become self-sustaining within a year or other limited period of time as opposed to a typical three to five-year period. As a result, capital investment per field is reduced. After the completion of gas production, water, other fluids or gases may be injected into the coal seam 15 through the pattern 50.

Figure 20:
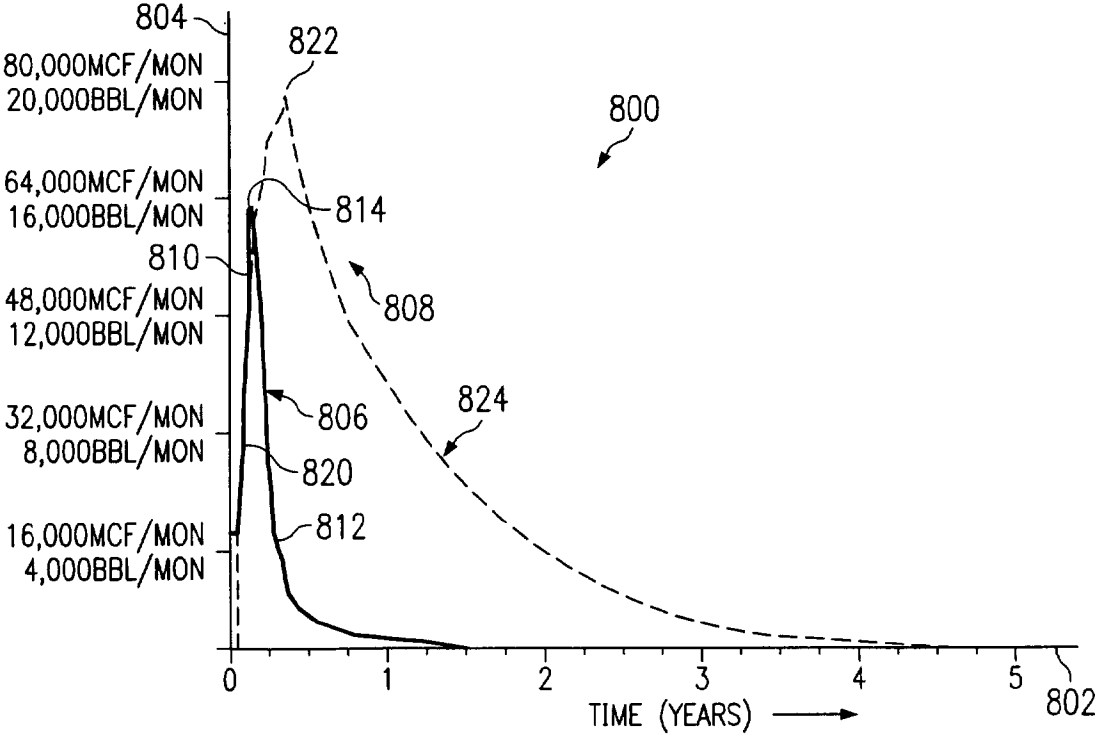
FIG. 20 is a graph illustrating production curves for gas and water from the coverage area of the subterranean zone in accordance with one embodiment of the present invention.

FIG. 20 illustrates a production chart 800 for an area of coal seam 15 having a medium to low effective permeability in accordance with one embodiment of the present invention. In this embodiment, water and gas are drained to the cavity 20 through a uniform pinnate pattern and produced to the surface 14. It will be understood that water and gas may be collected from the coal seam 15 in other suitable subsurface structures such as a well bore extending below the well bore pattern 50 so as to prevent pressure buildup and continued drainage of the coverage area. In addition, it will be understood that reservoir pressure may be suitably reduced without the use of a cavity, rat hole or other structure or equipment. For example, the use of a volume control pump operable to prevent the buildup of a hydrostatic pressure head that would inhibit and/or shut down drainage from the coverage area may be used.

Referring to FIG. 20, the chart 800 includes time in months along the X axis 802 and production along the Y axis 804. Gas production is in thousand cubic feet per month (MCF/mon) while water production is in barrels per month (BBL/mon). It will be understood that actual production curves may vary due to operating conditions and parameters as well as formation and operating irregularities and equipment sensitivity and reliability. A water production curve 806 and a gas production curve 808 are based on an initial one to two week blow-down and on production under substantially continuous flow conditions. Flow conditions are continuous when the well is not shut in, when production is continuous and/or when gas is produced without pressure build up at the well head. Flow conditions are substantially continuous when flow interruptions are limited to shut-ins for routine maintenance and/or shut-ins for less than twenty or even ten or five percent of a production time period. The production curves wells produced under conditions that are not substantially continuous may be normalized and/or suitably adjusted to provide gas and water production curves of the well under substantially continuous flow conditions. Thus, production curves, production amounts, production times as well as formation parameters such as absolute, relative or effective permeability may be actually measured, determined based on modeling, estimated based on standardized equations and/or trends or otherwise suitably determined.

The water production curve 806 reaches a peak within a first or second month from the start of water production with a majority of removable water being removed from the coverage area within three months to one year of the start of water production. Water production 806 may have a fixed flow volume for dewatering prior to kick-off and thereafter a steep and substantially linear incline 810 and decline 812 with a sharp peak 814.

The gas production curve 808 may have a steep incline 820 followed by a peak 822. Under substantially continuous flow conditions the peak may occur within one month or a year from the start of water production. The peak 822 may have a substantially exponential or other decline 824 that does not reach one-third or one-quarter of the peak rate until after twenty-five percent, a third or even a majority of the total gas volume in the coverage area has been produced. It will be understood that more than the specified amount of gas may be produced within the specified period. In tight or other coals, the production curve may have a hyperbolic decline. A peak has or is followed by a decline when the decline tapers directly off from that peak.

The value produced is represented by the area under the production curve. Thus, under substantially continuous flow conditions, the majority of the gas is produced at or toward the beginning of the production time period rather than a gradual increase in gas rates with a peak occurring at the middle or toward the end of a complete gas production cycle. In this way, production is front-loaded. It will be understood that free or near well-bore gas in the immediate vicinity of the well bores may be released during drilling or the very beginning of production may have a separate peak. Thus, with production curves may include several peaks which are each a tapering, projecting point with substantial declines on both sides of the point. Such free gas, however, accounts for about two to five percent of the total gas in the coverage area of the coal seam 15.

Gas production may kick-off at approximately one week and proceeds at a self-sustaining rate for an extended period of time. The rate may be self-sustaining when water no longer needs to be removed to the surface by the provision of compressed air or by a pump. Gas production may peak before the end of the third month in medium permeability seams or take nine months, twelve months, eighteen months or two to three years in low and ultra low permeability seams. During the life of the well, the effective permeability of coal in the coverage area may vary based on water and gas saturations and relative permeability.

After the peak 822, gas production may thereafter decline over the next three to five years until completed. On the decline, at least part of the production may be self-sustaining. Thus, gas from a corresponding area of the coal seam 15 may be produced within one, two, three or five years with half the gas produced within a 12 to 18 month period. At kick-off, pressure may be at 200 to 250 psi, down from an initial 300 psi and thereafter drop sharply.

The gas production time may be further reduced by increasing water removal from the coal seam 15 and may be extended by reducing water production. In either case, kick-off time may be based on relative water removal and the decline curves may have substantially the same area and profile. In one embodiment, the amount of water collected in the cavity 20 and thus that can be removed to the surface 20 may be controlled by the configuration of the drainage pattern 50 and spacing of the lateral bores. Thus, for a given coal seam 15 having a known or estimated permeability, water pressure and/or influx, lateral spacing may be determined to drain a desired volume of water to the cavity 20 for production to the surface 14 and thus set the gas production curve 806. In general, lateral spacing may be increased with increasing permeability and may be decreased with decreasing permeability or increasing reservoir or water pressure or influx. In a particular embodiment, drilling expenses may be weighed against the rate of returns and a suitably optimized pattern and/or lateral spacing determine. In this way, commercially viable fields for methane gas production are increased. A Coal Gas simulator by S. A. Holditch or other suitable simulator may be used for determining desired lateral spacing.

Figure 21:
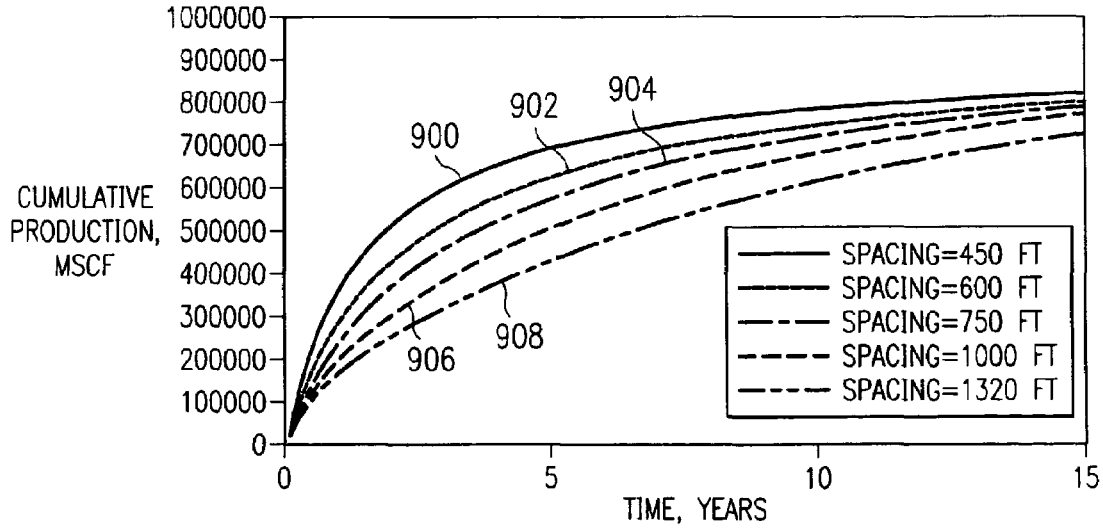
FIG. 21 is a graph illustrating simulated cumulative gas production curves for a multi-lateral well as a function of lateral spacing in accordance with one embodiment of the present invention.

FIG. 21 illustrates a simulated cumulative gas production chart for a multi-lateral well as a function of lateral spacing in accordance with one embodiment of the present invention. In this embodiment, the baseline reservoir properties used for the simulation models is a coal bed with a thickness of 5.5 feet, an initial pressure of 390 psia, an ash content of 9.3%, a moisture content of 2.5%, a Langmuir volume of 1,032 scf/ton, a Langmuir pressure 490 psia, a sorption time of a hundred days, a horizontal well diameter of 4.75 inches, a horizontal well skin factor of zero and a well FBHP of 20 psia. Total laterals for the simulated wells as a function of lateral spacing is twenty-two thousand, six hundred feet of total lateral for a lateral spacing of four hundred fifty feet, seventeen thousand, five hundred feet of total lateral for a six hundred foot lateral spacing, fourteen thousand, eight hundred feet of total lateral for seven hundred fifty foot lateral spacing, twelve thousand three hundred feet of total lateral for a one thousand foot lateral spacing and ten thousand four hundred feet of total lateral for one thousand three hundred and twenty foot lateral spacing. Permeability for the coal seam was 0.45 millidarcies.

Referring to FIG. 21, a cumulative gas production curve 900 for a lateral spacing of four hundred fifty feet is illustrated over a fifteen year production time. Cumulative gas production curves 902, 904, 906 and 908 are also illustrated for lateral spacings of six hundred feet, seven hundred fifty feet, one thousand feet and one thousand three hundred twenty feet, respectively. Other suitable lateral spacings less than, greater than or between the illustrated spacings may be used and suitably varied based on the permeability and type of the coal seam as well as rate of return and other economic factors.

Although the present invention has been described with several embodiments, various changes and modifications may be suggested to one skilled in the art. It is intended that the present invention encompass such changes and modifications as fall within the scope of the appended claims and their equivalence.

What is claimed is:

1. A method for surface production of gas from a subterranean zone, comprising:

lowering reservoir pressure in an area of a subterranean zone having a medium to low effective permeability through a multi-branching well bore pattern providing a drainage network for the area;

producing gas from the area of the subterranean zone in two-phase flow with water from the area;

producing twenty-five percent of total gas in the area of the subterranean zone within three years of a start of production; and wherein the subterranean zone comprises a coal bed.

2. The method of claim 1, wherein the subterranean zone has a low effective permeability.

3. The method of claim 1, further comprising lowering reservoir pressure throughout the area of the subterranean zone while a subterranean aquifer continues to supply additional water to the area.

4. The method of claim 1, wherein the well bore pattern includes a plurality of cooperating bores, further comprising substantially uniformly dropping reservoir pressure throughout the area of the subterranean zone by producing through the cooperating bores of the well bore pattern to the surface.

5. The method of claim 1, further comprising producing gas from the area of the subterranean zone in two-phase flow with water from the area.

6. The method of claim 1, wherein the gas comprises methane.

7. The method of claim 6, further comprising producing the methane in a self-sustaining flow.

8. The method of claim 7, further comprising reaching the self-sustaining flow within one year of a start of production.

9. The method of claim 6, further comprising producing at least twenty percent of methane in the area within two years of the start of production.

10. The method of claim 1, wherein the well bore pattern comprises a pinnate well bore pattern.

11. The method of claim 1, wherein the area comprises a substantially polygonal area of the subterranean zone.

12. The method of claim 1, wherein the area comprises a substantially square area of the subterranean zone.

13. The method of claim 1, wherein the area comprises a substantially non-disjointed area of the subterranean zone.

14. The method of claim 1, wherein the area comprises a substantially symmetrical area of the subterranean zone.

15. The method of claim 1, wherein the area comprises a shape operable to be nested between a plurality of similarly shaped areas.

16. The method of claim 4, wherein the area extends to any point in the subterranean zone horizontally between any two of the cooperating bores.

17. The method of claim 4, wherein over fifty percent of the area is horizontally spaced apart from any cooperating bore by distance of greater than 200 feet.

18. The method of claim 4, wherein the pressure differential within the area is less than or equal to 10 pounds per square inch (psi) within six months of the start of production.

19. The method of claim 1, further comprising:

producing water through the bore of the well bore pattern to a cavity; and lifting water from the cavity to the surface.

20. The method of claim 19, wherein the cavity comprises a volume greater than or equal to 1000 cubic feet.

21. The method of claim 19, wherein the cavity comprises a horizontal cross section greater than or equal to 20 square feet.

22. The method of claim 4, wherein a plurality of the cooperating bores are substantially parallel to each other.

23. The method of claim 4, wherein the area extends to a periphery of the well bore pattern defined by a distal end of all the cooperating bores.

24. The method of claim 1, further comprising producing at least twenty-five percent of the total gas in the area of the subterranean zone within eighteen months of the start of production.

25. The method of claim 1, further comprising producing at least twenty-five percent of the total gas in the area of the subterranean zone within one year of the start of production.

26. The method of claim 1, further comprising producing at least twenty-five percent of the total gas in the area of the subterranean zone within nine months of the start of production.

27. The method of claim 1, further comprising producing at least twenty-five percent of the total gas in the area of the subterranean zone within six months of the start of production.

28. The method of claim 1, further comprising producing at least one third of the gas in the area of the subterranean zone within five years of the start of production.

29. The method of claim 1, further comprising producing at least one-third of the gas in the area of the subterranean zone within two years of the start of production.

30. The method of claim 1, further comprising producing at least one-third of the gas in the area of the subterranean zone within one year of the start of production.

31. The method of claim 1, further comprising producing at least one-third of the gas in the area of the subterranean zone within six months of the start of production.

32. The method of claim 1, further comprising producing at least forty percent of the gas in the area of the subterranean zone within five years of the start of production.

33. The method of claim 1, further comprising producing at least forty percent of the gas in the area of the subterranean zone within two years of the start of production.

34. The method of claim 1, further comprising producing at least forty percent of the gas in the area of the subterranean zone within one year of the start of production.

35. The method of claim 1, further comprising producing at least two thirds of the gas in the area of the subterranean zone within five years of the start of production.

36. The method of claim 1, further comprising producing at least two thirds of the gas in the area of the subterranean zone within three years of the start of production.

37. The method of claim 1, wherein the well bore pattern is operable under substantially continuous flow conditions to allow non-near well bore gas to be produced at a peak rate within three years of the start of production.

38. The method of claim 1, wherein the well bore pattern is operable under substantially continuous flow conditions to allow non-near well bore gas to be produced at a peak rate within two years of the start of production.

39. The method of claim 1, wherein the well bore pattern is operable under substantially continuous flow conditions to allow non-near well bore gas to be produced at a peak rate within one year of the start of production.

40. The method of claim 1, wherein the well bore pattern is operable under substantially continuous flow conditions to allow non-near well bore gas to be produced at a peak rate within six months of the start of production.

41. The method of claim 1, wherein the well bore pattern is operable under substantially continuous flow conditions to allow non-near well bore gas to be produced at a peak rate within three months of the start of production.

42. The method of claim 1, further comprising producing gas from the area under substantially continuous flow conditions for at least eighteen months after the start of production and reaching a peak production rate for non-near well bore gas during the eighteen months within nine months of the start of production.

43. The method of claim 1, further comprising producing gas from the area under substantially continuous flow conditions for at least a year after the start of water production and reaching a peak production rate for non-near well bore gas during the year within six months of the start of production.

44. The method of claim 1, wherein the well bore pattern is operable under substantially continuous flow conditions to allow within three years of the start of production gas to be produced at a peak rate and to allow one-third of the gas in the area to be produced before a product decline from the peak rate reaches one-third of the peak rate.

45. The method of claim 1, wherein the well bore pattern is operable under substantially continuous flow conditions to allow within two years of the start of production gas to be produced at a peak rate and to allow one-third of the gas in the area has been produced before a production decline from the peak rate reaches one-third of the peak rate.

46. The method of claim 1, wherein the well bore pattern is operable under substantially continuous flow conditions to allow within one year of the start of production gas to be produced at a peak rate and to allow one-third of the gas in the area has been produced before a production decline from the peak rate reaches one-third of the peak rate.

47. The method of claim 1, wherein the well bore pattern is operable under substantially continuous flow conditions to allow within nine months of the start of production gas to be produced at a peak rate and to allow one-third of the gas in the area has been produced before a production decline from the peak rate reaches one-third of the peak rate.

48. The method of claim 1, wherein the well bore pattern is operable under substantially continuous flow conditions to allow within six months of the start of production gas to be produced at a peak rate and to allow one-third of the gas in the area has been produced before a production decline from the peak rate reaches one-third of the peak rate.

49. The method of claim 1, further comprising producing gas from the area under substantially continuous flow conditions for at least eighteen months after the start of production and reaching a peak rate of gas production within the eighteen months, the peak followed by a decline that under substantially continuous flow conditions reaches one-third of the peak rate after one-third of the gas has been produced from the area.

50. The method of claim 1, further comprising producing gas from the area under substantially continuous flow conditions for at least nine months after the start of production and reaching a peak rate of gas production within the nine months, the peak followed by a decline that under substantially continuous flow conditions reaches one-third of the peak rate after one-third of the gas has been produced from the area.

51. The method of claim 1, further comprising producing gas from the area at an exponential decline under substantially continuous flow conditions.

52. The method of claim 1, further comprising lowering reservoir pressure by removing water from the area and providing gas lift to produce to the surface at least part of the water collected by the well bore pattern.

53. The method of claim 52, further comprising providing the gas lift by providing compressed air down a surface bore through which the gas is produced.

54. The method of claim 53, wherein the compressed air is pumped down the surface bore at over two hundred pounds per square inch psi).

55. The method of claim 53, wherein the compressed air is provided at a rate of over five hundred cubic feet per minute (CFM).

56. The method of claim 53, wherein the compressed air is provided at a pressure of over two hundred fifty pounds per square inch (psi) and at a rate of over eight hundred cubic feet per minute (CFM).

57. The method of claim 52, further comprising producing at least three thousand barrels of water per day during a first week of water production.

58. The method of claim 52, further comprising producing at least four thousand barrels of water per day during a first week of water production.

59. The method of claim 52, further comprising producing at least five thousand barrels of water per day during a first week of water production.

60. The method of claim 52, wherein the gas lift is provided at the start of production for a period of less than six weeks.

61. The method of claim 52, further comprising providing gas lift at least until gas production kicks off to a self-sustaining flow.

62. The method of claim 1, wherein the well bore pattern comprises a multi-lateral pattern.

63. The method of claim 1, wherein the pattern comprises an omni-directional pattern.

64. The method of claim 1, wherein the pattern is operable to intersect a substantial number of natural fractures in the area of the subterranean zone.

65. The method of claim 1, further comprising obtaining a majority of at least twenty-five percent of the total gas in the area into the pattern from intersections of the well bore pattern with natural fractures of the subterranean zone.

66. The method of claim 1, wherein the subterranean zone comprises a coal seam, further comprising producing a majority of gas from the area of the coal seam while relative permeability of coal to gas in a coal matrix of the coal seam remains substantially below twenty percent of absolute permeability.

67. The method of claim 1, wherein the effective permeability is below eight millidarcies.

68. The method of claim 1, wherein the effective permeability is below six millidarcies.

69. The method of claim 1, wherein the effective permeability is below four millidarcies.

70. The method of claim 1, wherein the effective permeability is below two millidarcies.

71. The method of claim 1, wherein the effective permeability is below one millidarcy.

72. The method of claim 1, further comprising reducing reservoir pressure by removing water from the area and reaching a self-sustaining flow within nine months of the start of production.

73. The method of claim 1, further comprising reducing reservoir pressure by removing water from the area and reaching a self-sustaining flow within six months of the start of production.

74. The method of claim 1, further comprising reducing reservoir pressure by removing water from the area and reaching a self-sustaining flow within three months of the start of production.

75. The method of claim 1, further comprising reducing reservoir pressure by removing water from the area and reaching a self-sustaining flow within one month of the start of production.

76. The method of claim 1, further comprising reducing reservoir pressure by removing water from the area and reaching a self-sustaining flow within two weeks of the start of production.

77. The method of claim 1, further comprising reducing reservoir pressure by removing water from the area and reaching a self-sustaining flow within one week of the start of production.

78. The method of claim 1, wherein the pressure differential within the area is less than or equal to ten pounds per square inch (psi) within three years of the start of production.

79. The method of claim 1, wherein the pressure in the area is less than or equal to seventy percent of the drilled-in pressure within three months of the start of production.

80. The method of claim 1, further comprising dewatering the area of the subterranean zone to reduce the reservoir pressure and reducing a water saturation in the area by ten percent within two years of the start of production.

81. The method of claim 1, further comprising dewatering the area of the subterranean zone to reduce the reservoir pressure and reducing a water saturation in the area by twenty percent within three years of the start of production.

82. The method of claim 1, further comprising dewatering the area of the subterranean zone to reduce the reservoir pressure and reducing a water saturation in the area by thirty percent within three years of the start of production.

83. The method of claim 1, further comprising dewatering the area of the subterranean zone to reduce the reservoir pressure and reducing a water saturation in the area to substantially an irreducible level within three years of the start of production.

84. The method of claim 1, further comprising dewatering the area of the subterranean zone to reduce the reservoir pressure and reducing a water saturation in the area to substantially an irreducible level within five years of the start of production.

85. The method of claim 1, further comprising dewatering the area of the subterranean zone to reduce the reservoir pressure and reducing a water saturation in the area to substantially an irreducible level within eight years of the start of production.

86. The method of claim 1, further comprising dewatering the area of the subterranean zone to reduce reservoir pressure and reducing a water saturation below ninety percent of an initial water saturation within eighteen months of the start of production.

87. The method of claim 1, further comprising dewatering the area of the subterranean zone to reduce reservoir pressure and reducing a water saturation below ninety percent of an initial water saturation within one year of the start of production.

88. The method of claim 1, further comprising dewatering the area of the subterranean zone to reduce reservoir pressure and reducing a water saturation below ninety percent of an initial water saturation within nine months of the start of production.

89. The method of claim 1, further comprising dewatering the area of the subterranean zone to reduce reservoir pressure and reducing a water saturation below ninety percent of an initial water saturation within six months of the start of production.

90. The method of claim 1, further comprising dewatering the area of the subterranean zone to reduce reservoir pressure and reducing a water saturation below ninety percent of an initial water saturation within three months of the start of production.

91. The method of claim 1, further comprising dewatering the area of the subterranean zone to reduce reservoir pressure and reducing a water saturation below eighty percent of an initial water saturation within eighteen months of the start of production.

92. The method of claim 1, further comprising dewatering the area of the subterranean zone to reduce reservoir pressure and reducing a water saturation below eighty percent of an initial water saturation within one year of the start of production.

93. The method of claim 1, further comprising dewatering the area of the subterranean zone to reduce reservoir pressure and reducing a water saturation below eighty percent of an initial water saturation within nine months of the start of production.

94. The method of claim 1, further comprising dewatering the area of the subterranean zone to reduce reservoir pressure and reducing a water saturation below eighty percent of an initial water saturation within six months of the start of production.

95. The method of claim 1, further comprising dewatering the area of the subterranean zone to reduce reservoir pressure and reducing a water saturation below eighty percent of an initial water saturation within three months of the start of production.

96. The method of claim 1, wherein the well bore pattern is a substantially horizontal pattern, further comprising producing gas and water from the area of the subterranean zone substantially through a single surface well connected with the horizontal well bore pattern.

97. The method of claim 1, wherein the well bore pattern is a substantially horizontal pattern, further comprising producing gas and water from the subterranean zone through one or more interconnected well bores extending from the surface to the horizontal well bore pattern.

98. The method of claim 97, wherein the horizontal well bore pattern comprises a plurality of substantially identical sub-patterns extending from a substantial center of the area, the sub-patterns each having a disparate orientation.

99. The method of claim 1, wherein the well bore pattern comprises a plurality of substantially identical subpatterns extending from a substantial center of the area, the sub-patterns each having a disparage orientation.

100. The method of claim 1, wherein the area of the subterranean zone comprises at least three hundred acres.

101. The method of claim 1, wherein the area of the subterranean zone comprises at least five hundred acres.

102. The method of claim 1, wherein the area of the subterranean zone comprises at least seven hundred fifty acres.

103. The method of claim 1, wherein the well bore pattern comprises a substantially horizontal pattern.

104. The method of claim 1, wherein reservoir pressure is reduced by removing water and the water is produced to the surface.

105. A method for producing gas from a tight coal formation, comprising:

using a well bore pattern providing coverage of an area of a coal seam having an effective permeability below seven millidarcies to remove water from the area of the coal seam; and removing a sufficient volume of water from the area of the coal seam to obtain at substantially continuous flow conditions and within two years of a start of water production a gas production peak rate having a decline that reaches one-third of the peak rate after at least twenty-five percent of gas in the area has been produced, wherein at least a portion of the gas is produced in a two-phase flow with at least some of the water from the area of the coal seam.

106. The method of claim 105, further comprising removing a sufficient volume of water from the area of the coal seam to obtain the gas production peak rate within eighteen months of the start of water production.

107. The method of claim 105, further comprising removing a sufficient volume of water from the area of the coal seam to obtain the gas production peak rate within one year of the start of water production.

108. The method of claim 105, further comprising removing a sufficient volume of water from the area of the coal seam to obtain the gas production peak rate within nine months of the start of water production.

109. The method of claim 105, further comprising removing a sufficient volume of water from the area of the coal seam to obtain the gas production peak rate within six months at the start of water production.

110. The method of claim 105, further comprising removing a sufficient volume of water from the area of the coal seam to obtain the gas production peak rate within three months of the start of water production.

111. The method of claim 105, wherein the decline curve comprises an exponential decline under substantially continuous flow conditions.

112. The method of claim 105, wherein the coal seam has an effective permeability below five millidarcies.

113. The method of claim 105, wherein the coal seam has an effective permeability below three millidarcies.

114. The method of claim 105, wherein the coal seam has an effective permeability below two millidarcies.

115. The method of claim 105, wherein the coal seam has an effective permeability below one millidarcy.

116. A method for producing gas from a tight coal formation, comprising:

using a well bore pattern providing coverage of an area of a coal seam having an effective permeability below seven millidarcies to remove water from the area of the coal seam; and removing a sufficient volume of water from the area of the coal seam to obtain at substantially continuous flow conditions and within two years of a start of water production a gas production peak rate having an exponential decline that reaches one-quarter of the gas production peak rate after at least thirty percent of gas in the area has been produced, wherein at least a portion of the gas is produced in a two-phase flow with at least some of the water from the area of the coal seam.

117. The method of claim 116, further comprising obtaining the production peak within one year of the start of water production.

118. The method of claim 116, further comprising obtaining the production peak within nine months of the start of water production.

119. The method of claim 116, further comprising obtaining the production peak within six months of the start of water production.

120. The method of claim 116, further comprising obtaining the production peak within three months of the start of water production.

121. A method for surface production of gas from a subterranean zone, comprising:

lowering water pressure throughout an area of a subterranean zone having a medium to low effective permeability by removing water from the area through a well bore pattern providing coverage of the area to the surface;

producing gas from the area of the subterranean zone in two-phase flow with at least some of the water from the area;

producing gas in a self-sustaining flow from the area of the subterranean zone within two years of a start of water production; and wherein the subterranean zone comprises a coal bed.

122. The method of claim 121, further comprising producing gas in the self-sustaining flow within eighteen months of the start of water production.

123. The method of claim 121, further comprising producing gas in the self-sustaining flow within twelve months of the start of water production.

124. The method of claim 121, further comprising producing gas in the self-sustaining flow within nine months of the start of water production.

125. The method of claim 121, further comprising producing gas in the self-sustaining flow within six months of the start of water production.

126. The method of claim 121, further comprising producing gas in the self-sustaining flow within three months of the start of water production.

127. A method for surface production of gas from a subterranean zone, comprising:

providing a well bore pattern in a subterranean zone having a medium to low effective permeability, the well bore pattern comprising at least one bore and providing coverage of an area of the subterranean zone;

lowering water pressure in the area of the subterranean zone by using gas lift to produce to the surface at least some water collected by the well bore pattern from the subterranean zone;

producing gas from the area of the subterranean zone in two-phase flow with at least some water from the area; and wherein the subterranean zone comprises a coal bed.

128. The method of claim 127, further comprising providing gas lift by providing compressed air to a subterranean cavity collecting water from a well bore pattern.

129. The method of claim 128, wherein the compressed air is provided at a pressure of over two hundred pounds per square inch (psi) and a rate of over eight hundred cubic feet per minute (CFM).

130. A method for surface production of gas from a coal seam, comprising:

providing an onini-directional horizontal well bore pattern in a medium to low effective permeability coal seam, the well bore pattern providing coverage of an area of the coal seam and operable to intersect a substantial number of natural fractures in the area of the coal seam;

producing gas from the area of the coal seam in two-phase flow with water from the area; and obtaining a majority of gas from the area into the well bore pattern from the natural fractures intersecting the well bore pattern.

131. The method of claim 130, further comprising producing twenty percent of gas in the area of the coal seam while relative permeability of coal to gas in a coal matrix of the coal seam remains below twenty percent of absolute permeability.

132. The method of claim 131, further comprising producing thirty percent of the gas in the area while the relative permeability of coal to gas of the coal matrix remains below the twenty percent of absolute permeability.

133. The method of claim 131, further comprising producing forty percent of the gas in the area while the relative permeability of coal to gas of the coal matrix remains below the twenty percent of absolute permeability.

134. The method of claim 131, further comprising producing fifty percent of the gas in the area while the relative permeability of coal to gas of the coal matrix remains below the twenty percent of absolute permeability.

135. The method of claim 131, further comprising producing sixty percent of the gas in the area while the relative permeability of coal to gas of the coal matrix remains below the twenty percent of absolute permeability.

136. The method of claim 131, further comprising producing seventy percent of the gas in the area while the relative permeability of coal to gas of the coal matrix remains below the twenty percent of absolute permeability.

137. A method for surface production of gas from a subterranean coal seam, comprising;

providing an omni-directional horizontal well bore pattern operable to intersect a number of natural fractures in a coal seam having medium to low effective permeability;

producing gas from an area of the coal seam covered by the well bore pattern in two-phase flow with water from the area; and producing thirty percent of gas from the area of the coal seam covered by the well bore pattern while relative permeability of coal to gas of a matrix coal in the coal seam remains below ten percent of absolute permeability.

138. The method of claim 137, further comprising producing forty percent of gas from the area while the relative permeability remains below the ten percent of absolute permeability.

139. A method for surface production of gas from a subterranean zone, comprising:

forming a horizontal drainage pattern in a subterranean zone having a medium to low effective permeability;

the horizontal drainage pattern including a plurality of cooperation bores and connected to a surface well bore;

collecting fluids from an area of the subterranean zone covered by the horizontal drainage pattern through the horizontal drainage pattern, the area comprising at least one hundred acres;

producing fluids collected from the subterranean zone to the surface through the surface well bore; and producing twenty-five percent of total gas in the area of the subsurface zone within two years of the start of water production.

* * * * *

UNITED STATES PATENT AND TRADEMARK OFFICE

CERTIFICATE OF CORRECTION

PATENT NO. : 8,333,245 B2
APPLICATION NO. : 10/246052
DATED : December 18, 2012
INVENTOR(S) : Joseph Alan Zupanick and Monty H. Rial It is certified that error appears in the above-identified patent and that said Letters Patent is hereby corrected as shown below:

In the Claims:

In Claim 28, column 29, line 34, delete "one third" and insert -- one-third --.

In Claim 35, column 29, line 55, delete "two thirds" and insert -- two-thirds --.

In Claim 36, column 29, line 58, delete "two thirds" and insert -- two-thirds --.

In Claim 54, column 31, line 15, delete "psi)." and insert -- (psi). --.

In Claim 99, column 33, line 54, delete "subpatterns" and insert -- sub-patterns --.

In Claim 130, column 35, line 58, delete "onini" and insert -- omni --.

In Claim 137, column 36, line 31, delete "comprising;" and insert -- comprising: --.

Signed and Sealed this
Thirtieth Day of April, 2013

Teresa Stanek Rea

Teresa Stanek Rea
*Acting Director of the United States Patent and Trademark Office*